US005680995A

United States Patent [19]

Salminen

[11] Patent Number: 5,680,995

[45] Date of Patent: Oct. 28, 1997

[54] CONTINUOUS DIGESTER

[76] Inventor: Reijo K. Salminen, 373 Cove Rd., Bellingham, Wash. 98226

[21] Appl. No.: 672,458

[22] Filed: Jun. 28, 1996

Related U.S. Application Data

[60] Provisional application No. 60/000,830 Jun. 29, 1995, and 60/004,474 Sep. 28, 1995.

[51] Int. Cl.[6] ..... B02C 19/12

[52] U.S. Cl. ..... 241/21; 241/23; 241/24.11; 241/24.29; 241/28; 241/46.01; 241/65; 241/70

[58] Field of Search ..... 241/15, 21, 23, 241/24.11, 24.29, 28, 46.01, 65, 70, 79.1, 46.17

[56] References Cited

U.S. PATENT DOCUMENTS

| | | | |
|---|---|---|---|
| 3,773,610 | 11/1973 | Shouvlin et al. | 241/28 X |
| 4,235,665 | 11/1980 | Reinhall et al. | 241/28 X |
| 4,726,880 | 2/1988 | Smith | 241/28 X |
| 4,872,953 | 10/1989 | Smith | 241/79.1 X |
| 4,886,576 | 12/1989 | Sloan | 241/28 X |
| 5,133,507 | 7/1992 | Sepling et al. | 241/78 |
| 5,358,185 | 10/1994 | Konecsny | 241/18 |
| 5,568,896 | 10/1996 | Adams et al. | 241/24.29 |

*Primary Examiner*—John M. Husar
*Attorney, Agent, or Firm*—Robert B. Hughes

[57] ABSTRACT

A continuous pulp digester having an elongate horizontally aligned pressure vessel through which the wood chips and digesting fluid flow in a forward direction. In a first and second embodiments within the pressure vessel there is an inner container defining an elongate chamber or passageway having a square cross sectional configuration. In a third embodiment the digesting chamber is cylindrical. At locations along the digester, there are several pair of liquid flow inlets and liquid flow outlets which enable filtrate from a pulp washer and a digesting agent to be moved into and across the digesting chamber to flow out the flow outlets. These are recirculated in a net upstream flow pattern toward the outlet end of the digester, and discharged as black liquor at different locations in the digester.

20 Claims, 44 Drawing Sheets

400
418
EVAPORATION AND RECOVERY
424
422
426
404
414
497
526
524
411
590
410
518
586
578
402
420
421
570
562
568
529
407
408
406
414
416
530

FIG. 42

| Ref. Line | Filtrate/Liquor Flow T deg C | Alco % | DS % | Position | Pulp/Chip Flow T deg C | Alco % | DS % |
|---|---|---|---|---|---|---|---|
| | | | | RKS-Washer | | | |
| 1 | 30 | 0 | 0 | RKS-Washer in | 74 | 17.5 | 0.07 |
| 2 | 74 | 15 | 0.06 | RKS-Washer out | 50 | 0.2 | 0.01 |
| | | | | Digester blow-end | | | |
| 3 | 68 | 15 | 0.06 | 1st Filtr.wash/in | 135 | 58 | 0.16 |
| 4 | 128 | 49 | 0.13 | 1st Filtr.wash/out | 75 | 17.5 | 0.07 |
| 5 | 135 | 60 | 0 | 1st Alco wash/in | 135 | 50 | 0.75 |
| 6 | 135 | 51 | 0.7 | 1st Alco wash/out | 135 | 58 | 0.16 |
| 7 | 128 | 49 | 0.13 | 2nd Filtr.wash/in | 195 | 59 | 5.9 |
| 8 | 188 | 57 | 4.5 | 2nd Filtr.wash/out | 135 | 50 | 0.75 |
| | | | | Digester mid-sect. | | | |
| 9 | 195 | 61 | 0 | 2nd Alco wash/in | 195 | 52 | 1.7 |
| 10 | 195 | 53 | 1.6 | 2nd Alco wash/out | 195 | 59 | 0.3 |
| 11 | 195 | 51 | 0.7 | 3rd Filtr.wash/in | 195 | 56 | 5.1 |
| 12 | 195 | 56 | 4.7 | 3rd Filtr.wash/out | 195 | 52 | 1.7 |
| 13 | 195 | 57 | 4.5 | 4th Filtr.wash/in | 195 | 51 | 10.4 |
| 14 | 195 | 52 | 9.1 | 4th Filtr.wash/out | 195 | 56 | 5.1 |
| | | | | Impregnation sect. | | | |
| 15 | 205 | 53 | 1.6 | 5th Filtr.wash/in | 174 | 49 | 7.4 |
| 16 | 176 | 50 | 6.6 | 5th Filtr.wash/out | 195 | 51 | 3.3 |
| 17 | 195 | 56 | 4.7 | 6th Filtr.wash/in | 130 | 37 | 7.5 |
| 18 | 133 | 43 | 6.9 | 6th Filtr.wash/out | 174 | 49 | 5.7 |
| 19 | 176 | 50 | 6.6 | 7th Filtr.wash/in | 34 | 19 | 6.6 |
| 20 | 41 | 28 | 6.6 | 7th Filtr.wash/out | 130 | 37 | 6.6 |

CONTINUOUS DIGESTER

CROSS REFERENCE TO RELATED APPLICATIONS

This application claims the priority of U.S. Provisional patent application Ser. No. 60/000,830 filed Jun. 29, 1995 and Provisional patent application Ser. No. 60/004,474 filed Sep. 28, 1995.

BACKGROUND OF THE INVENTION

The present invention relates generally to the art of wood pulp digesters, and more particularly to a continuous digester.

BACKGROUND ART

In a typical continuous pulp digester, the wood chips and the white liquor are fed into the upper end of a vertically aligned digester, with the interior of the digester defining a cylindrical digesting chamber maintained at a relatively high pressure (e.g. 200 PSI) and high temperature (e.g. approximately 380° F.). The mixture of chips and white liquor moves slowly and downwardly through the digester so that the total dwell time within the digester is generally between about two to four hours. During the period that the wood chips are in the digester, the white liquor reacts with the material in the wood chips to break down certain organic compounds in the wood chips so as to "delignify" the pulp. At several locations along the length of the digester, portions of the liquid are extracted, either to be recirculated back into the digester, sent to an evaporator, or possibly to be processed elsewhere in the system. To retain the wood chips that are being processed in the digester, the liquid is extracted through sets of screens which are generally placed in sets at vertical locations circumferentially around the digester.

SUMMARY OF THE INVENTION

The continuous digester system of the present invention comprises a pressure vessel having a lengthwise axis, a rear upstream inlet end having a wood chip intake means, and a front outlet means having a pulp outlet means. The vessel has an elongate processing chamber through which wood chips travel forwardly in the presence of a digesting agent while being transformed into pulp, with the pulp being discharged from the pulp outlet means at the front outlet end of the vessel. There is a liquid flow means to circulate the processing liquid through said digester system to carry dissolved solids with said processing liquid, said flow means comprising the following:

i. an initial inlet means to initially introduce processing liquid into the pressure vessel at an an initial inlet downstream location;

ii. a plurality of processing liquid inlet means at inlet locations along the lengthwise axis of the pressure vessel to introduce processing liquid into the processing chamber;

iii. a plurality of processing liquid outlet means at outlet locations along the lengthwise axis of the pressure vessel to extract processing liquid from said processing chamber, said outlet locations being spaced laterally from said inlet location so that flow of said processing liquid from each of said inlet means to related outlet means has a lateral flow component through said processing chamber;

iv. recirculating means comprising a plurality of interconnecting line means, at least some of said interconnecting line means connecting at least some of the outlet means with related inlet means at further upstream locations to direct processing liquid from said at least some of said liquid outlet means through related interconnecting line means to further upstream locations to flow through the related inlet means into the processing chamber and laterally in the processing chamber to other outlet means to again be recirculated through related interconnecting line means to other inlet means;

v. liquor outlet means to discharge liquor for further processing, said liquor outlet means being upstream of the initial downstream location and upstream of at least some of said liquid inlet means and said liquid outlet means.

The digesting system is characterized in that the processing liquid moving in a recirculating pattern through the processing chamber and through the recirculating means carries dry solid content extracted from the wood chips during processing in the processing chamber in a net upstream flow pattern to be discharged from the processing chamber at said liquor outlet means.

In the preferred system, there is a washer to receive pulp from the digester and to dewater and wash the pulp. A substantial portion of filtrate from the washer is directed into the initial inlet means to move through the recirculating means into said net upstream direction.

Also, in the preferred form, the digesting agent is introduced into the liquid flow means to flow through the recirculating means in a net upstream direction to extract dry solids content from the wood chips being processed and carry these in the net upstream direction.

In the preferred form, the system further comprises an evaporation and recovery means to receive liquid discharged from the pressure vessel at a plurality of discharge locations at different operating locations in said pressure vessel so as to extract liquor having different characteristics from different extraction locations.

In the preferred embodiments of the present invention, the digesting agent is alcohol. The evaporation and recovery means extracts the alcohol from the liquor and recirculates the recovered alcohol back to liquid flow means to be recirculated into the liquid flow means.

Also, in the preferred form the system comprises an impregnation zone located in the pressure vessel at a more upstream location. There is at least one cooking zone located downstream of the impregnation zone, and at least one wash displacement zone located downstream of the cooking zone. At least some of the liquid inlet means and liquid outlet means are located at said displacement wash zone to receive the processing liquid and recirculate the processing liquid sequentially through related pairs of the liquid inlet means and the liquid outlet means. The flow means further comprises means to move the processing liquid from the wash displacement zone to an upstream location to be directed into the cooking zone to flow in a downstream direction in the processing chamber toward the displacement wash zone.

Desirably, processing liquid from the dislacement wash zone is recirculated to the impregnation zone to flow downstream in said vessel through said impregnation zone and into said cooking zone. Also, liquor is extracted from the impregnation zone and directed to the evaporation and recovery means for processing. In this arrangement, liquor also is extracted from the cooking zone and directed to the evaporation and recovery means for processing.

In the system of the present invention, the net upstream flow created by the liquid flow means comprises at least one displacement zone having a downstream end and an upstream end, with a plurality of a liquid outlet means being positioned at longitudinally spaced locations along a length of the displacement wash zone and a plurality of the outlet means positioned at spaced locations along the length of the displacement zone. The pluralities of liquid outlet and liquid inlet means are arranged so that there are related first downstream and second upstream liquid inlet means being arranged relative to related first downstream and second upstream outlet means in a manner that at least a portion of flow from the first downstream inlet means flows through the processing chamber to pass into the first downstream outlet means. Then at least a portion of the flow into the first downstream inlet means is recirculated to the second upstream inlet means, with at least a portion of the flow from the second liquid inlet means flowing across the processing chamber to the second upstream inlet means. At least a portion of the flow from the second upstream inlet means is recirculated by the recirculating means in an upstream direction. In this manner, the net upstream flow of processing liquid is accomplished.

The pressure vessel has a generally cylindrical cross sectional configuration transverse to its lengthwise axis. In two embodiments, there is inside the pressure vessel an inner-containing means, defining the elongate processing chamber, and comprising at least in part planar wall surfaces. Screen means are located at longitudinally spaced locations at the planar wall surfaces, so that at least some of the liquid inlet means passes liquid into the processing chamber through the screen means, and at least some of the liquid outlet means discharges processing liquid through related screen means. Desirably, there is propeller blade means which move across related screen means to prevent obstruction of flow through the screen means.

In another configuration, the cylindrical sidewall itself defines the processing chamber. At least one of the liquid inlet means and outlet means comprises liquid passageway means formed in the cylindrical sidewall, with the passageway means having flow axes which are slanted in a radially inward and forward direction. This flow means desirably comprises a plurality of circumferential ring assemblies positioned at longitudinally spaced locations along the sidewall. Each ring assembly defines a flow chamber to communicate with related passageway means extending through the wall member.

Also, in a preferred form, adjacent pairs of aligned liquid inlet means and liquid outlet means are arranged in an angularly alternating relationship, so that a cross flow of processing liquid between such adjacent alternating pairs have different flow directions through the processing chamber.

In a preferred form, the evaporation and recovery means comprises at least first and second heat exchange means and first and second separator means. The first evaporator means initially receives the liquor from the pressure vessel and after evaporation discharges liquor which is then directed to the first separator means, where a portion of the liquor is separated. The remaining liquor is directed to the second heat exchange. Then the liquor from the second heat exchange means is directed to the second separator means to extract another portion of the liquid from the second heat exchange means.

In preferred form, the pressure vessel is aligned so its major alignment component is horizontal.

In the method of the present invention, a pressure vessel and flow system is provided as described above. The flow of the wood chips is in a downstream direction, while there is a recirculation of the processing liquid in an upstream direction, as described above.

Other details of the present invention will become apparent from the following detailed description.

BRIEF DESCRIPTION OF THE DRAWINGS

FIG. 42 is a table showing various values, namely temperature, alcohol contents, and dissolved solid contents, at various locations in the digester;

DESCRIPTION OF THE PREFERRED EMBODIMENTS

1. Typical Prior Art Digesting Process

Figure 1:
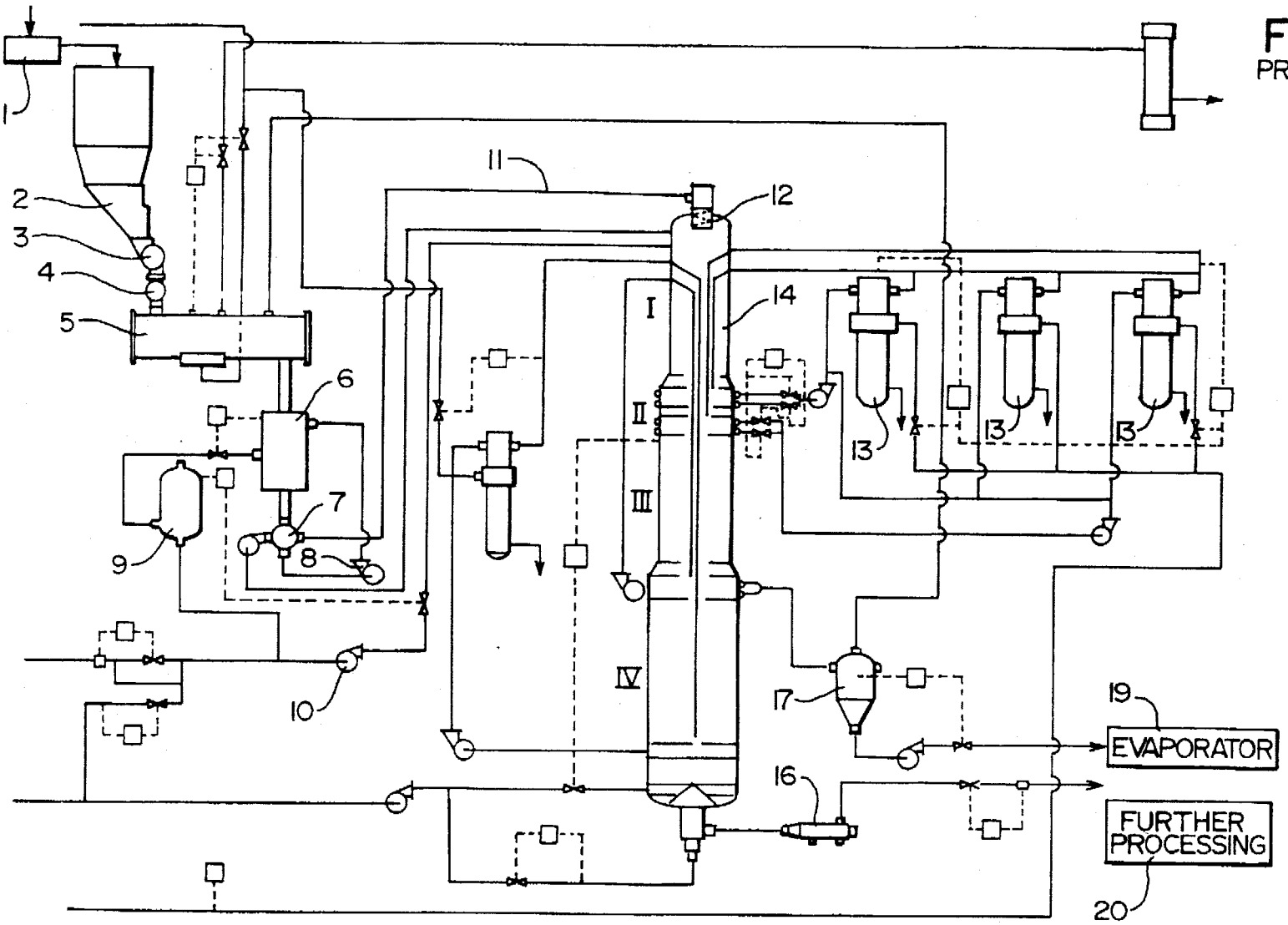
FIG. 1 PRIOR ART
FIG. 1 is a schematic drawing illustrating the main components and system of a prior art digesting system.

It is believed that a clearer understanding of the present invention will be obtained by first reviewing the digesting portion of a typical pulp mill for which the present invention is particularly adapted. With reference to FIG. 1, the wood chips are first subjected to magnetic separation of tramp iron and screening at location 1, and then directed into a surge bin of a hopper indicated at 2. From the hopper, the chips flow into a chip meter 3 which controls the rate of flow of the chips which then pass into a low pressure feeder 4.

The feeder 4 directs the chips into a steaming vessel 5 that is kept at between 15 to 20 PSI where the chips are pre-steamed. The chips are then directed from the steaming vessel 5 into the chip chute 6, from which the chips move to a high pressure feeder 7. The chips are flushed into the feeder by means of a chip chute circulating pump 8. As seen in FIG. 1, the flow from the pump 8 into the chip chute 6 and to the feeder 7 is in a counterclockwise direction. Liquor level of the chip chute 6 is controlled by the level tank 9. The wood chips mixed with a certain amount of liquor are then moved from the feeder 7 through a line 11 into a top strainer 12 to the top of the digester 14. A high pressure pump 10 introduces the cooking liquor to the digester, as well as the excess liquor from the chip chute level tank 9. The volume of the cooking liquor can be controlled by a magnetic flow meter.

In general, the digester pressure is controlled so as to be at about 200 PSI. The chips and the cooking liquor gradually move downwardly in the digester, first passing into an upper impregnation Zone I and then to the heating Zone II.

The temperature is raised in two steps by two cooking circulating systems, which comprise extraction strainers, pumps and central circulating chambers. Three heaters 13 are shown. After heating, the chips and liquor pass downwardly through the cooking zone III of the digester. As the chips then pass into the lower washing zone IV of the digester, extracted wash liquor is circulated through the chips to provide a quench of the cooking reaction. The chips continue to pass downwardly in the washing zone IV, then to be discharged. The entire sequence is arranged so that the duration of the digesting process is about one and one half to four hours.

Wash liquor from a subsequent filtrate tank or fresh hot water is pumped into the bottom of the digester and flows inwardly countercurrently to the chip flow. Elevated temperatures of 125° C. (to 135°) are controlled in the diffusion zone by an auxiliary wash liquor circulation and heater system.

At various locations in the digester, the liquor is recirculated to an upper location. A portion of the liquor that is extracted between zone III and zone IV is directed to a flash tank 17, and thence to flash heat evaporators. The pulp that is extracted from the bottom of the digester is directed to a blow unit 16 which has a pressure reducing function, and then further directed to a brown stock washer 19 and/or to some other location for further processing as indicated schematically at 20.

A. FIRST EMBODIMENT

2. The Overall Structure and Operation of a First Embodiment of the Digester In this section there will be a brief description of the overall construction and operation of the digester and the digesting system of the first embodiment of the present invention. Then in the following sections there will be descriptions of the main structural components which are particularly adapted for use in this first embodiment, and also a more detailed description of the overall operation of the digesting system and other aspects and variations of the same.

Figure 2:
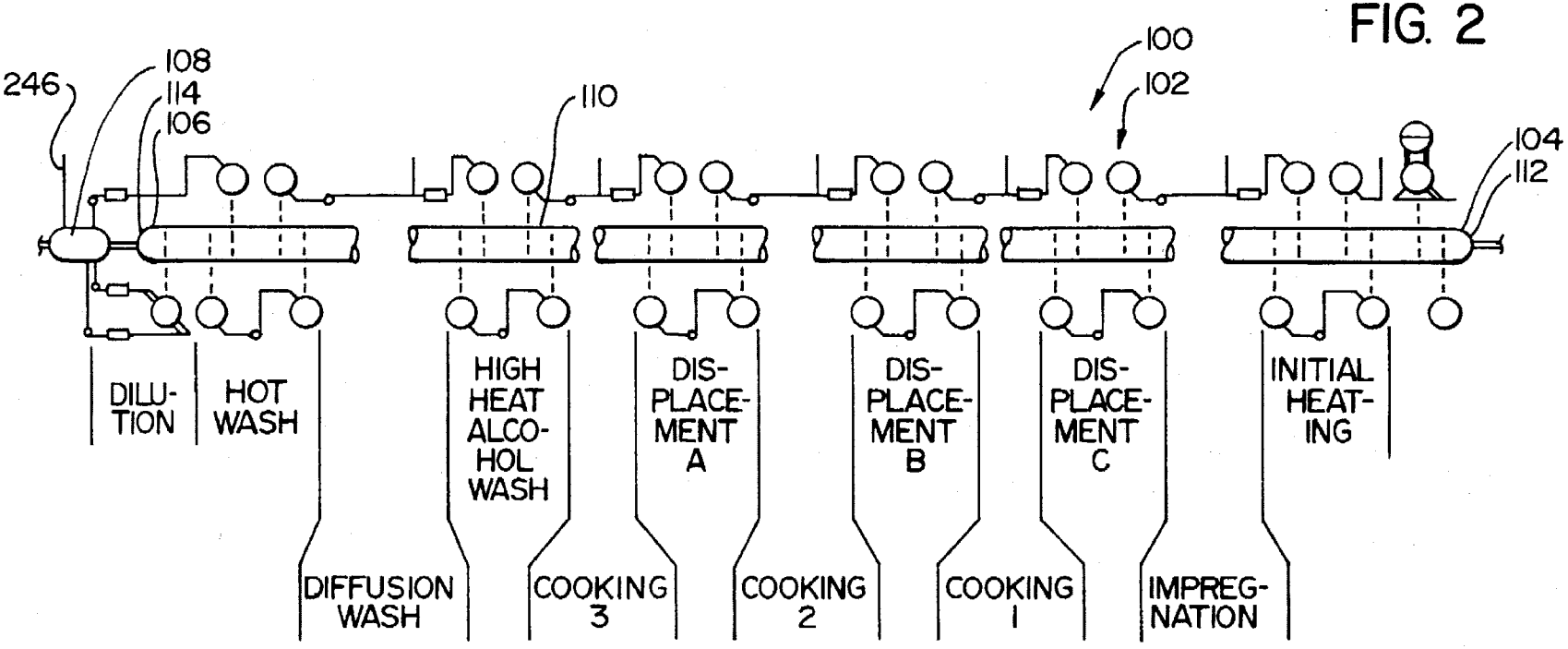
FIG. 2 is a somewhat schematic side elevational view illustrating the digesting system of the present invention.
Figure 3:
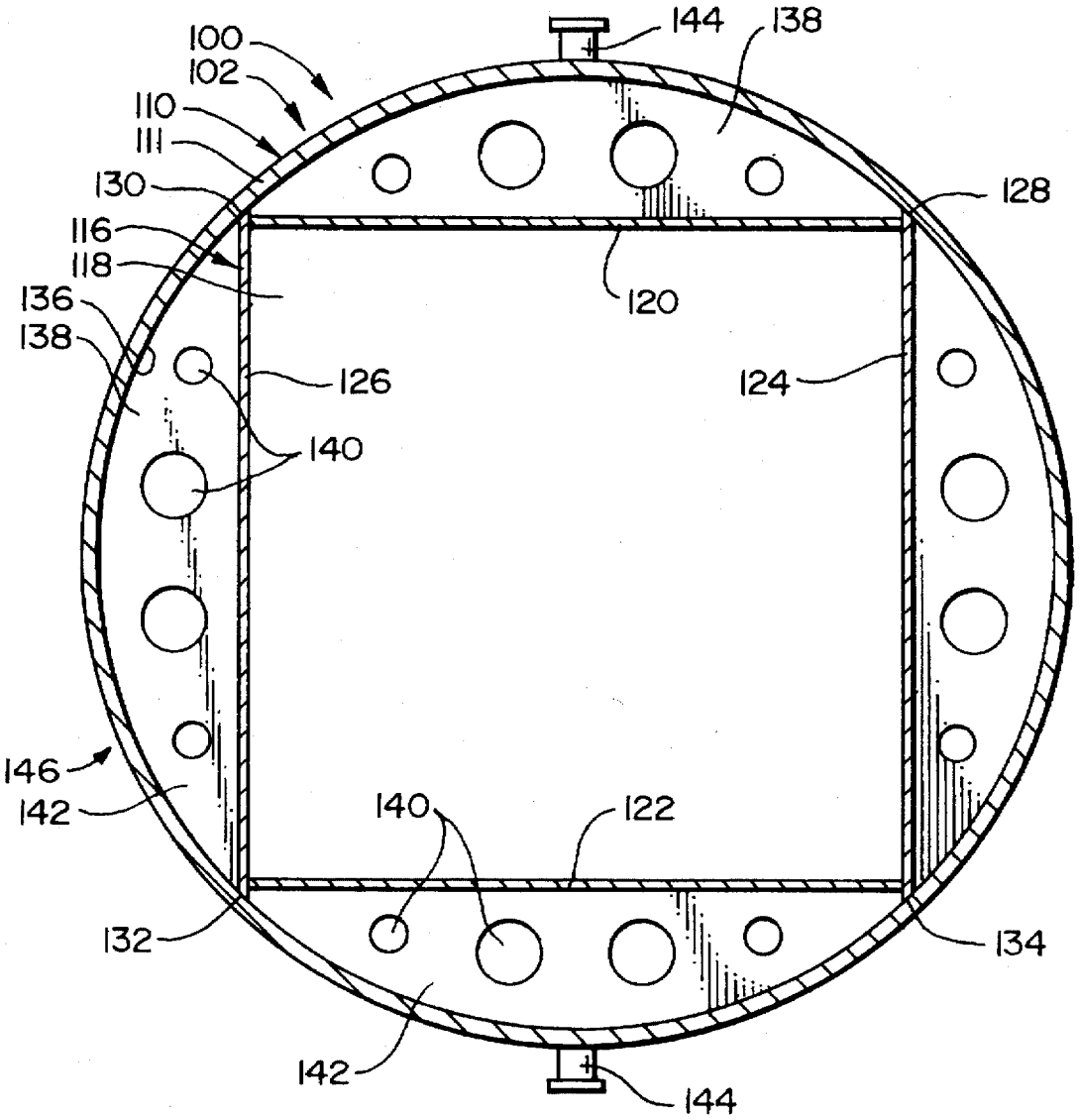
FIG. 3 is a transverse sectional view illustrating a typical cross section of the digester of the present invention.

To describe the first embodiment of the present invention, reference is first made to FIGS. 2 and 3. FIG. 2 is a schematic side elevational view of the digesting system 100 of the present invention. This digesting system 100 comprises an elongate, horizontally aligned digester 102, having a wood chip inlet end 104 and a pulp outlet end 106. At the pulp outlet end 106 there is a washer 108 which receives the pulp slurry from the digester 102 to dewater and wash the pulp and discharge it for further processing. In addition, the washer 108 cooperates with the digesting system 100 to recirculate filtrate from the washer back into the digester 102 near the exit end 106 thereof.

The wood chips are introduced into the inlet end 104 through an inlet of the digester 102 by conventional means and are mixed with the liquor in the digester. Over a period of several hours (e.g. usually two to four hours), the wood chips move continuously down the length of the digester 102 and proceed through various processing zones. When the wood chips reach the exit end 106; these have been substantially delignified, and the pulp is diluted with filtrate from the washer 108 and then passed into the washer 108.

In the following description, the term "wash water" means the fresh water which is introduced into the washer 108. The term "flitrate" shall refer to the liquid which is removed from the pulp 20. in the washer 108 during the dewatering operation (which will be called the "dewatering flitrate"), and the effluent which is discharged from the washer to be utilized at another location of the digester (this being called the "washer discharge filtrate". The term "liquor" or "liquors" shall refer to all of the liquid which is in the digester and has as one of its ingredients the digesting ingredient (which in this preferred embodiment is ethyl alcohol). Finally, the term "black liquor" shall refer to the liquor which is discharged from the digester for further processing. This discharge of black liquor takes place adjacent to the wood chip inlet end 104 of the digester 102.

The term "forward" shall denote a direction extending from the wood chip intake end 104 to the pulp discharge end 106, so that the rear end will be at 104 and the forward end will be the end at 106. The term "downstream" shall denote the direction of flow of the wood chips which are being processed in the digester, this direction being from the end 104 to the end 106, and the term "upstream" shall denote the opposite direction. The term "inner" shall denote proximity to a longitudinal center axis of the digester 102, and the term "outer" or "outward" shall denote a direction away from the longitudinal center axis of the digester 102 and/or a location more distant from the longitudinal center axis or line of the digester 102.

The filtrate from the washer in addition to being recirculated to dilute the pulp that exits from the digester end at 106, provides part of the liquid to form the liquor which is used in the digesting process within the digester 102. This is accomplished in a manner that the filtrate from the washer 108 enters the digester vessel 102 adjacent to the downstream end, and then is recirculated through the digester in a manner that the "net flow path" is in an upstream direction. This will be described in more detail later herein, but the following will give a brief summary of how this is accomplished.

In the preferred embodiment, the digesting ingredient is ethyl alcohol. As will be discussed more fully hereinafter, the present invention particularly adapts itself for the effective use of ethyl alcohol and solves problems which have been experienced in the prior art where ethyl alcohol is used as the digesting ingredient. However, within the broader scope of the present invention, it is to be understood that other digesting ingredients could be used and derive a good portion of the benefits of the present invention.

There are five main components in the digester 102 which are combined with other components of the system. As indicated above, there will now be descriptions of each of these five components in more detail.

3. Typical Cross Sectional Configuration of the Digester 102

The term digester 102 shall refer not only to the high pressure vessel which is the containing structure, but also to those components within the containing structure. Thus, with reference to FIG. 3, this digester 102 comprises a high pressure container 110 which has a cylindrical cross sectional configuration. This vessel 110 is typically made of a high strength steel capable of withstanding pressures up to as high as 500 PSI, and temperatures as high as 200° C. or higher. This vessel comprises a cylindrical containing wall 111 which extends the entire length of the digester 102, and it is enclosed at the ends.

The rear end of the digester vessel 110 is closed by a substantially hemispherical rear wall 112, and the front end is closed by a substantially hemispherical forward wall 114.

Positioned within the pressure vessel 110 is an inner container 116 which has a substantially square cross sectional configuration and which extends substantially the entire length of the digester 102 (See FIG. 3).

This inner container 116 defines an elongate chamber or passageway 118 (also having a square cross sectional configuration) which is the digesting area. This area 118 contains what are initially the wood chips and the digesting liquid (i.e. the liquor). The inner container 116 has an upper wall 120, a lower wall 122 and right and left sidewalls 124 and 126, respectively. These walls are joined to one another at corner locations which are designated (beginning at the upper right hand corner of FIG. 3 and proceeding counterclockwise) 128, 130,132 and 134. These corners 128 through 134 join directly with the inside surface 136 of the vessel wall. Alternatively, these corners 128 through 134 could be spaced inwardly from the vessel inner surface of the wall 111 136 and yet joined to the vessel 110 so that the areas surrounding the inner container 116 can communicate with one another.

Positioned between the inner surface 136 of the vessel 110 and the inner container 116, there is a plurality of reinforcing plates 138 welded or otherwise joined both to the outer pressure vessel 110 and the inner container 116. These plates 138 are positioned around all four walls of the inner container 116 at longitudinally spaced intervals along the length of the digester 102. These plates are provided with openings 140 so that a pressure equalizing fluid (either gaseous or liquid) can communicate between the areas 142 outside of the square container 116 between adjacent pairs of plates 138.

As indicated previously, the digesting process takes place at pressures as high as 200 to 500 PSI and temperatures as high as 150° to 200° C. The pressure vessel 110 is designed to withstand these high pressures and also to provide thermal insulation. Accordingly, the temperature and pressure levels within the inner chamber 118 should be substantially the same as the pressure and temperature of the areas 142 between the inner container 116 and the pressure vessel 110. This is accomplished by filling the areas 142 (which areas 142 have in cross section the shape of a segment of a circle) with a liquid or gaseous medium which would be kept at the same pressure as exist with the chamber 118 of the inner container 116. For this purpose, there are shown nozzles 144 which communicate with a fluid such as steam, or possibly a suitable liquid (e.g. condensate) to fill these areas 142 surrounding the inner container 116. These nozzles 144 will be provided for all space or areas of the vessel 110 which surround or are adjacent to the inner container 116.

As indicated above, what is shown in FIG. 3 is a typical cross section of the digester 102. These sections can be made in modules or units of, for example, four feet long, or as longer sections. The module shown in FIG. 3 is given the general numerical designation 146.

4. Fluid Inlet Unit of the Digester 102

Figure 4:
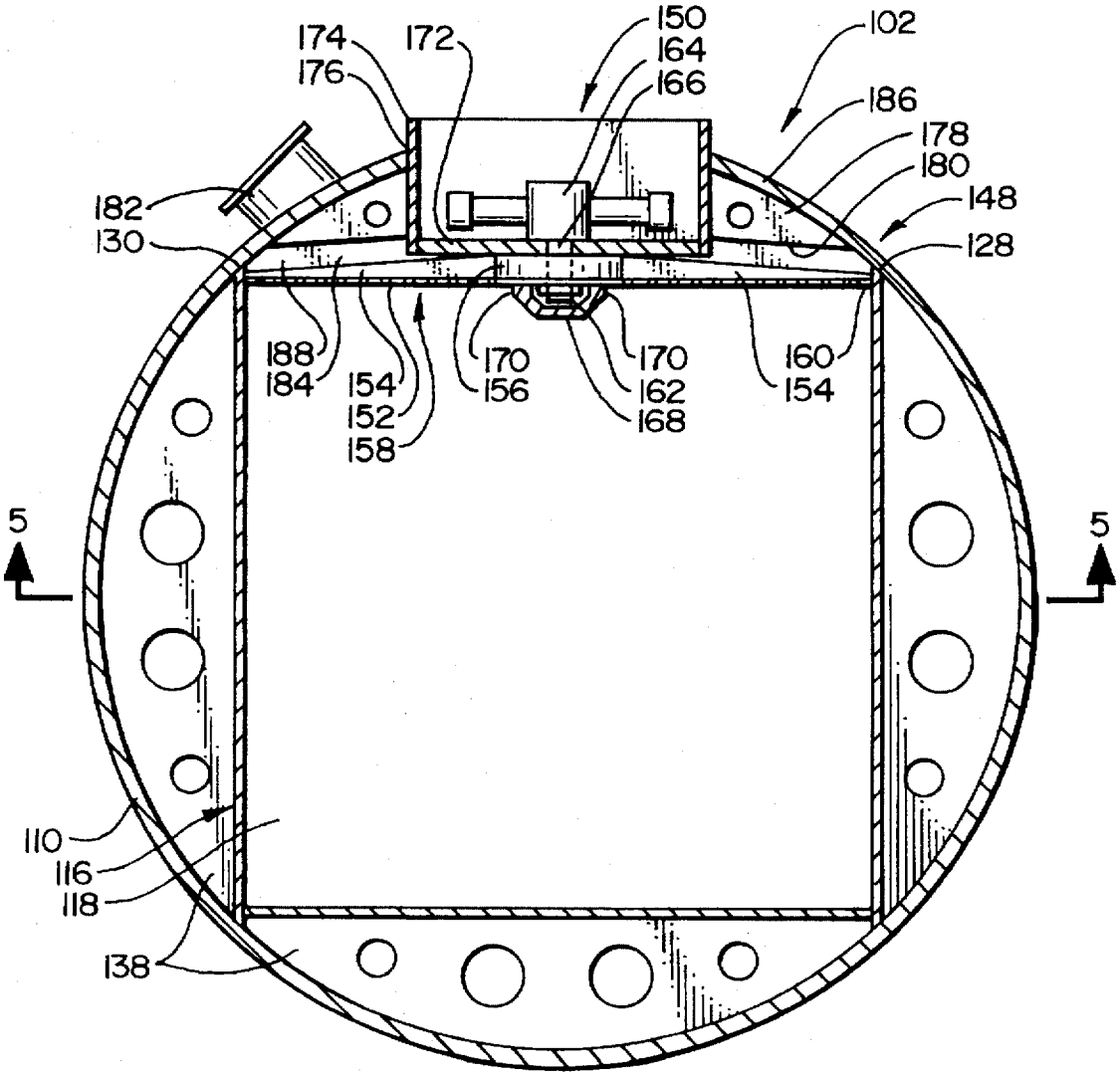
FIG. 4 is a transverse sectional view showing a liquid inflow module used in the digester of the present invention.

Reference is made to FIG. 4, where there is shown a fluid inlet module 148 of the digester 102. It can be seen that the cross sectional configuration of this section in FIG. 4 is substantially the same as shown in FIG. 3, in that there is the surrounding pressure vessel 110, the bracing or reinforcing plates 138, and the inner container 116. However, the top wall 120 of the inner container 116 is omitted. In its place, there is provided a fluid inlet assembly generally designated 150.

In place of the top wall 120, there is provided an inlet screen 152 which is positioned in a plane extending between the two top corner lines 128 and 130. This screen 152 has a circular configuration and is mounted to a plurality of radially extending bracing arms 154 which in turn connect to a central hub 156. The screen assembly 158 (made up of the screen 152, the bracing arms 154 and the hub 156, is rotatably mounted within a surrounding plate 160 which has an outer square perimeter and a circular cutout to receive the screen 152 and the bracing arms 154.

The hub 156 is connected (e.g. by the nut and drive shaft connection 162) to a hydraulic actuator 164. This hydraulic actuator 164 has an output shaft 166 which is caused to rotate in a reciprocating manner through 180° of rotation. Thus, the actuator 164 will rotate the screen assembly 158 180° in one direction, then 180° in the opposite direction.

Figure 5:
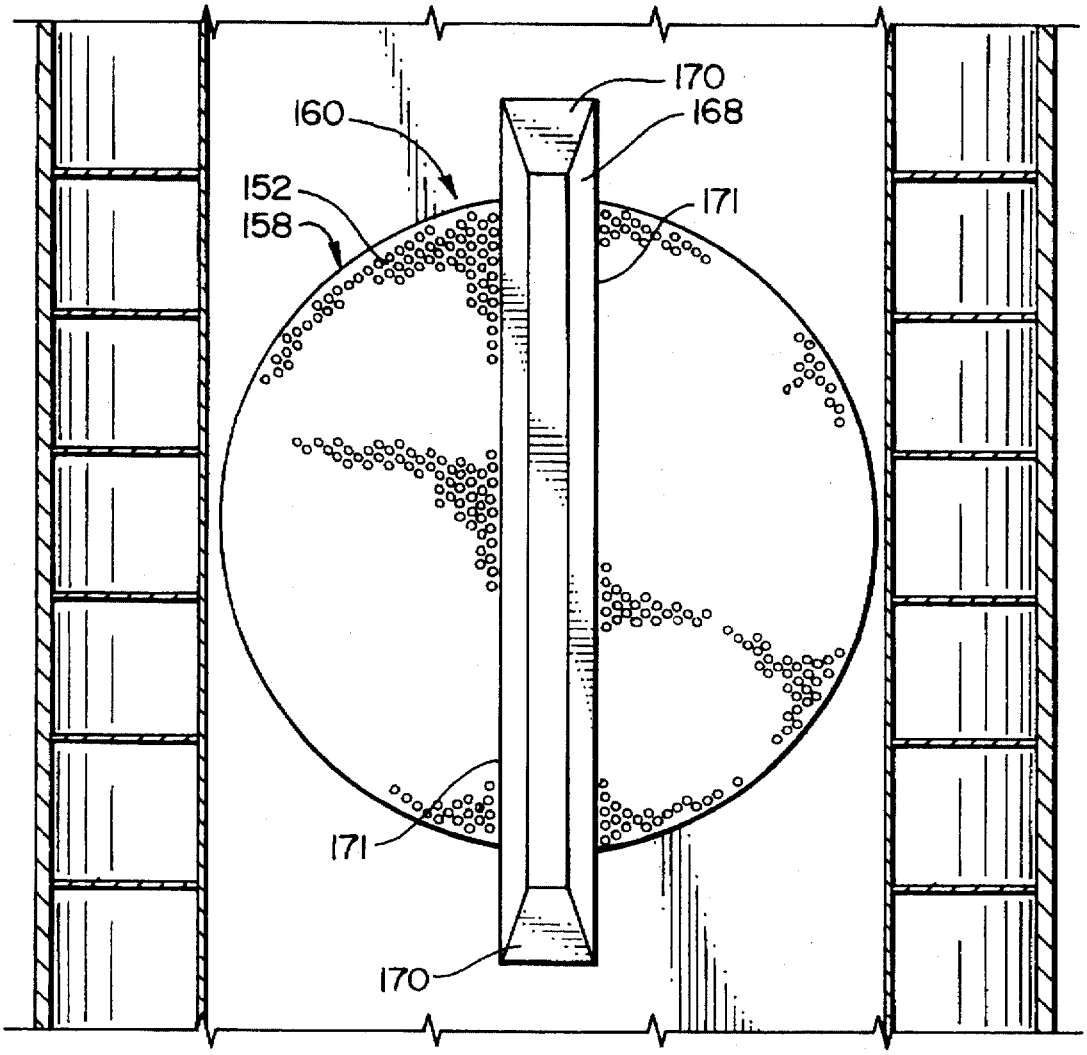
FIG. 5 is a sectional view taken along line 5—5 of FIG. 4.

There is provided a longitudinally aligned wiper blade 168 (FIG. 5) that extends diametrically across the entire screen 152 in a forward to rear direction. This wiper blade 168 remains stationary, and one means of accomplishing this is, as shown herein, to connect opposite ends 170 of the blade 168 to the plate structure 160 that surrounds the screen assembly 158. As the screen assembly 158 rotates through its 180° paths of travel, all portions of the screen 152 pass by the adjacent edge sections 171 of the blade 168 to maintain the screen 152 free of any matter that might clog the screen 152. This could be, for example, wood chips or pulp fiber bundles.

The screen assembly 158 and the rotary actuator 164 are mounted to a flat circular mounting plate 172 that is in turn mounted to a cylindrical plate 174 that is in turn welded or otherwise joined at 176 to an opening in the vessel wall 110. This mounting plate 172 and the cylindrical plate 174 are of steel construction and of sufficient strength to withstand the pressures within the vessel 110.

There are also partial bracing plates 178, but the inner edge 180 of these plates 178 is spaced a short distance outwardly of the arms 154. There is a fluid inlet nozzle 182 which leads into the area or space 184 which is between the screen assembly 158 and the adjacent wall portion 186 of the vessel 110.

The plate 160 which surrounds the screen assembly 158 has a square configuration around its perimeter. At the forward and rear edges of the plate 160, there are forward and rear isolating plates 188 which form an isolated chamber which is defined at the inner location by the screen 152 and the surrounding plate 160, on the outside by the adjacent portion 186 of the vessel 110, and at the forward and rear ends by the forward and rear plates 188.

In operation, the effluent which is to be directed into the vessel 110 is directed through the inlet nozzle 182 at a pressure slightly higher than the fluid within the chamber 118. This fluid entering through the nozzle 182 distributes itself throughout the area or volume 184 behind the screen assembly 158 and thus passes substantially uniformly through the screen 152 into the chamber 118. As this happens, the screen assembly 158 is rotated by the actuator 164 through the 180° arcuate path of travel to wipe the screen 152 free of any material which might clog the screen 152. This reciprocating rotation of the screen assembly 158 may not need to be done continuously, but could be done intermittently to keep the screen 152 open. (e.g. every two to fifteen minutes or longer). The screen is rotated slowly (e.g. one to five revolutions per minute depending on the position in the digester, faster at the forward end and slower at the rear end of the digester).

As indicated above, this modular fluid inlet unit 148 is used at different locations along the length of the digester 102 to direct fluid into the digester 102. The various functions performed by this unit 148 will be discussed later herein.

5. Fluid Outlet Unit of the Digester 102

Figure 6:
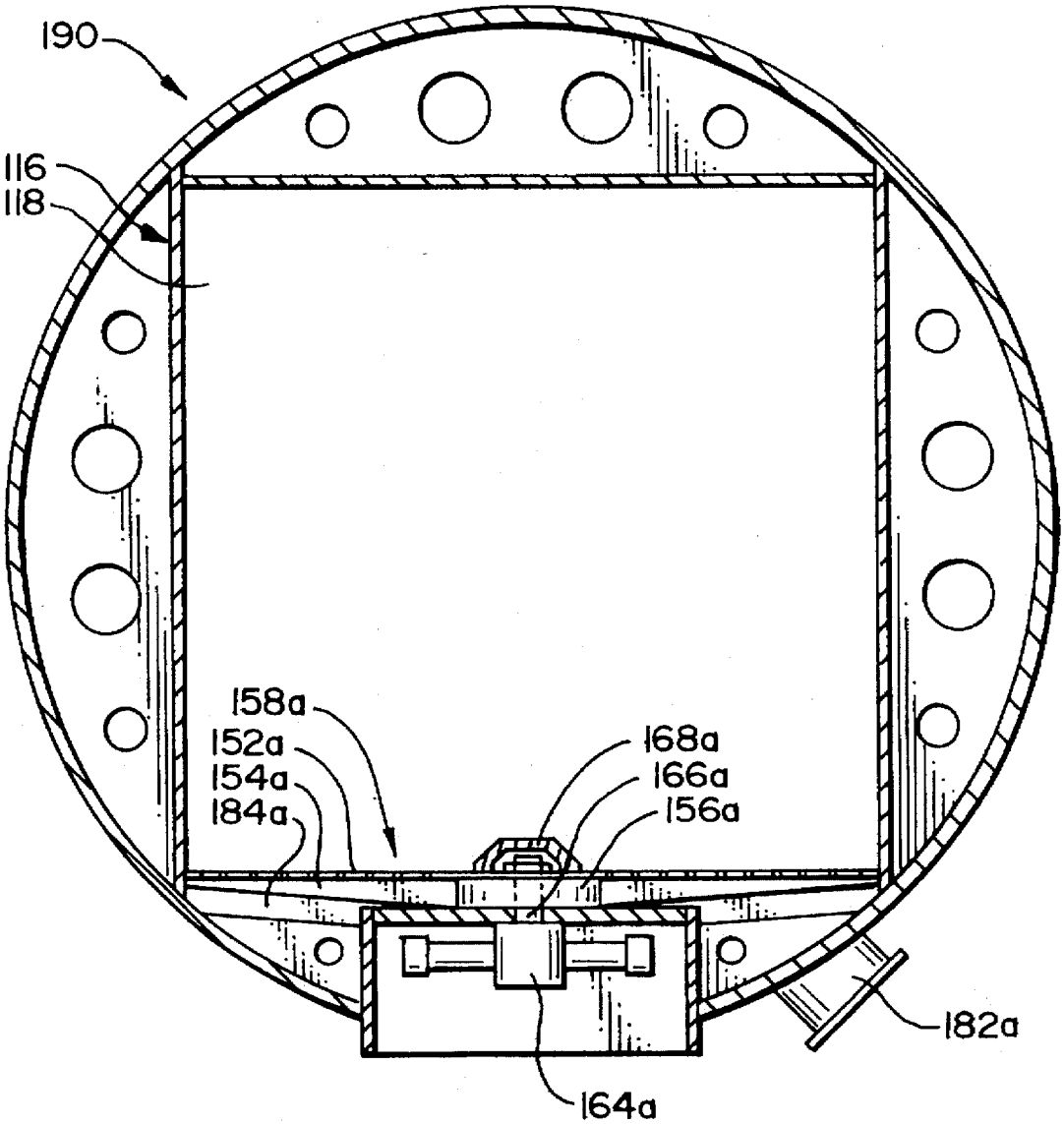
FIG. 6 is a transverse sectional view, similar to FIG. 4, showing a liquid outflow module of the present invention.

Reference is made to FIG. 6, which shows a module 190 which is constructed substantially identically to the module 148 shown in FIG. 4, except that the module 190 is inverted 180° relative to the module 148 of FIG. 4. With this similarity of structure, for convenience components of this module 190 which correspond to similar components of the module or unit 148 of FIG. 4 will be given like numerical designations with an "a" suffix distinguishing those of the module 190 shown in FIG. 6.

Thus, there is a screen assembly **158*a* comprising the screen 152*a*, the support arms 154*a*, and the hub 156*a*. There is a rotary actuator 164*a* along with its output shaft 166*a*, and also the wiper arm 168*a***. Other components will simply be given numerical designations with the "a" suffix without further verbal description.

The main difference in this unit 190 is that the nozzle **182*a*, instead of being an inlet nozzle is an outlet nozzle. Thus, the nozzle 182*a* is operated at a pressure slightly below that which exists within the digesting chamber 118**.

Also, since the flow from the digesting chamber 118 is outwardly through the screen **152*a*, there may be some tendency for the wood chips which are being processed into pulp to tend to accumulate on the screen 152*a*. The rotation of the screen assembly 158*a* relative to the blade 168*a*** alleviates this problem.

As will be discussed later herein, most all of the inlet units 148 are positioned so that each is adjacent to, and immediately upstream of, a related outlet unit 190. The pressure differential from the chamber 184 of the inlet unit 148 to the chamber 118 and thence to the outlet chamber **184*a* is such that it causes a fluid flow into the chamber 118 (through the screen 152) and outwardly from the chamber 118 (through the screen 152*a*). As the wood chips/pulp and liquor move forwardly in the chamber 118, the fluid flows outwardly through the screen 152 displaces the liquor in the chamber 118 downwardly so that as the displaced fluid moves downwardly through the chamber 118 it is also moving forwardly. As this liquor reaches the lower wall of the inner container 116, it is then adjacent to the outlet screen 152*a* so that this displaced liquid then flows out the lower conduit 182*a*. This operation is accomplished at various locations along the length of the digester 102** and will be described more completely in the next section.

Figure 7:
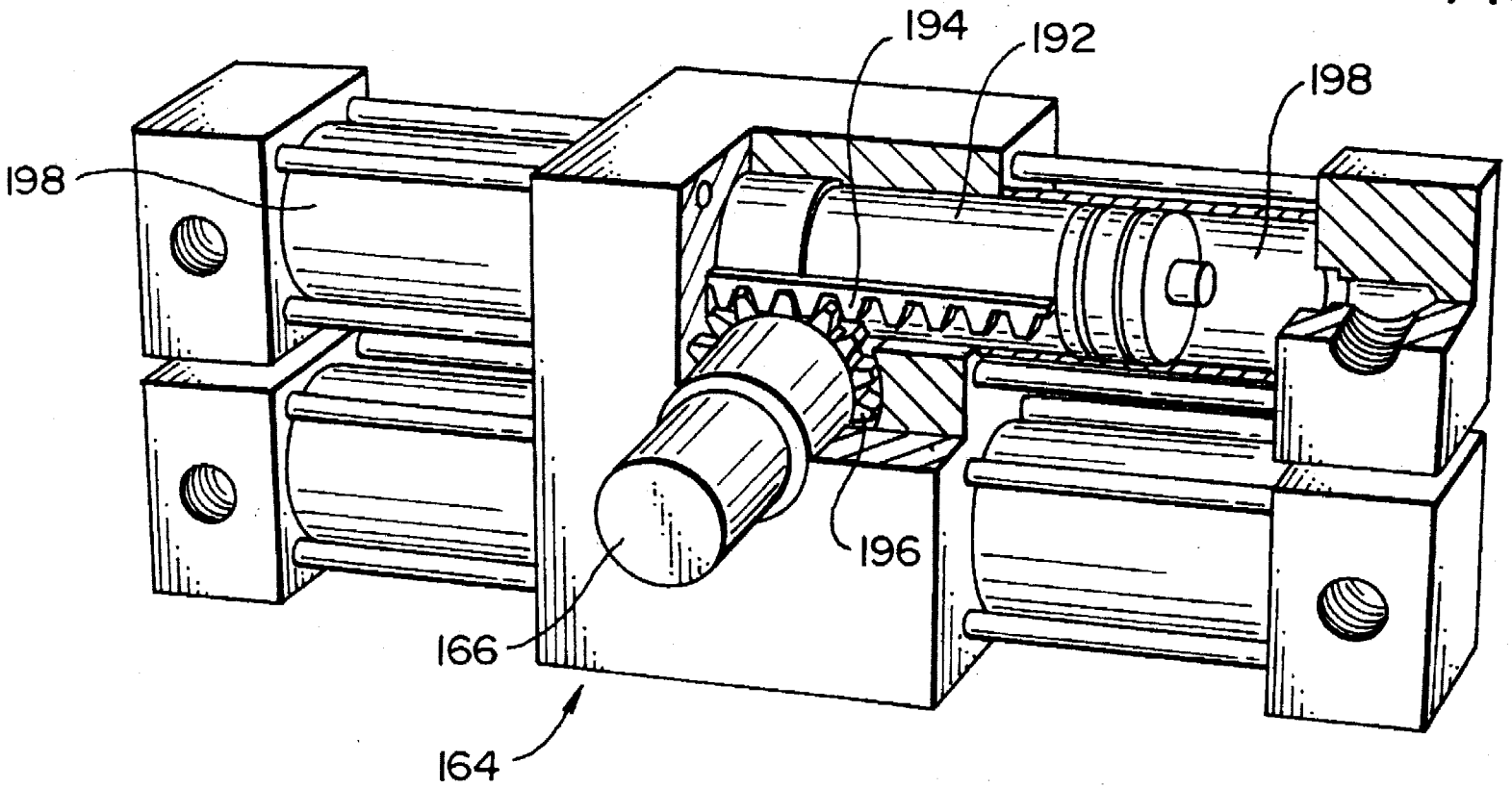
FIG. 7 is an isometric view of one of the hydraulic actuators used in the liquid outflow and liquid inflow modules of the present invention.

To describe the rotary actuators 164 and **164*a*, reference is made to FIG. 7. This actuator 164 or 164*a* is, or may be of more or less conventional design. There are upper and lower reciprocating pistons 192, each of which have gear teeth 194 which engage with gear teeth 196 connected to the shaft 166. Hydraulic fluid is directed alternatively into the chambers 198 at opposite ends of each piston 194. The fluid is directed into, and discharged from, the chambers 198 in a manner to reciprocate the pistons oppositely to one another and thus move the shaft 166 through alternating 180° paths of revolution. As described above, this causes the 180° alternating rotation of the two screen assemblies 152 and 152*a***.

In the area of the rack and pinion gear teeth 194 and 196, there is maintained an oil pressure moderately higher than the pressure in the digesting chamber 118. Seals are provided around the shaft 166 to prevent the oil in this area from flowing into the interior of the digester 102. Also, a seal is provided between the housing of the actuator 164 and the plate 172.

6. Flow Patterns in Displacement Zones

Figure 8:
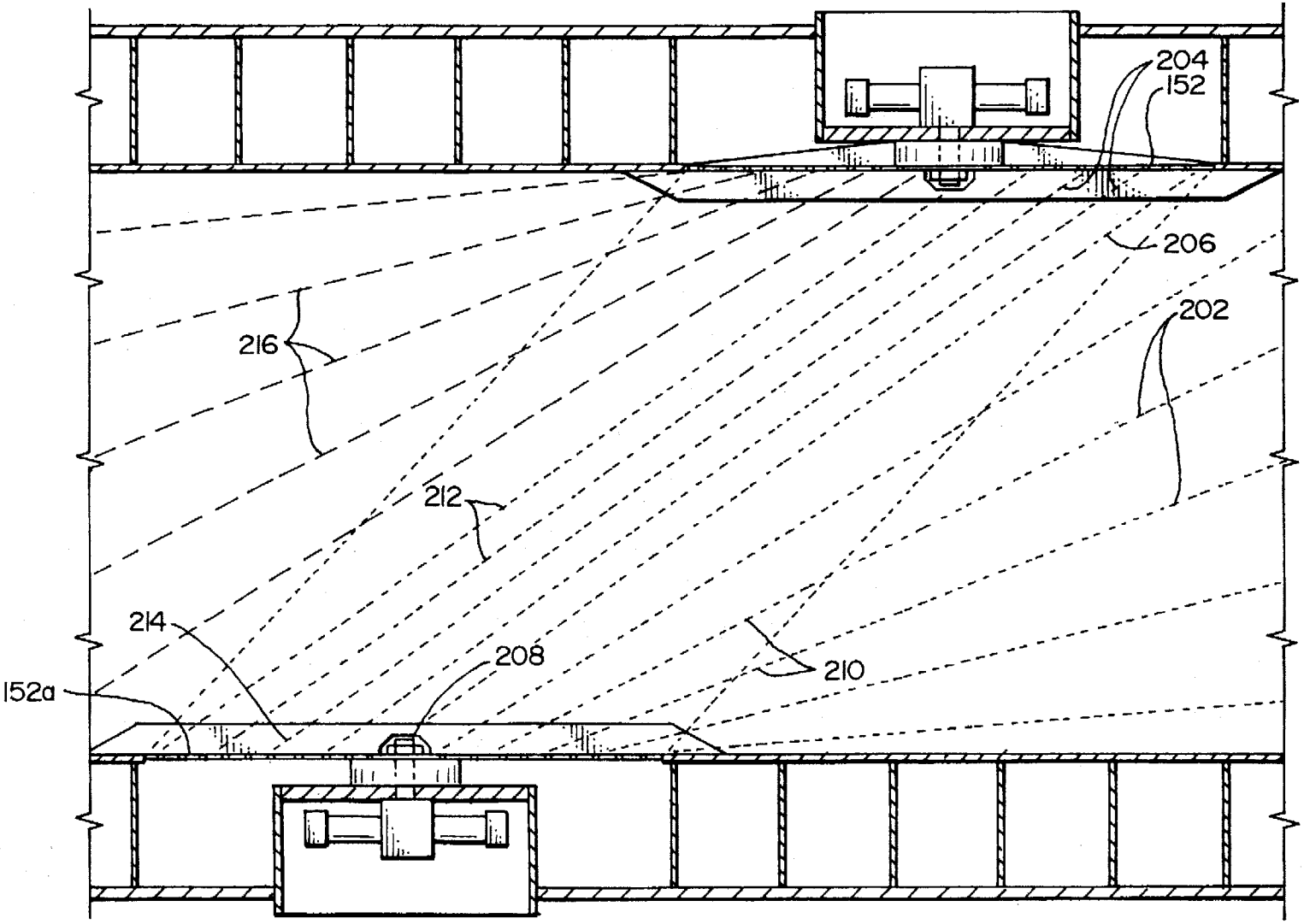
FIG. 8 is a longitudinal sectional view of a portion of the digester illustrating the flow pattern from an inlet module to an outlet module of the digester.

Reference is now made to FIG. 8 which illustrates a typical displacement flow pattern between an inlet module 148 and an outlet module 190.

As the wood chips are introduced into the rear end 104 of the digester 102 and progress through the digester 102, they lose their character as wood chips and become delignified pulp fibers. The consistency of the pulp in the digester is typically about 12.5%, which means that there are two parts liquid within the fibers and five parts liquid surrounding the fibers.

In the right hand part of FIG. 8, the flow of the liquor moving into the displacement zone is indicated by the flow lines 202. The velocity of the liquor further upstream is about one and one half feet per minute. The average velocity of the liquor which flows from the screen 152*a* of the unit 190 is about three feet per minute. The pulp fibers tend to move through the digesting chamber or passageway 118 more as a plug, moving at the one and one half foot per minute rate of travel.

The diagonal cross flow between the units 148 and 190 does not have any significant tendency to compress this plug of pulp fibers, but the flow passes through the spaces surrounding the pulp fibers.

With further reference to FIG. 8, the initial flow of liquor from the screen 152 is indicated by the lines at 204. This flow forms an interface at 206 with the flow 202. It can be seen that that interface plane 206 extends longitudinally in a downstream direction at a downward slant. The result is that the interface plane 206 extends to about a mid-location at 208 of the screen 152*a*. The flow of the liquor 202 displaced through the screen 152*a* is illustrated by the lines at 210.

It is to be understood that the interface plane 208 is not a clearly defined plane and the adjacent liquors tend to combine to some extent in a mixing zone along the plane 208.

A portion 212 of the flow of liquor from the screen 152 follows a flow path to the screen 152*a* at 214. Another portion of the liquor from the screen 152 follows more of a diverging downstream flow, indicated by the lines 216.

From the above description, it is apparent that a high percentage of the liquid flow at 202 is displaced into the screen 152*a* for recirculation in an upstream direction. Also, a significant percentage of the flow from the screen 152 is directed in a downstream direction. However, this flow at most locations is subjected to a further downstream displacing action to be recirculated back up to an upstream location. The advantage of this will become more apparent in reviewing the later description of the overall operation of the system 100 of the present invention.

7. Pulp Diluting Unit of the Digester

Figure 9:
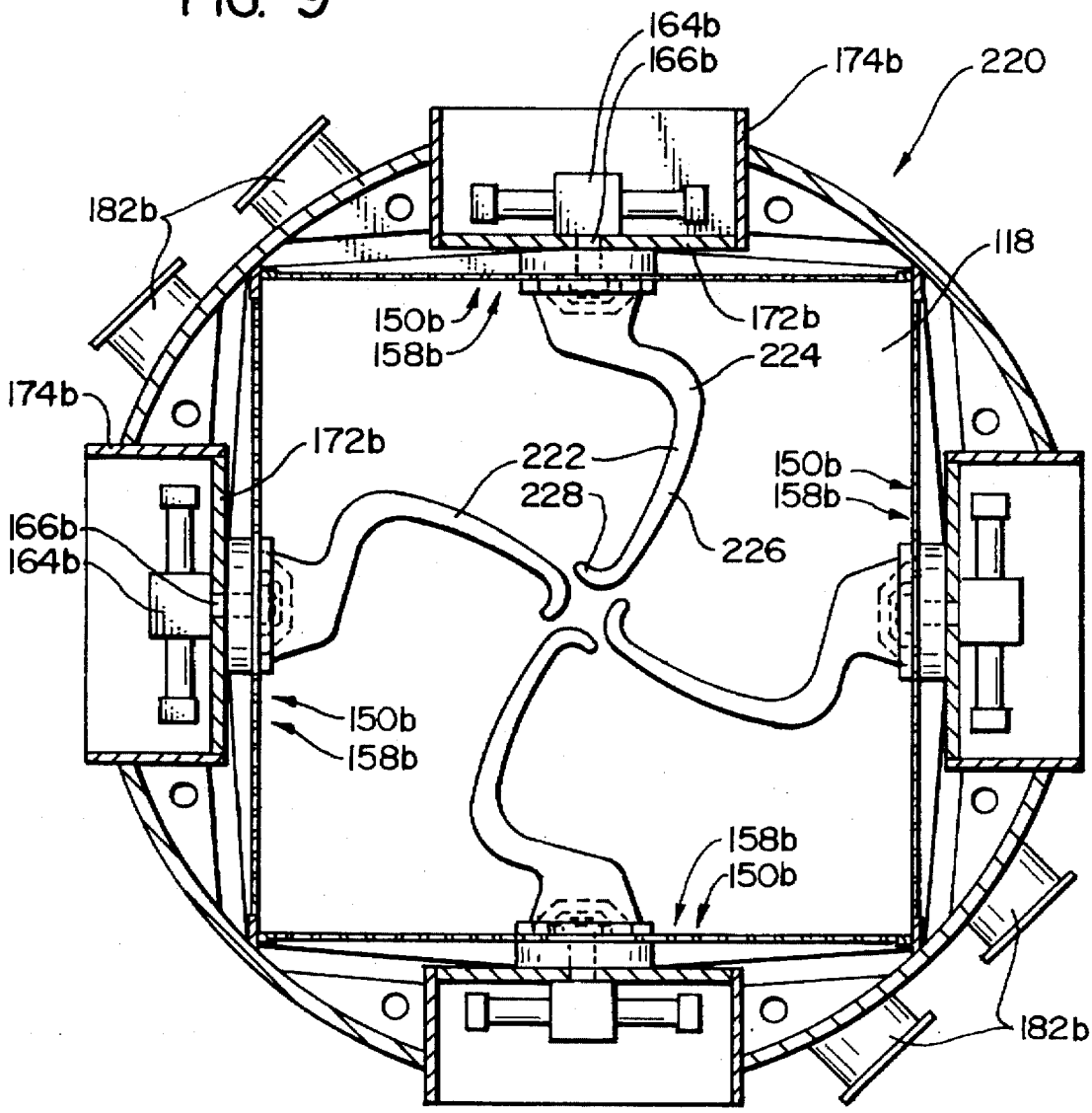
FIG. 9 is a transverse sectional view of the pulp diluting module of the digester of the present invention.

Reference is made to FIG. 9 which is a cross sectional view if the diluting unit or module 220. This module 220 is located near the outlet 106 of the digester 102. Components of this diluting module 220 which are the same as, or similar, components of the prior modular units will be given like numerical designations, with a "b" suffix distinguishing those of the modular unit 220.

The function of this diluting unit 220 is to deliver a large portion of the filtrate from the washer 108 into the front end of the chamber 118 to bring the consistency of the wood pulp/liquor mix (which is at about 12½% consistency in the digester 102) to about 2% to 4% consistency. It can be seen that the four walls of the inner container 116 are removed and replaced by four inlet flow assemblies 150*b*, each with its screen assembly 158*b*. Each screen assembly 158*b* has, as in the prior modular units 148 and 190 the hydraulic actuator 164*b* (or hydraulic motor) and the associated mounting plates 172*b* and 174*b*. All of the nozzles 182*b* are inlet nozzles so that there is a net inflow of filtrate from the washer 108 into the chamber 116 from all four sides.

There is connected to each rotary actuator shaft 166*b* a related mixing arm 222 which has a radially outward right angle elbow section 224 positioned laterally of the axis of the shaft 166. This elbow section 224 connects to a forearm section 226 that terminates at a middle location 228. The hydraulic actuators 164*b* could be arranged to rotate through 360° paths of travel, in an alternating pattern. Or each actuator 164*b* could be a continuously rotating motor, rotating only in one direction. These rotating arms 222 mix the incoming filtrate with the pulp in the dilution zone.

8. Liquid Outlet Unit For The Wood Chip Inflow

Figure 10:
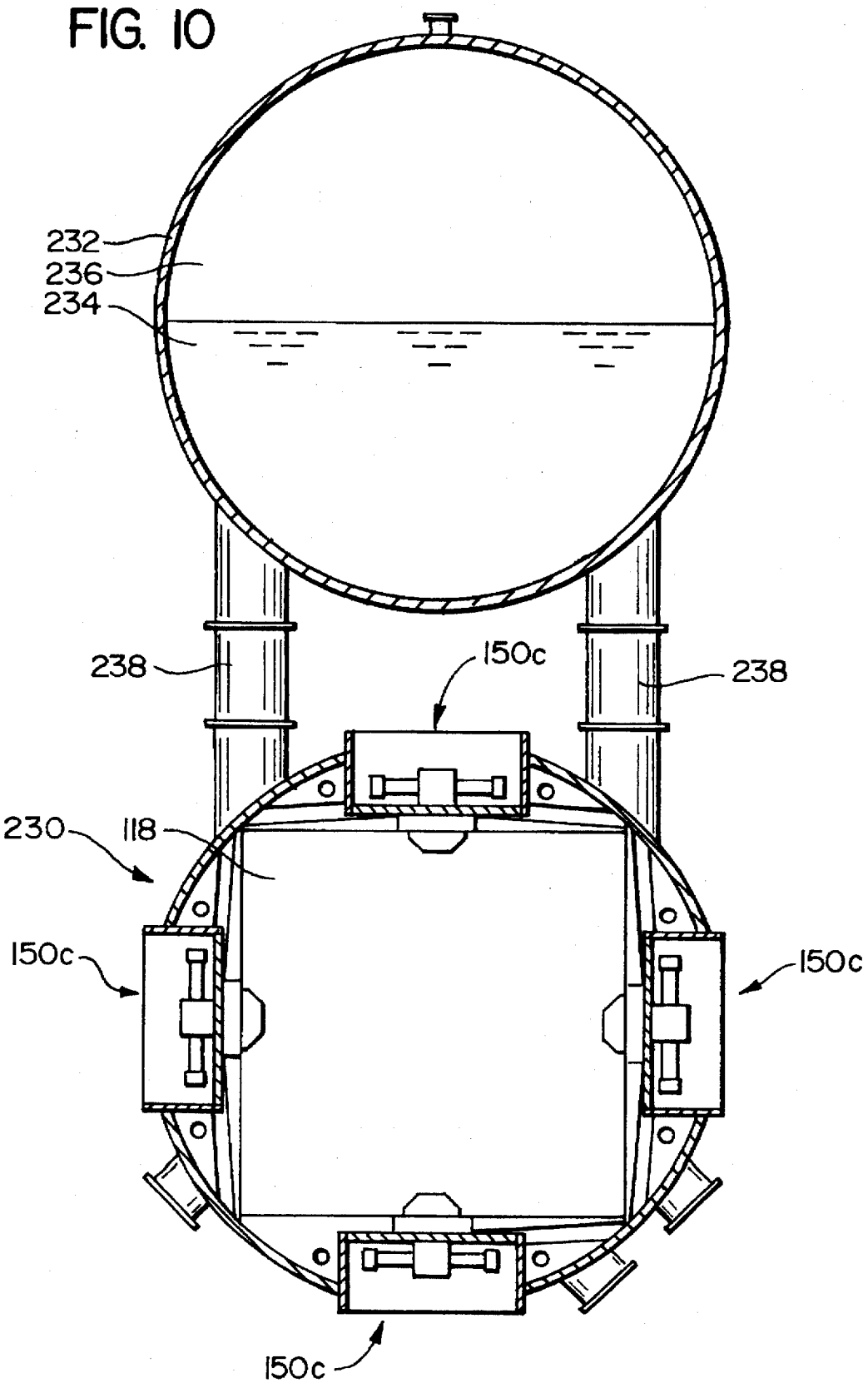
FIG. 10 is a transverse sectional view showing the liquid outlet unit for the wood chip inflow section of the present invention.

Reference is made to FIG. 10 which shows a module 230 which in terms of structure is substantially identical to the module 220 of FIG. 9. Components of this module 230 which are similar to components described previously herein will be given like numerical designations, with a "c" suffix distinguishing those components of this module 230.

When the wood chips are introduced into the rear end 104 of the digester 102, they are first mixed with liquid in a prior art manner so that they flow readily into the digester 102. Black liquor is used for this purpose. However, after the wood chips are introduced, it is desirable to displace this liquor to maintain the derived liquor to wood ratio in the digester 102.

Positioned above the module 230 is an accumulator tank 232 which is filled to about its mid-height with this recirculation liquor, as at 234. The upper half of the chamber defined by the container 230 is designated 236 and contains a pressurized gas, typically nitrogen. This communicates through two tubes 238 to the uppermost fluid assembly 150*c* which functions either as an inlet assembly or an outlet assembly, depending upon conditions in the digesting chamber 116. If the inflow of fluid into the inlet 104 of the digester 102 is for a period of time greater than the outflow at the opposite end 106, then this extra fluid is able to pass upwardly through the conduits 238 into the accumulator tank 232. If the opposite situation occurs, then fluid will flow from the tank 232 into the chamber 118.

In addition of the function as an accumulator, the module 230 acts also as a separator of air and gases that are coming in with the wood chips. These gases are vented from the area 236 periodically.

The other three assemblies 150*c* are all fluid outlet assemblies. These function to carry away the excess liquor which accompanies the wood chips that are being introduced into the digester 102.

9. Overall Operation of the Digesting System 100

Reference is now made back to FIG. 2 which shows somewhat schematically the entire digesting system. It is believed that the more detailed description of the overall operation of the preferred embodiment will be better understood by first providing some introductory comments, some of which have been made earlier herein.

As indicated earlier, the wood chips are introduced at 104 and these move continuously downstream along the length of the digester 102. As the wood chips pass through various zones, they are subjected to several processing steps to delignify the wood chips, and to cause these to become pulp fibers. The pulp with the liquor carrying the pulp to the front discharge end 106 is first diluted and cooled with the filtrate from the washer 108 and then discharged into the washer for dewatering and washing.

As described previously, the filtrate from the washer 108 serves to dilute the pulp near the discharge end 106 so that it can be discharged at a consistency of 2 to 4%. Further, the filtrate from the washer 108 is delivered into the digester 102 near the outlet 106 end first to accomplish displacement washing of the pulp near the outlet end 106, and then to be moved further upstream to be combined with digesting ingredients (in this preferred embodiment ethyl alcohol) to provide the proper concentration of the digesting ingredient (s).

As indicated previously, the digesting liquid, hereinafter called the "liquor", is recirculated through the digester in a fashion so that there is a net upstream movement of the liquor from the front discharge end 106 toward the rear inlet end 104, this being accomplished by extracting the liquor from the digester 102 at downstream locations and moving it upstream to be reinjected into the digester 102. As the liquor is moved further upstream, the liquor acquires a higher concentration of the lignin and other organic matter extracted form the wood chips, and thus, in the terminology of the pulp industry, becomes higher in dry solids (D. S.) content as it is recirculated in a continuous upstream fashion. The liquor is eventually discharged as black liquor at an upstream location indicated at 240.

With the foregoing being given as introductory comments, there will now be a more detailed description of this process. This will be done with reference to FIG. 2 and also with reference to FIGS. 11 through 14 which show respective portions of the digester system 100 of FIG. 2, but drawn to an enlarged scale.

10. Operation at the Dilution Zone and the Hot Wash Zone

Figure 11:
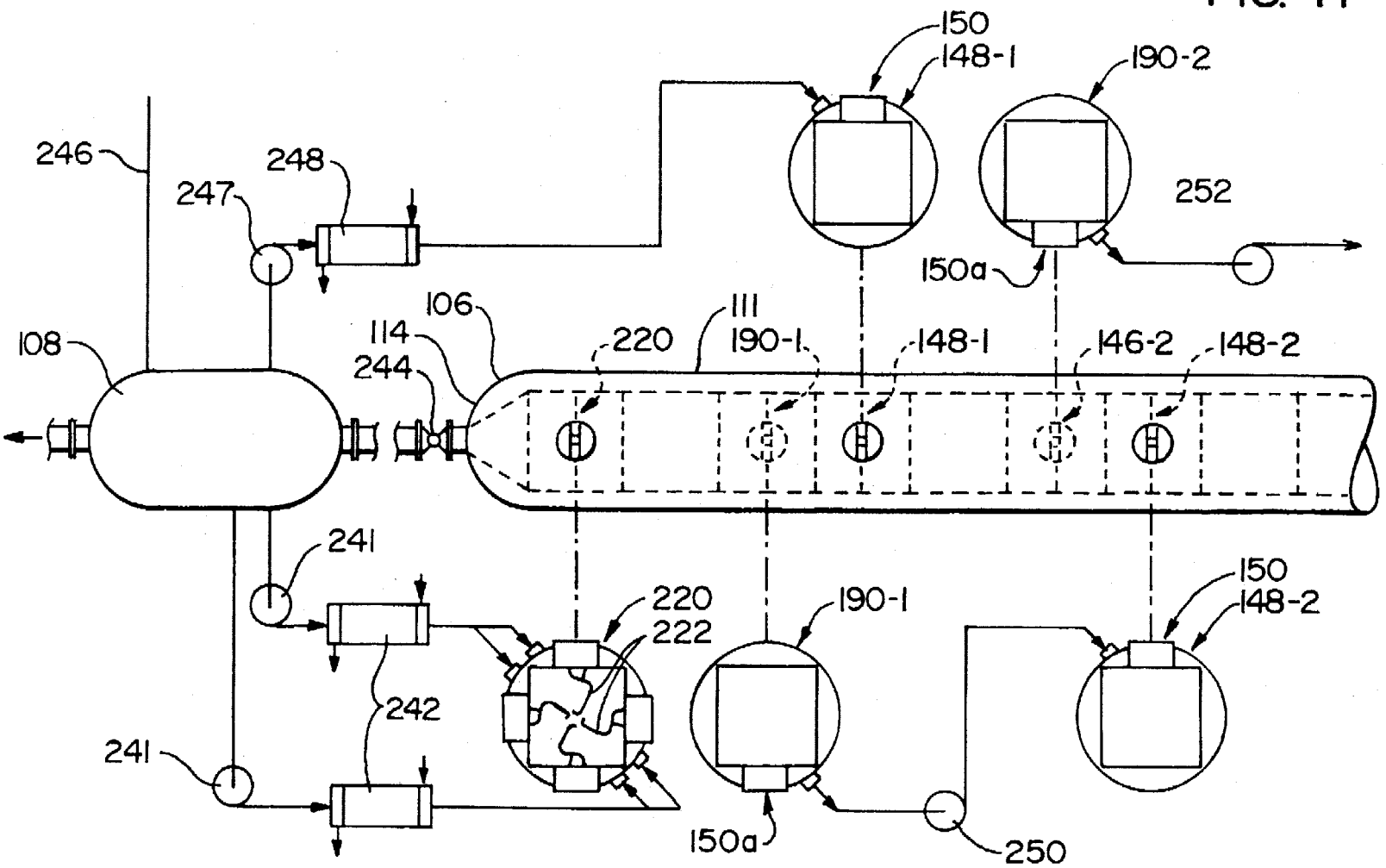
FIGS. 11 through 14 are semi-schematic views, similar to FIG. 2, showing in an enlarged scale four sections of the digesting system illustrated in FIG. 2.
Figure 12:
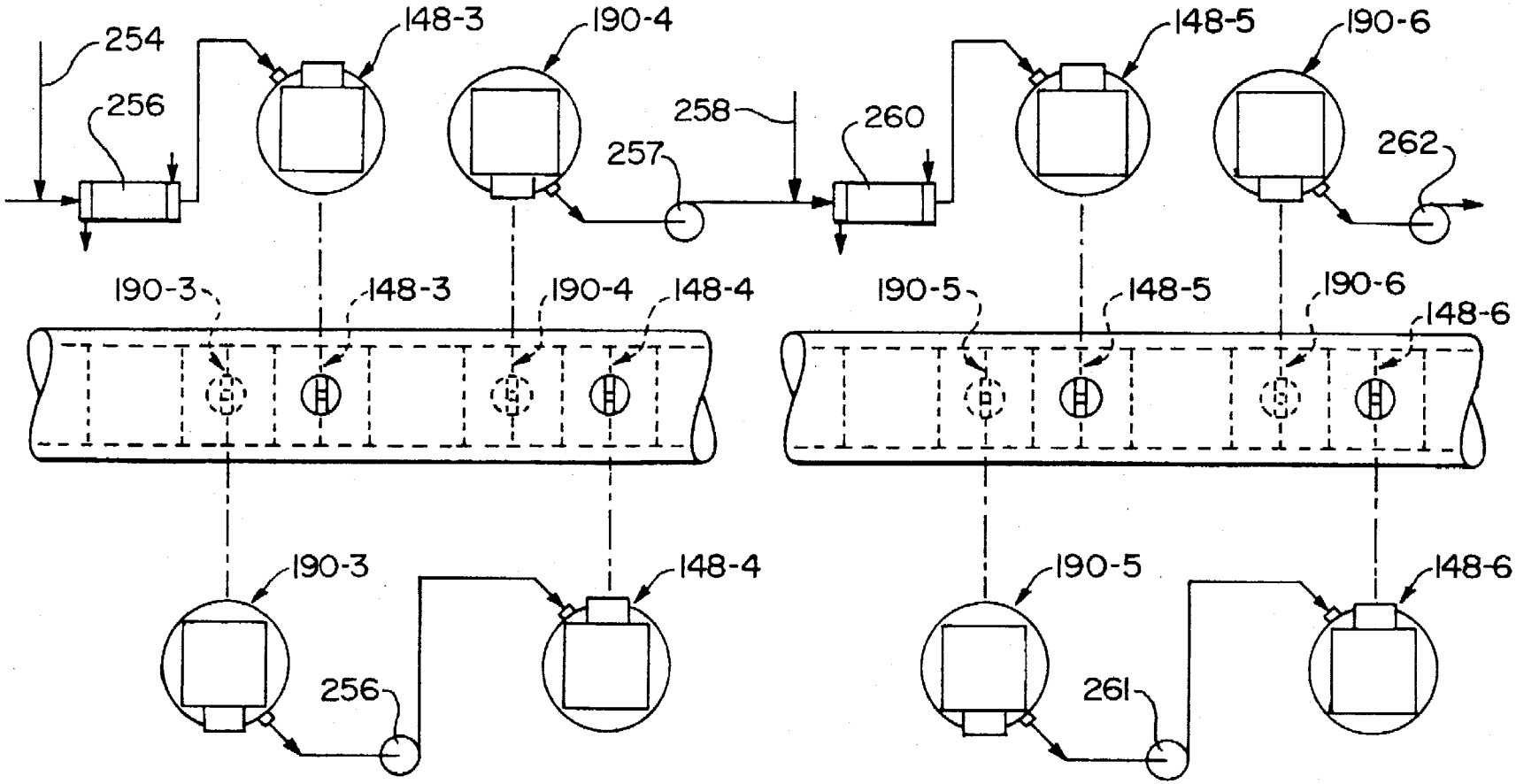
Figure 13:
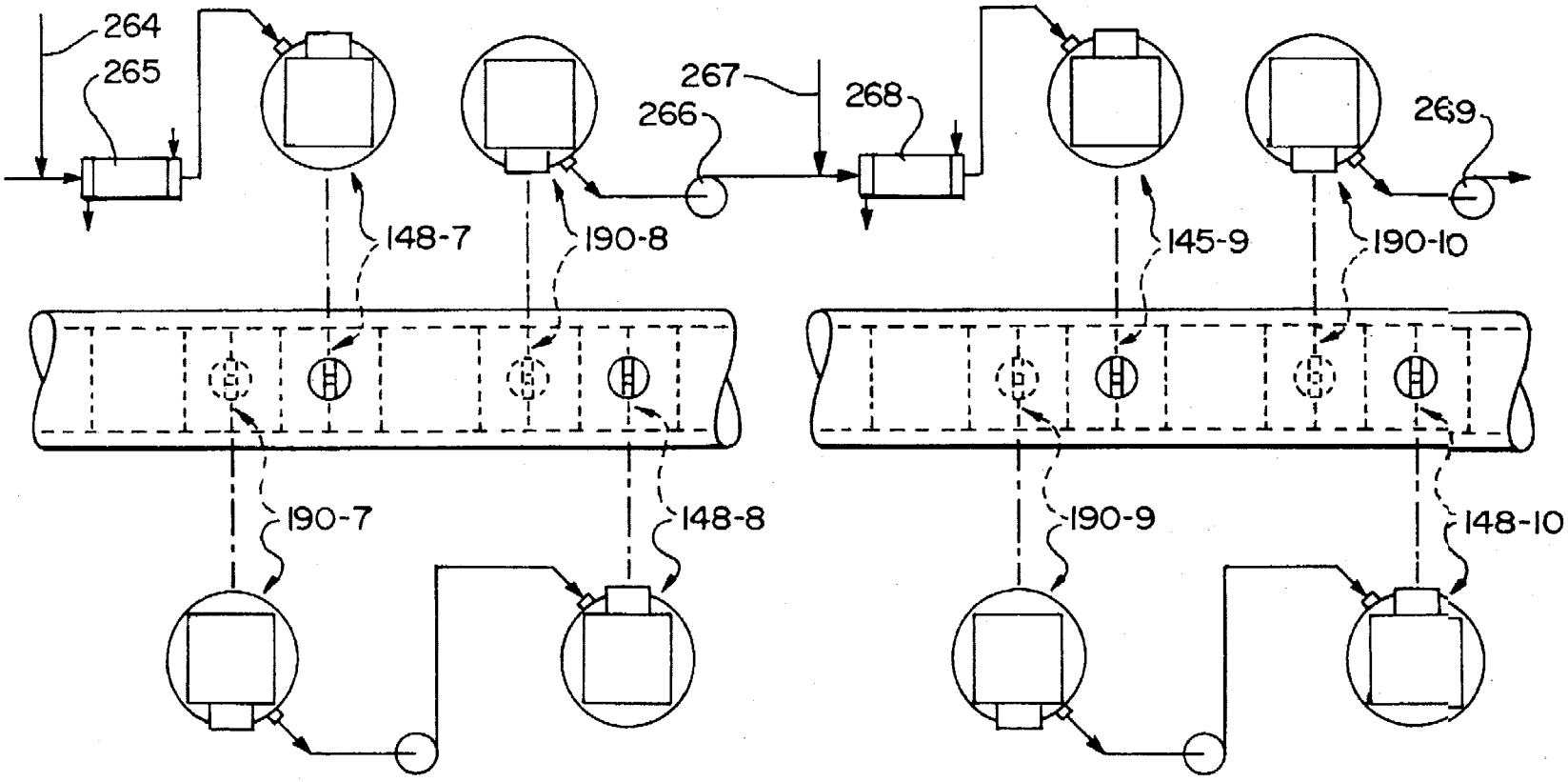
Figure 14:
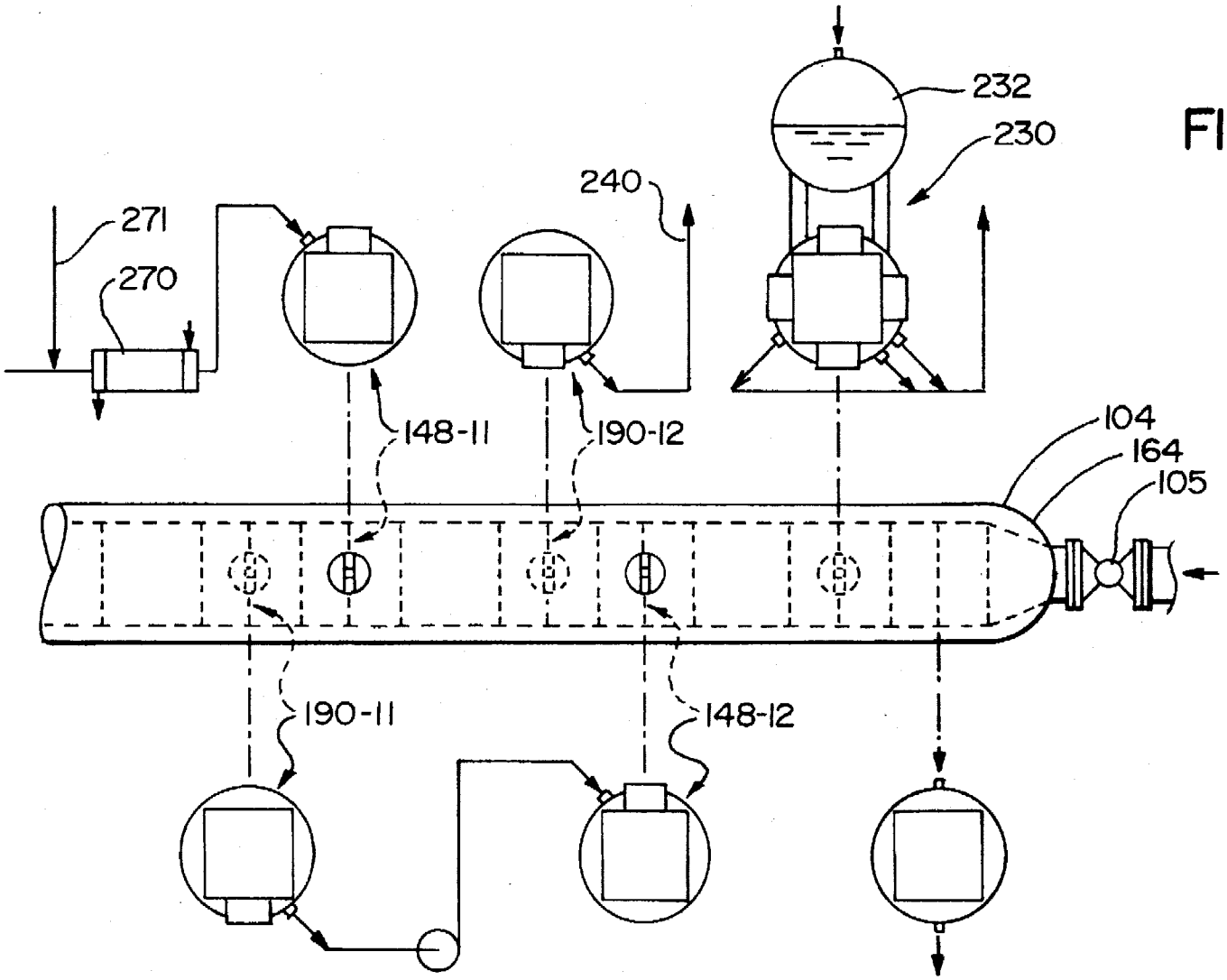

Reference is first made to FIG. 2 and FIG. 11. All of the filtrate from the washer 108 is transferred to, or recirculated in, the digester 102. This filtrate is the liquid which is removed from the pulp during the dewatering process, and also the liquid which is the outflow of filtrate from the pulp during the final displacement washing in the washer 108.

Typically, the consistency of the pulp being processed in the digester is at about 12–13%. Thus, there are seven parts of liquor to one part wood fibre. To cause the proper discharge of the pulp into the washer 108, it is generally desirable to dilute the pulp to about 2% consistency. This is accomplished in the present invention by directing the major portion of the filtrate from the washer 108 by pumps 241 through a pair of heat exchangers 242 (to extract heat from the filtrate) into the filtrate inlet module 220. As the filtrate enters through the inlet nozzles **182*b*, it flows through the screens 152*b* into the chamber 118. The mixing arms 222 rotate slowly so that these mix the wood pulp with the filtrate. Then the filtrate is continuously discharged through a digester blow nozzle which is indicated schematically at 244**.

In the schematic drawing of FIG. 2 and in FIG. 11, the module 220 is shown somewhat schematically outside of the pressure vessel 110. This is done merely for purposes of illustration, and it is to be understood that this module 220 is positioned within the pressure vessel 110 as illustrated in FIG. 9.

From the above description, it is apparent that the major part of the filtrate is simply recirculated from the washer 108 through the heat exchangers 242 into the chamber 116 by means of the module 220 and then flows with the pulp fiber through the outlet nozzle 244 (blow nozzle) into the washer 108. In the washer 108, the diluted wood pulp is first dewatered, then washed through several cycles, and discharged. Fresh wash water is directed into the washer 108 through the inlet 246.

A substantially smaller portion of the filtrate is directed by a pump 247 first through a heat exchanger 248 which adds heat to the filtrate, and then is directed into the furthest downstream fluid inlet module 148-1 so that the filtrate flows downwardly through the flow inlet assembly 150 at the top of the module 148-1. The filtrate flowing from the assembly 150 moves downwardly, and at the same time, due to the forward flow of the liquor carrying the pulp in a downstream direction, the net flow of the filtrate is in a slanted downward and forward direction. The effect of this is, as described above, that the liquor presently in the digester 102 directly below the inlet assembly 150 is displaced downwardly and outwardly through the outlet assembly **150*a* of the unit 190-1. This initial displacement of the liquor accomplished by the combined action of the modules 148-1 and 190-1 is one stage of a final hot displacement wash accomplished by the filtrate derived directly from the washer 108**.

Then the liquor which flows into the module 190-1 is moved by the pump 250 into a further upstream module 148-2 which moves the liquor displaced by the module 148-1 into the liquor stream to displace the liquor immediately below the inlet assembly 150 of the module 148-2 downwardly to flow outwardly through the screen **150*a* of the module 190-2**.

The action of these modules 148-1 and 2 and 190-1 and 2 have thus accomplished a two stage hot wash, and this is accordingly designated in FIG. 2 as the "hot wash" zone of the digester 102.

At this point, it should be noted that the wash has been accomplished by the filtrate which enters at 148-1. The wash liquid that remains in the pulp moves downstream to the area of the dilution module 220. The liquor collected in the module 190-2 is moved by means of a pump 252 upstream toward a third inflow module 148-3.

11. Operation of the Diffusion Wash Zone, High Heat Alcohol Wash Zone, Cooking Zone 3 and Displacement Zone A At a location between the pump 252 and the module 148-3, there is shown schematically at 254 an inlet nozzle where ethyl alcohol is added in a sufficient quantity to the liquor from the module 190-2 to cause the liquor flowing into the digester 102 to be sixty percent ethyl alcohol by weight and forty percent water by weight. The liquor then flows through a heat exchanger 256 to raise the temperature, and then is delivered to what is designated as the "high heat alcohol wash" zone.

There are at that high heat alcohol wash zone two flow inlet modules 148-3 and 148-4 and two flow outlet modules 190-3 and 190-4. The liquid displacement operation proceeds in this high heat alcohol wash zone in the same manner as described previously relative to the further downstream hot wash zone. The net effect is that the alcohol liquor mixture displaces most of the liquor which is flowing into the high heat alcohol wash zone and delivers it through a pump 256 in an upstream direction. Also the rate of flow of the liquor into and through the inlet assembly 150 of the module 148-3 is sufficiently high so that a substantial amount of this liquor ends up flowing out of the module 190-4 and thence is pumped at 257 in an upstream direction. At a location upstream of the pump 257 there is an injection nozzle 258 by which an alcohol water combined liquor can be delivered into the line as needed to adjust the pH if this is required. The liquid then flows through the heat exchanger 260 and is delivered to a further upstream location which is designated "displacement zone A".

These modules 148-3 and 4 and 190-3 and 4 which comprise the high heat alcohol wash zone are spaced a distance upstream from the hot wash zone so that there is between these two zones an interconnecting section of the digester which has the typical cross section, as shown in FIG. 3. The rate of travel of the liquor with the pulp is such that it takes about twenty minutes for the liquor/pulp mixture to travel from the high heat alcohol wash zone to the hot wash zone. This twenty minute period of travel is through what is termed the "diffusion wash" zone where the lignin and other material in the pulp diffuses outwardly into the liquor.

As indicated above, the liquor that flows through the heat exchanger 260 is then delivered to that section of the digester which is designated as displacement zone "A". At this zone, there are two liquor inlet modules 148-5 and 6, and two liquid outlet modules 190-5 and 6. The liquor entering the module 148-5 discharges the liquor through the fluid flow assembly 150 to displace the liquor in the chamber 118 outwardly through the module 190-5 from which the liquor is delivered by the pump 261 to the module 148-6 which in turn delivers the liquor through the chamber 118 to displace the liquor in the chamber 118 to flow into the unit 190-6, where the pump 262 moves the liquor upstream.

Between the displacement zone A and the high heat alcohol wash zone, there is a section of the conduit which is designated "cooking zone 3". At this cooking zone 3, the digester section is of sufficient length so that the dwell time of the liquor pulp mixture in traveling from the displacement zone "A" to the high heat wash zone is between about thirty to forty minutes.

12. Operation at Cooking Zone 2, Displacement Zone B, Cooking Zone 1 and Displacement Zone C Reference is made to FIGS. 2 and 13. The pump 262 delivers the liquor by an inlet 264 where ethanol can be added as required, and this liquor is passed through a heat exchanger 265. At a location further upstream from the displacement zone "A", there is displacement zone "B". This displacement zone B comprises the modules 148-7 and 8 and 190-7 and 8. These function in substantially the same way as the modules 148-5 and 6 and 190-5 and 6 in the displacement zone "A" so the operation of these will not be repeated herein. The liquor and pulp mixture that flows from the displacement zone "B" to the displacement zone "A" travels through a section of the digester 102 which has a length such that the dwell time is about thirty to forty minutes. This section of the digester is designated "cooking zone 2".

Further upstream from the displacement zone "B", there is what is called a displacement zone "C". This comprises the modular units 148-9 and 10 and 190-9 and 10. The mode of operation of these modular units is substantially the same as those in the displacement zone "A" and displacement zone "B", so that operation will not be described further herein. The liquor from the unit 190-8 is delivered by a pump 266 by an ethanol inlet nozzle which optionally can be used to add ethanol, through a heat exchanger 268 to the unit 148-9, and after passing through the units 160-9, 148-10, and 190-10, the liquor from 190-10 is delivered further upstream by a pump 269. The section of the digester between the displacement zone "B" and the displacement zone "C" comprises the cooking zone 1, and this section of the digester is sufficiently long so that the dwell time of the liquor and pulp mixture from the displacement zone "C" to displacement zone "B" is approximately thirty to forty minutes.

13. Operation of the Impregnation Zone, Initial Heating Zone, Wood Chip and Liquid Recirculation and Black Liquor Removal Immediately upstream of the displacement zone C there is the impregnation zone. The section of the digester defining this impregnation zone is sufficiently long so that the dwell time of the wood chip liquor mixture is about ten to twenty minutes.

The liquor from the module 190-10 is pumped upstream through a heat exchanger 270 to add heat and this is delivered into the initial heating zone. Also there is a nozzle 271 for optional addition of ethanol as needed. At this initial heating zone, there are the modules 148-11 and 12 and 190-11 and 12. The displacement operation takes place as described with regard to the previous displacement zones. Most of the liquor passing through the initial heating zone moves through the modules 148-11, 190-11, 148-12, and 190-12 and is discharged at 240 as black liquor, for further processing. A smaller portion of the black liquor flows upstream to the location of the liquid outlet unit 230 (shown in FIG. 10) to serve as make-up liquor for the liquid which carries the wood chips into the digester.

The wood chips are, as indicated earlier, mixed with a carrying-liquid (i.e. black liquor) and introduced into the wood chip inlet 105 in a conventional manner. Most of this black liquor that carries the wood chips is discharged through the module 230 to be recycled to the wood chip feeder unit again carry additional wood chips into the inlet 105. Since the manner in which this is a done is already known in the prior art, this will not be described further herein.

The black liquor discharged at 240 is further processed for alcohol recovery and evaporation to recover the ethyl alcohol for reuse and also to provide the by-product or by-products from the black liquor More particularly the black liquor can have the liquid content reduced (e.g. by evaporation) and then be spray dried or otherwise dried to produce a by-product in a powder form which has desirable properties as an animal feed supplement or other uses.

14. Possible Modifications

Figure 15:
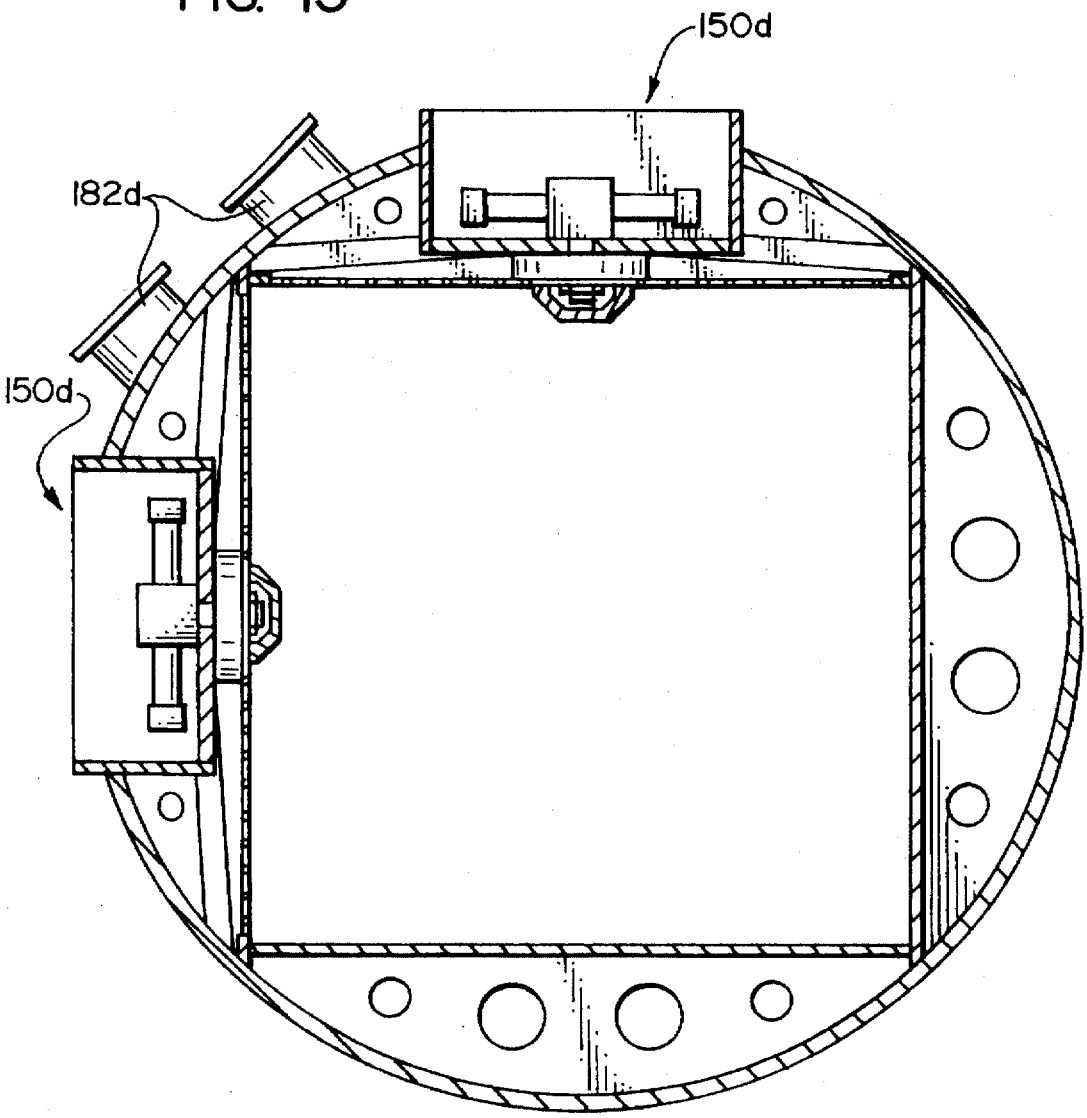
FIG. 15 is a view similar to FIG. 4, showing a cross sectional configuration of a modified form of a liquid inflow module.
Figure 16:
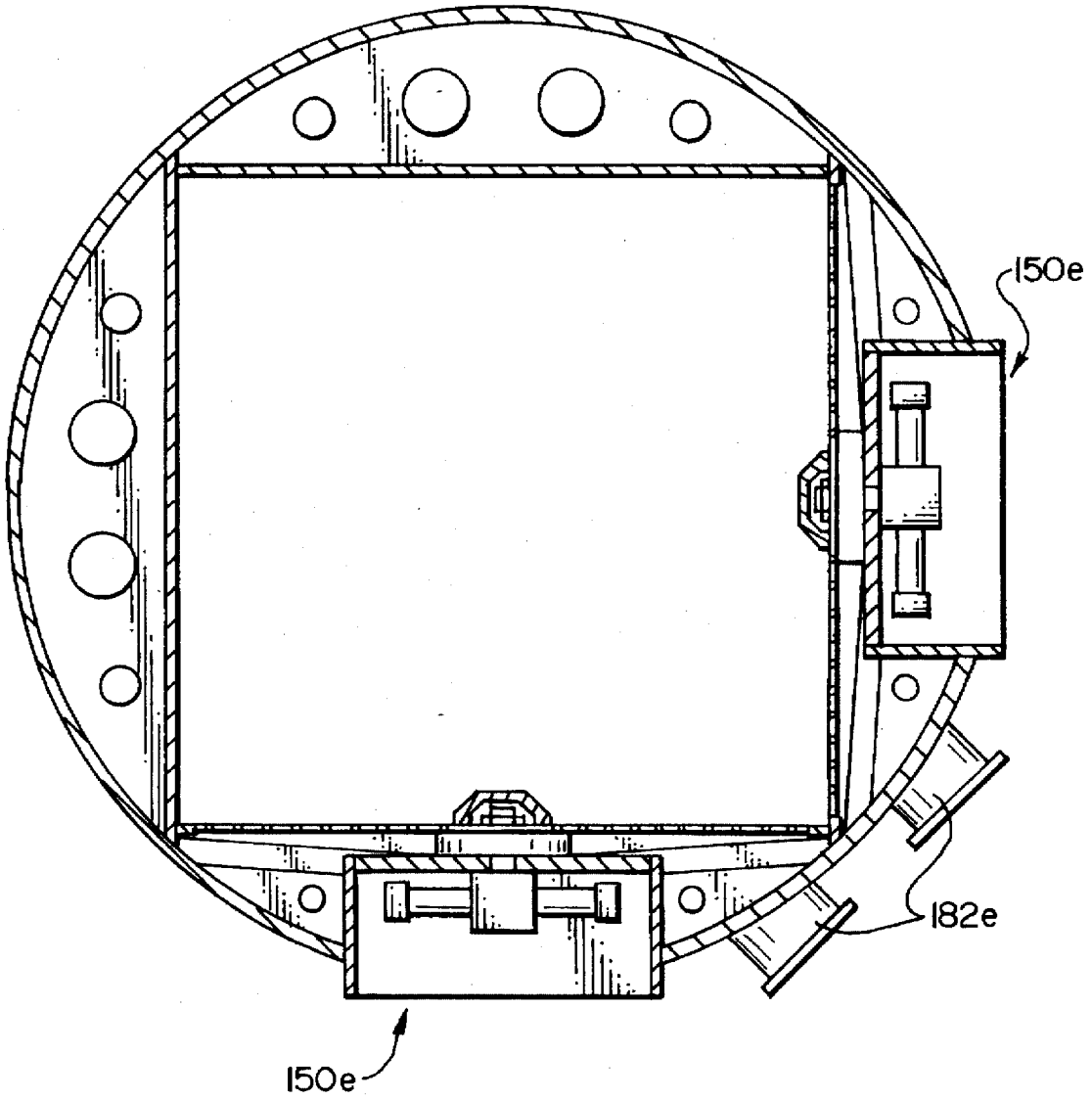
FIG. 16 is a view similar to FIG. 6, showing a modified version of the outflow module.

It is to be recognized, of course, that within the scope of the present invention, various modifications could be made in the present invention without departing from the basis teachings thereof. One such modification is illustrated in FIGS. 15 and 16. The components shown in FIG. 15 which correspond to components described previously herein will be given like numerical designations, with a "d" suffix distinguishing those of the module shown in FIG. 15.

In FIG. 15, instead of providing only one flow inlet assembly 150 as shown in FIG. 4, there are provided two such flow inlet assemblies **150*d* and likewise two inlet conduits 182*d***.

The other modification as shown in FIG. 16 shows the liquid flow outlet module. Components of this modification in FIG. 16 which are similar to prior components will be given like numerical designations, with an "e" suffix distinguishing those shown in FIG. 16. Thus, it can be seen that there are two liquid outflow assemblies **150*e*, and also outlet nozzles 182*e* for each of these assemblies 150*e***.

It is believed that the mode of operation of these modules FIGS. 15 and 16 are readily apparent from the prior description. The flow from the assemblies **150*d* in FIG. 15** is at a downward and lateral slant in a downstream direction.

B. SECOND EMBODIMENT

15. Introduction to the Second Embodiment

This second embodiment of the present invention is shown in FIGS. 17 through 29, which can be described as follows.

Figure 17:
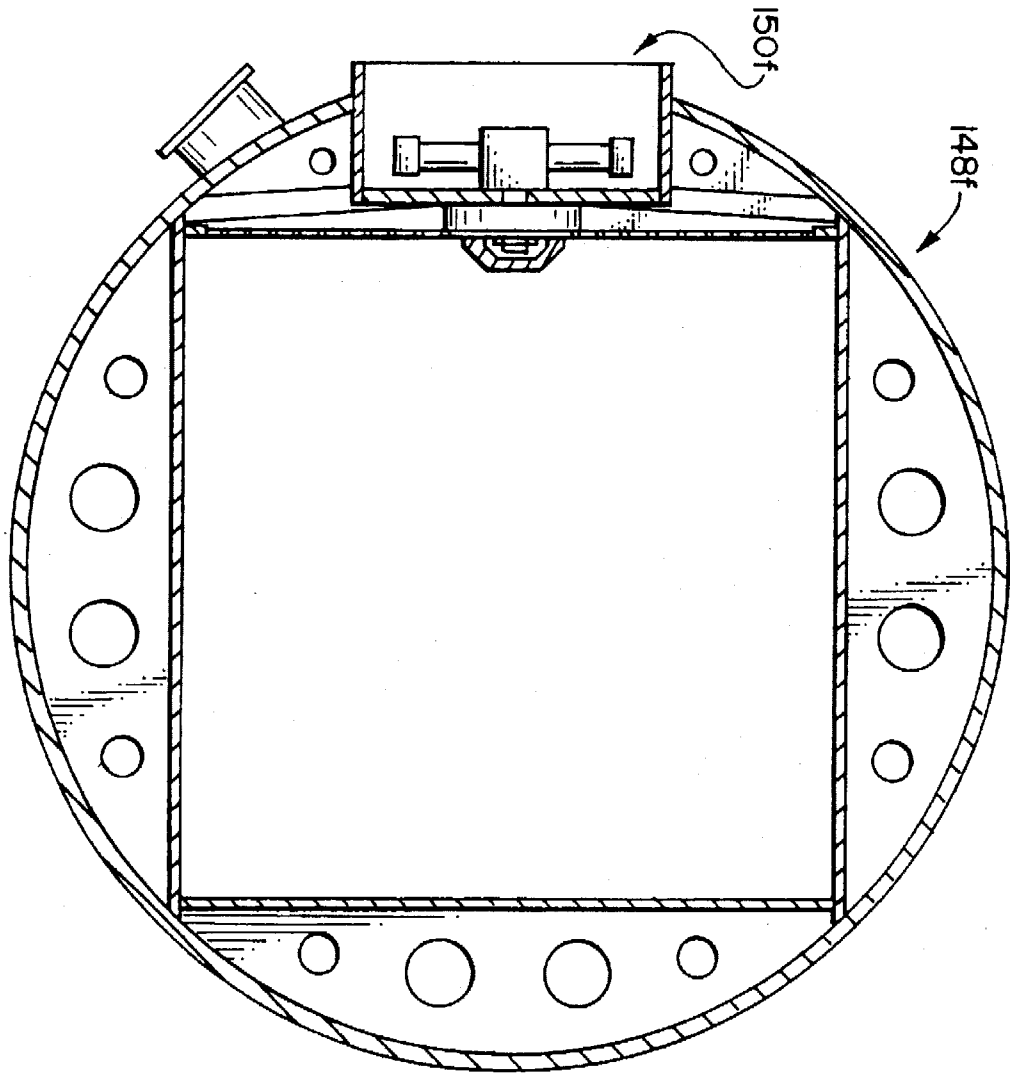
FIG. 17 is a view similar to FIG. 15 showing a cross sectional configuration of a further modified form of a liquid inflow module, incorporated in a second embodiment of the present invention.
Figure 18:
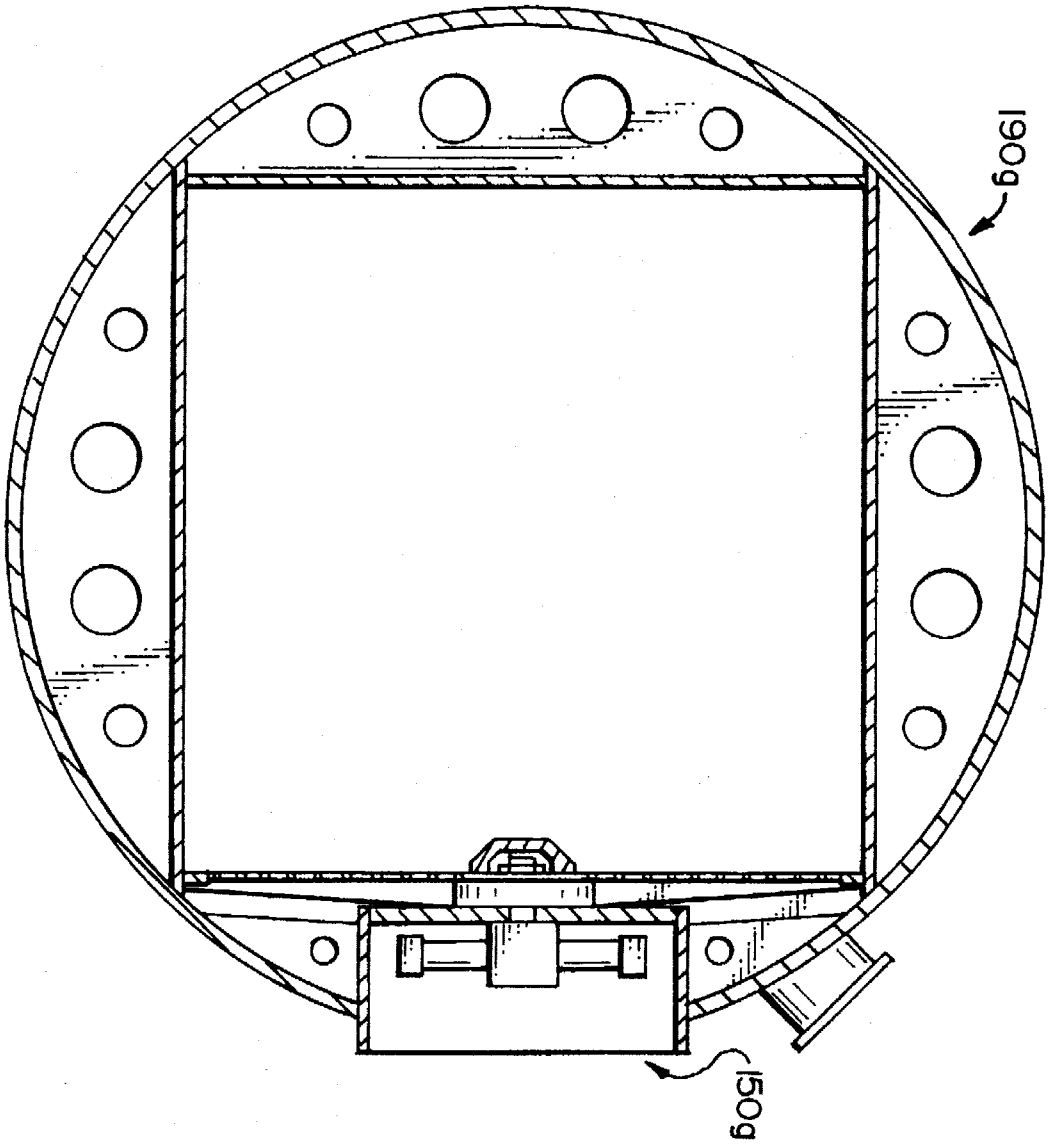
FIG. 18 is a view similar to FIG. 17 showing an outlet module utilizing the second embodiment of the present invention.

In the second embodiment there is a further modified version of an inlet module as shown in FIG. 17, and an outlet module shown in FIG. 18.

Components of this modified version of the inlet module will be given numerical designations similar to the prior embodiments, with an "f" suffix distinguishing those components of the modified version of FIG. 17. There is shown an inlet module **148*f*, and this has a single flow inlet assembly 150*f* located at one side of the module 148*f***.

In FIG. 18, there is shown a fluid outlet unit or module 190*g* having an outlet assembly 150*g* positioned at the side of the digester opposite to the side at which the flow inlet module 148*f* is located. The outlet module 190*g* is located just downstream of the inlet module 148*f* so that the flow of the filtrate from the inlet assembly 150*f* to the outlet assembly 150*g* is laterally across the chamber and also downstream toward the flow outlet assembly 150*g*. As will be disclosed later herein, this particular modification shown in FIGS. 17 and 18 is incorporated in the second embodiment which is described later herein.

FIGS. 19 through 29 are semi-schematic views, similar to FIGS. 11 through 14, showing 11 different sections of a second embodiment of the digester of the present invention.

The basic operation of this second embodiment is in many respects substantially similar to the operation of the first embodiment as shown in FIGS. 11 through 14. Therefore, the overall structure and operation of this second embodiment will not be discussed in detail in this description of the second embodiment, but will be described only generally. Those components or sections of the digester which are somewhat different in structure and/or function from components of the first embodiment will be indicated.

In FIGS. 19 through 29, there is presented various technical information concerning the overall operation. More specifically, flow rates are indicated in liters per minute. Temperatures at various locations are indicated. The alcohol content is indicated at various locations. The percent of dissolved solids is also indicated. It is believed that this information, in conjunction with the prior description of the operation of the various components quite adequately discloses the operation of this second embodiment. In the following paragraphs, there will be discussion of the second embodiment with reference to the individual drawings of FIGS. 19–29.

16. Description of the Second Embodiment

Figure 19:
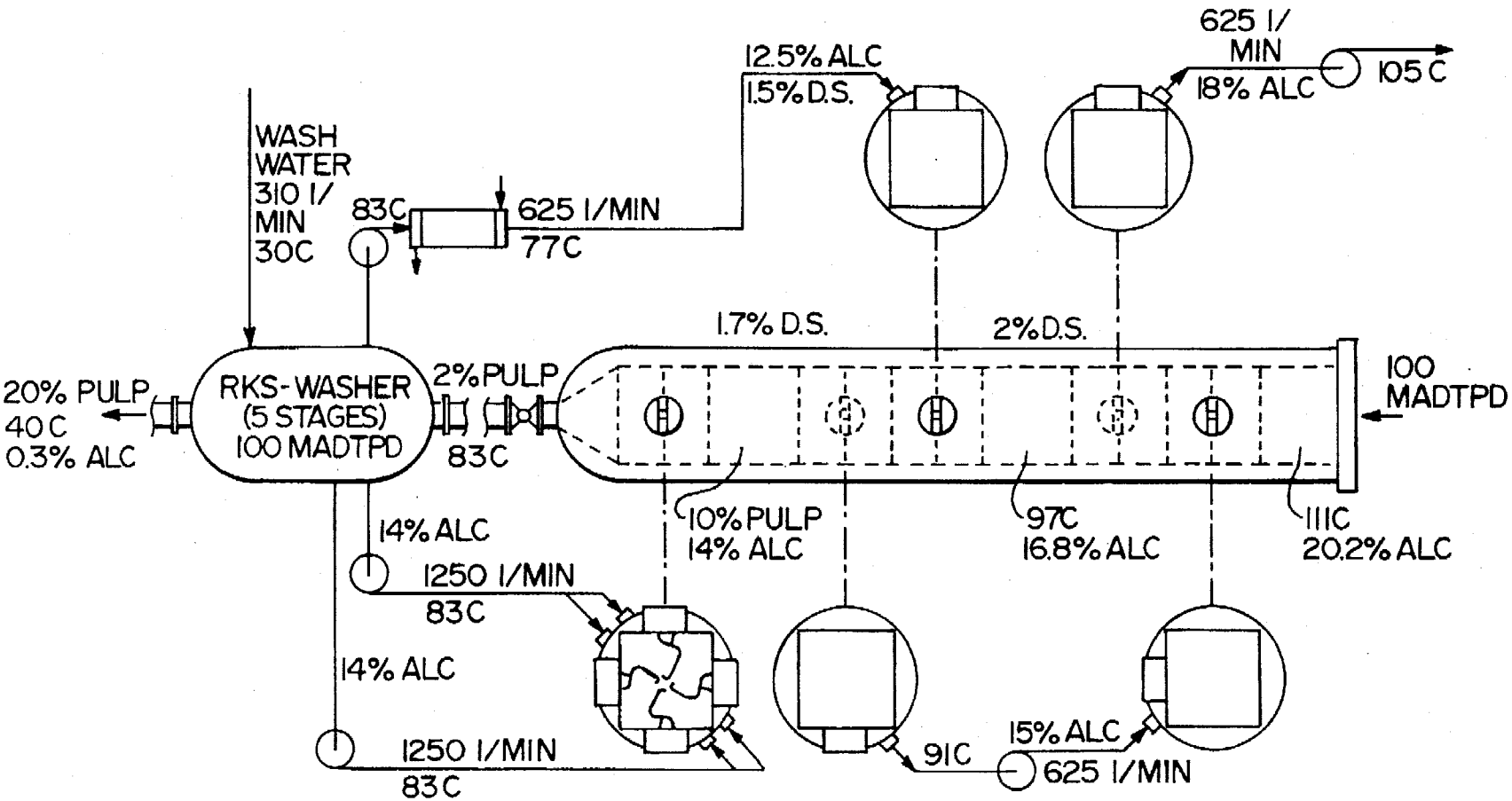
FIGS. 19 through 29 are schematic side elevational views showing the entire second embodiment, with various sections of the digester being shown in sequence, beginning from a front downstream location in FIG. 19, and continuing all the way to the opposite end of the digester in FIG. 29.

In FIG. 19 in the left hand side of the drawing, there is designated in the lower part the "dilution zone". This functions in substantially the same way as described previously herein with reference to Section 10. One difference is noted, in that the heat exchangers shown in FIG.11, indicated at 242 are not present in this second embodiment.

Figure 20:
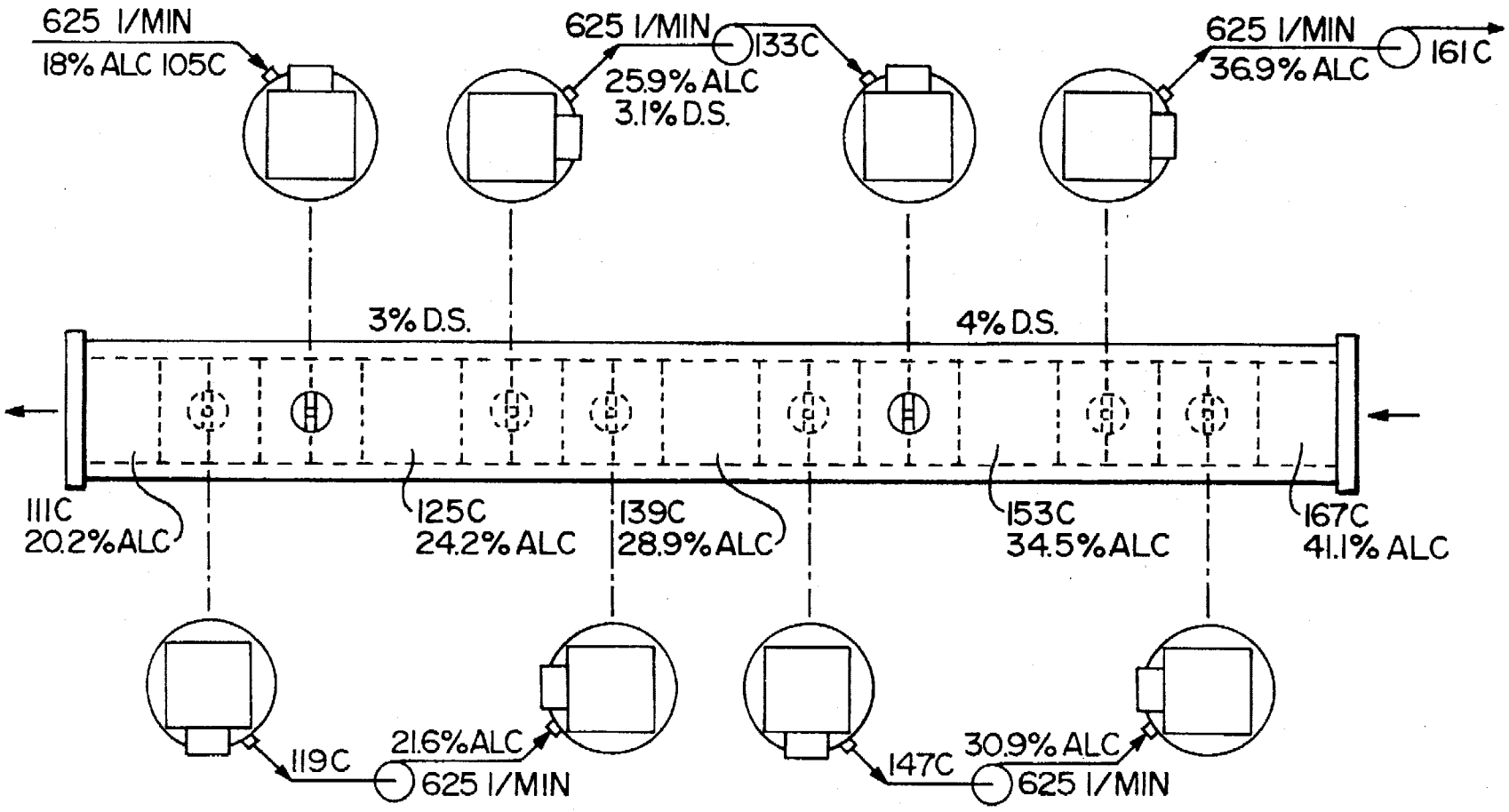
Figure 21:
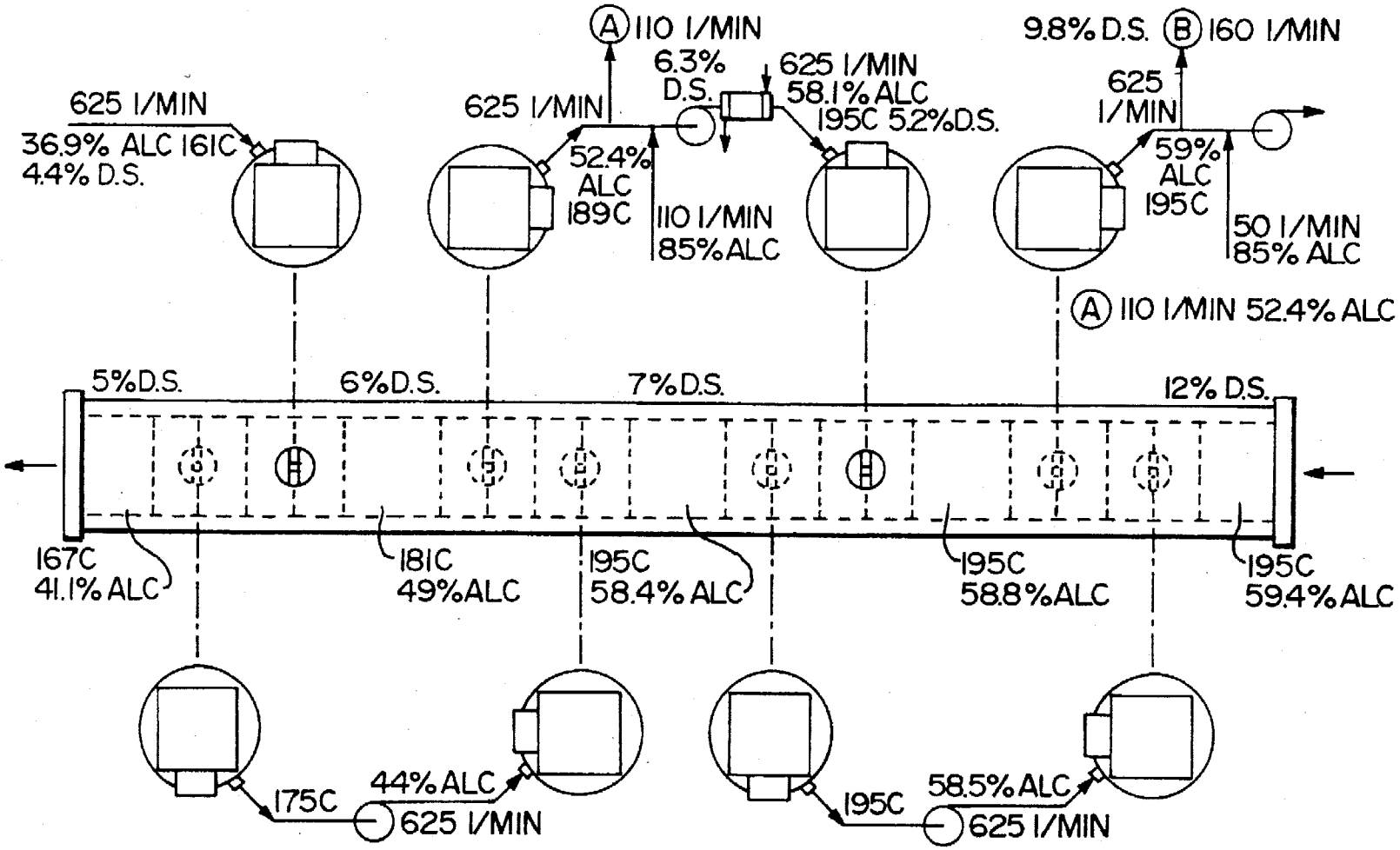

In the right half of FIG. 19, in the entire showing of FIG. 20 and in the left part of FIG. 21, there is shown the displacement wash zone. In this displacement wash zone, there are eight pair of modules, each pair comprising a flow inlet module and a flow outlet module; such as indicated at 148 and 190 in the description of the prior embodiment, or as shown in FIGS. 17 and 18. Thus, there are eight washing stages. It will be noted from the processing information on FIGS. 19, 20 and 21 that the temperature of the filtrate increases in an upstream direction. The percentage of dry solids in the pulp slurry decreases in a downstream direction. The alcohol content also decreases in a downstream direction.

It was indicated earlier herein that the modified arrangement of the flow inlet and flow outlet modules as shown in FIGS. 17 and 18 is utilized in the second embodiment. The arrangement shown in FIGS. 17 and 18 is utilized in an alternating pattern with the inflow and outflow modules shown in FIGS. 4 and 6, respectively. Thus, the pulp slurry will be subjected to a displacement wash operation in which at one location the displacement flow would be downstream and vertically and then at a subsequent location the displacement flow would travel laterally and downstream. This is believed to have certain benefits. For example, if the chips are oriented in one way where the flow may be obstructed or ineffective in the vertical direction, the flow in the lateral direction may accomplish better liquid contact with the chips. Also, the opposite may be true (i.e. the vertical flow accomplishing better liquid contact at some location of wood chips than the horizontal flow. This alternating pattern of vertically and laterally oriented pairs of flow inlet and flow outlet modules is repeated in all parts of the digester.

Also, it is possible that the vertical flow can be accomplished at different locations and in somewhat different manner in that at one location the flow could be at a downward slant, and in another location the flow from the inlet flow assembly to the outlet flow assembly could be at an upward slant. Further, with regard to the laterally disposed pairs of flow inlet and flow outlet assemblies, these could be arranged so that the flow would first be laterally across the digester in one direction, an din a subsequent pair flow inlet and flow outlet assembly, the lateral cross flow would be in the opposite direction.

In the right hand portion of FIG. 21 there is shown the high heat alcohol wash zone. It can be seen that downstream of the high heat alcohol wash zone a quantity of liquid having 85% alcohol content is being added to the flow of filtrate, and a corresponding quantity of the filtrate already in the flow line is discharged at location "A" and directed further upstream to be entered back into the digester. Also, at the upstream part of the high heat alcohol wash, and additional quantity of 85% alcohol is added, together with the flow from location A and a comparable amount of the filtrate is discharged at the location "B" to be recirculated into the digester at a further upstream location.

Figure 22:
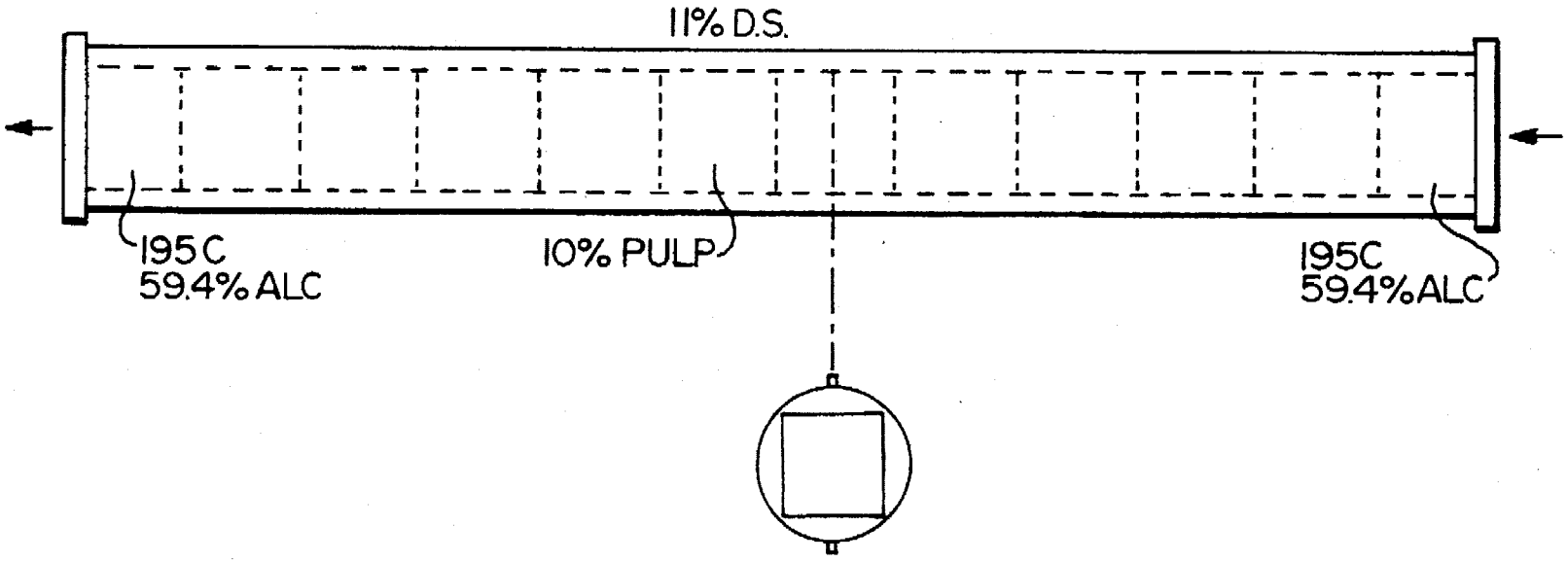

In FIG. 22, there is shown cooking zone 3, In this cooking zone, the cooking liquor around and inside the pulp enters the cooking zone with 10% dry solids (see the left part of FIG. 23), and exits from cooking zone 3 at 12% dry solids (see the left part of FIG. 21).

Figure 23:
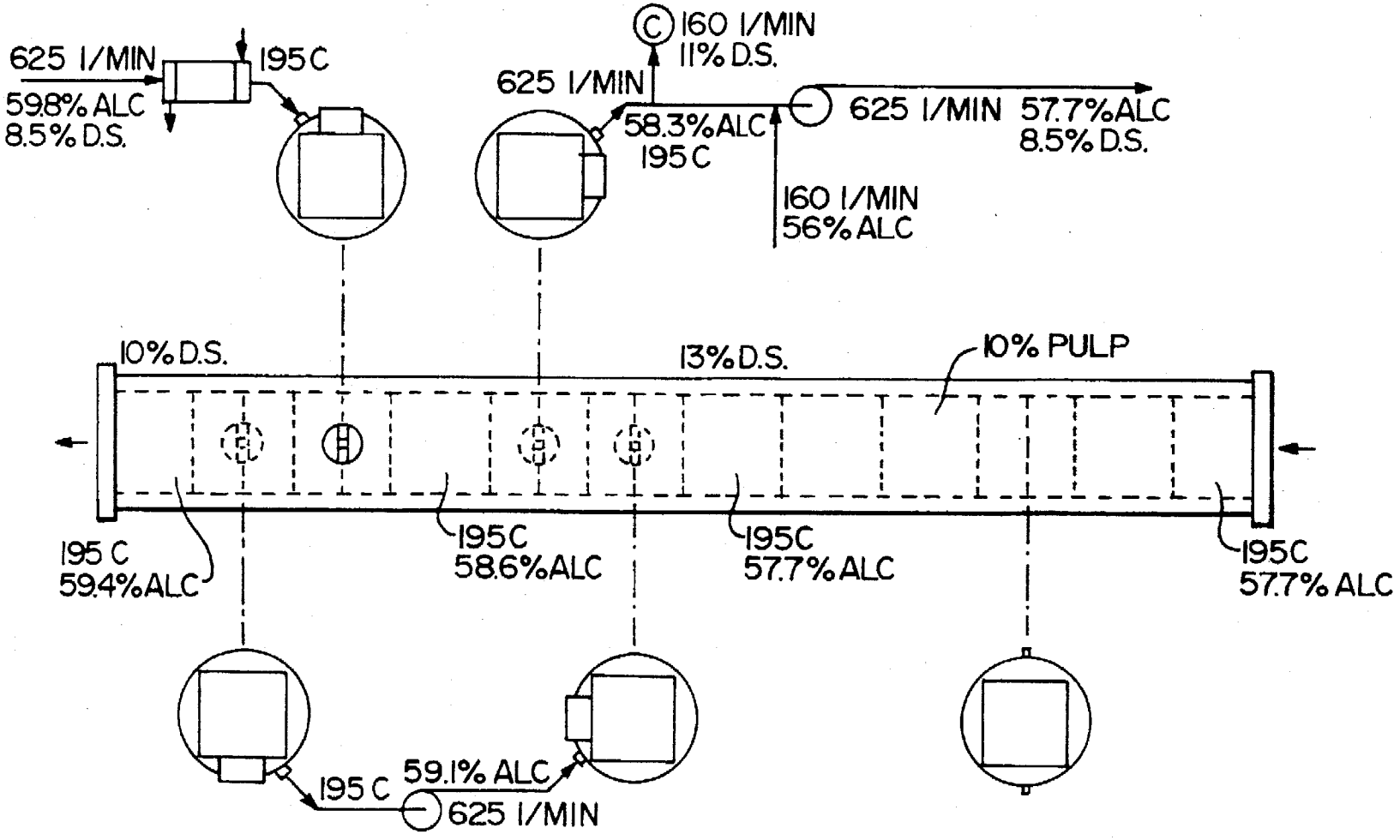

In the left part of FIG. 23, there is the "displacement wash at the end of the cooking zone 2". This comprises two pair of flow inlet and flow outlet modules. It will be noted that there is a heat exchanger leading into the first flow inlet module to add heat to the flow of filtrate. It will also be noted that at the upstream end of the displacement wash for cooking zone 2, there is added liquid of 56% alcohol content, and there is a corresponding outflow indicated at location "C".

Figure 24:
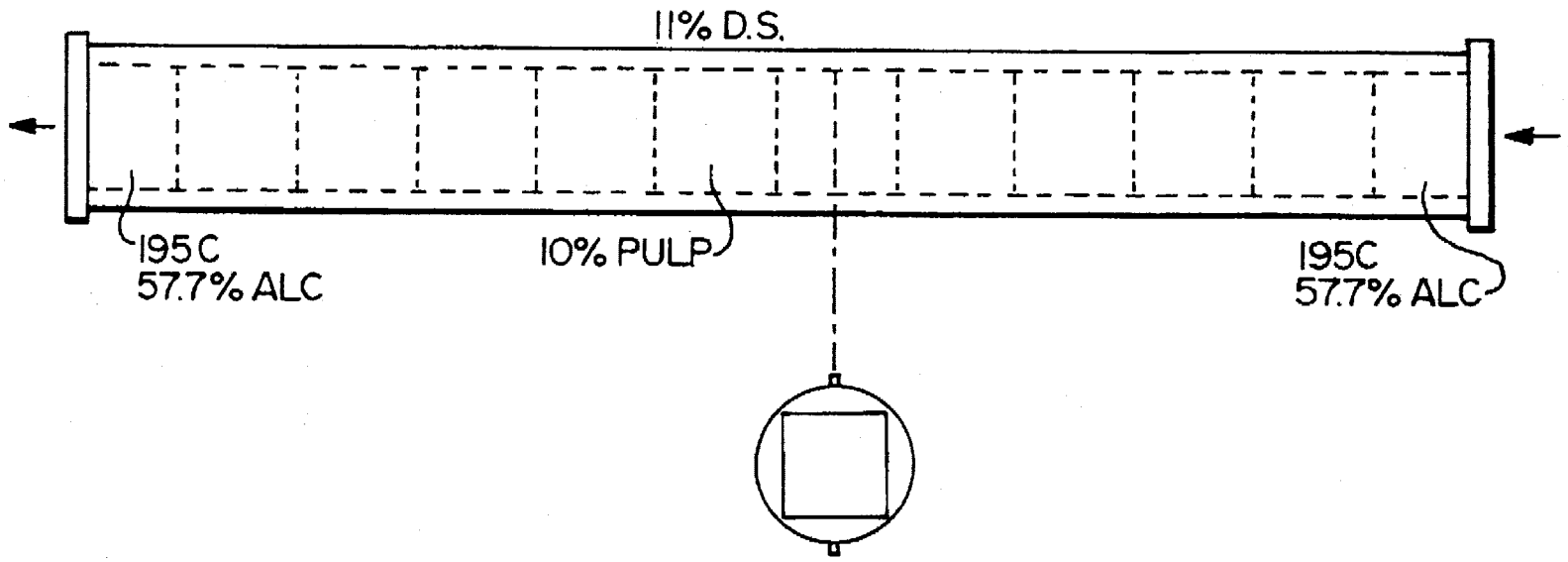

In the right hand part of FIG. 23, there is shown the downstream portion of cooking zone 2, and the rest of cooking zone 2 is shown in FIG. 24. It will be noted that at the entry portion of cooking zone 2 (see the left hand part of FIG. 25), the dry solids content of the pulp slurry is 10%, and at the downstream end of the cooking zone 2, the dry solids content is 13% (see FIG. 23).

Figure 25:
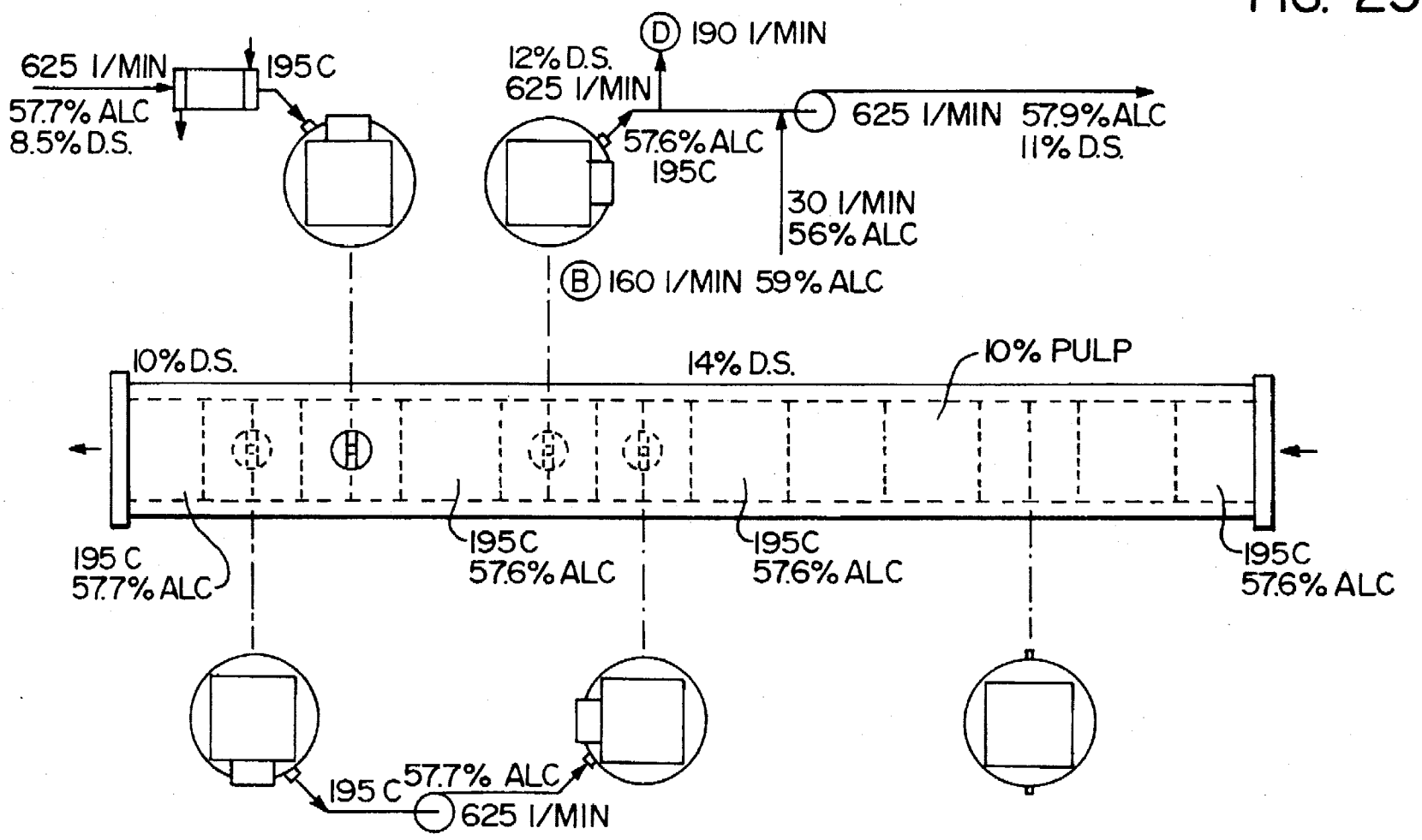

In the left hand side of FIG. 25, there is a displacement wash zone at the end of the cooking zone 1.

It will be noted that at the upstream end of the displacement wash zone of cooking zone 1, there is an inflow of the filtrate that was discharged further downstream at location "B", and there is also an inflow of additional liquid at 56% alcohol content. There is a corresponding outflow at location "D".

Figure 26:
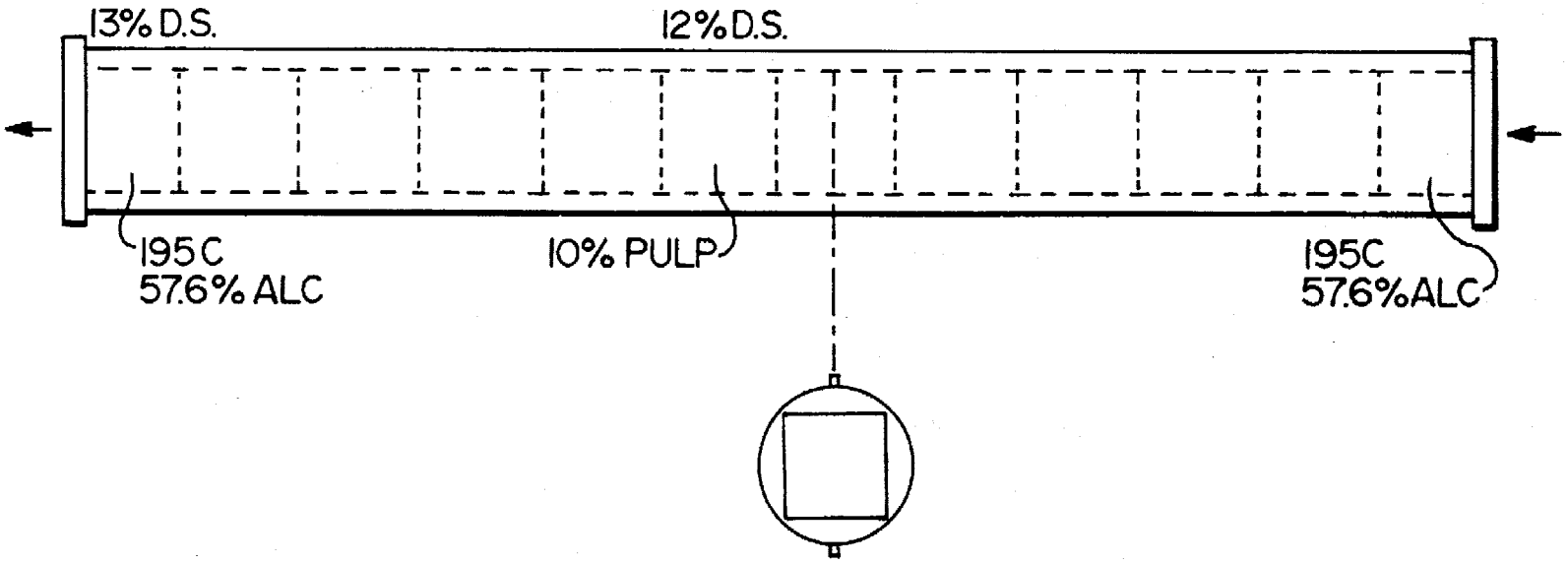

In the right hand part of FIG. 25 and in FIG. 26, there is shown cooking zone 1. it will be noted that the pulp slurry entering cooking zone 1 (see the left hand of FIG. 27) is at dry solids, and at the downstream end of cooking zone 1 the dissolved solids is at 14%.

Figure 27:
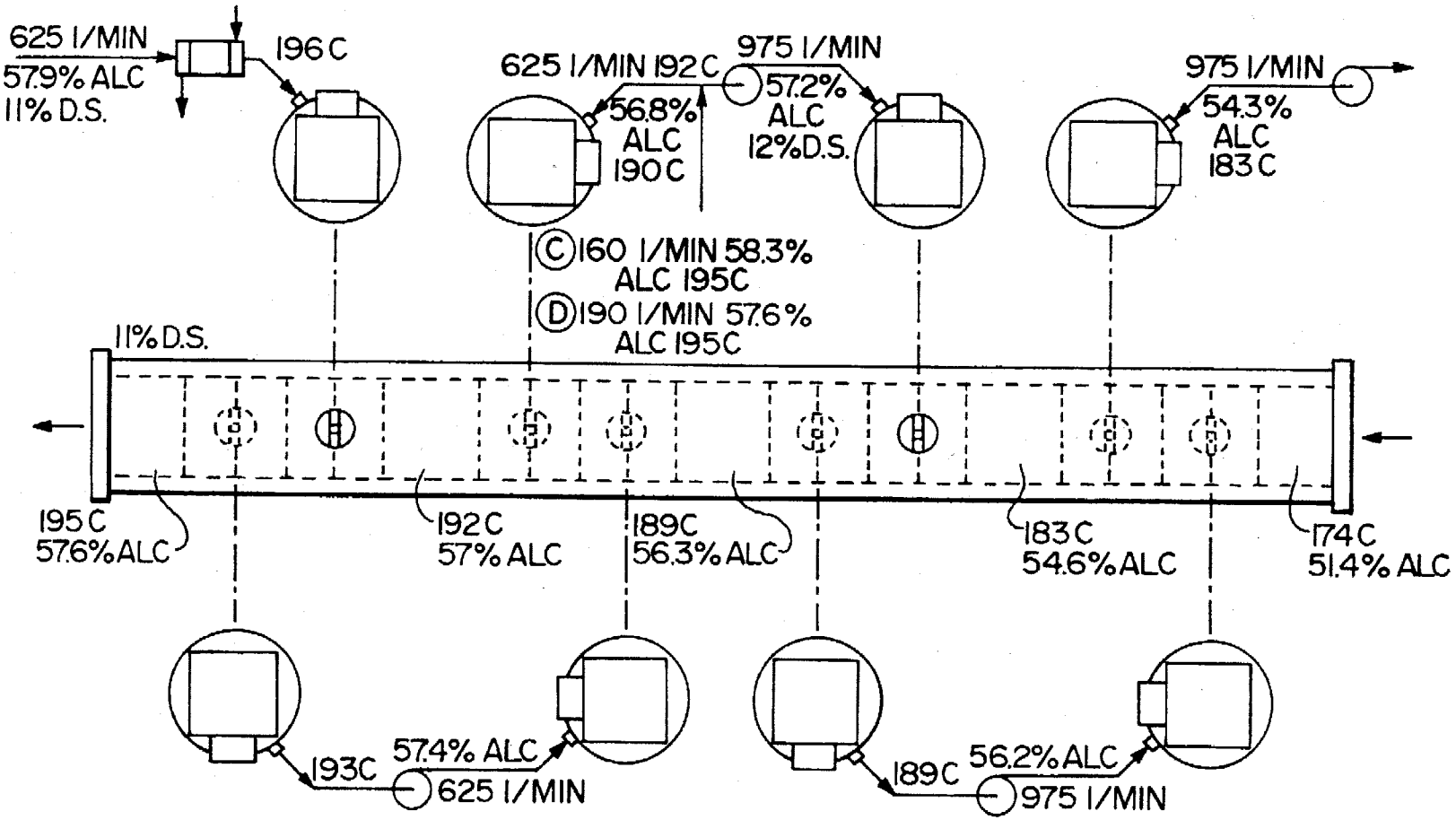
Figure 28:
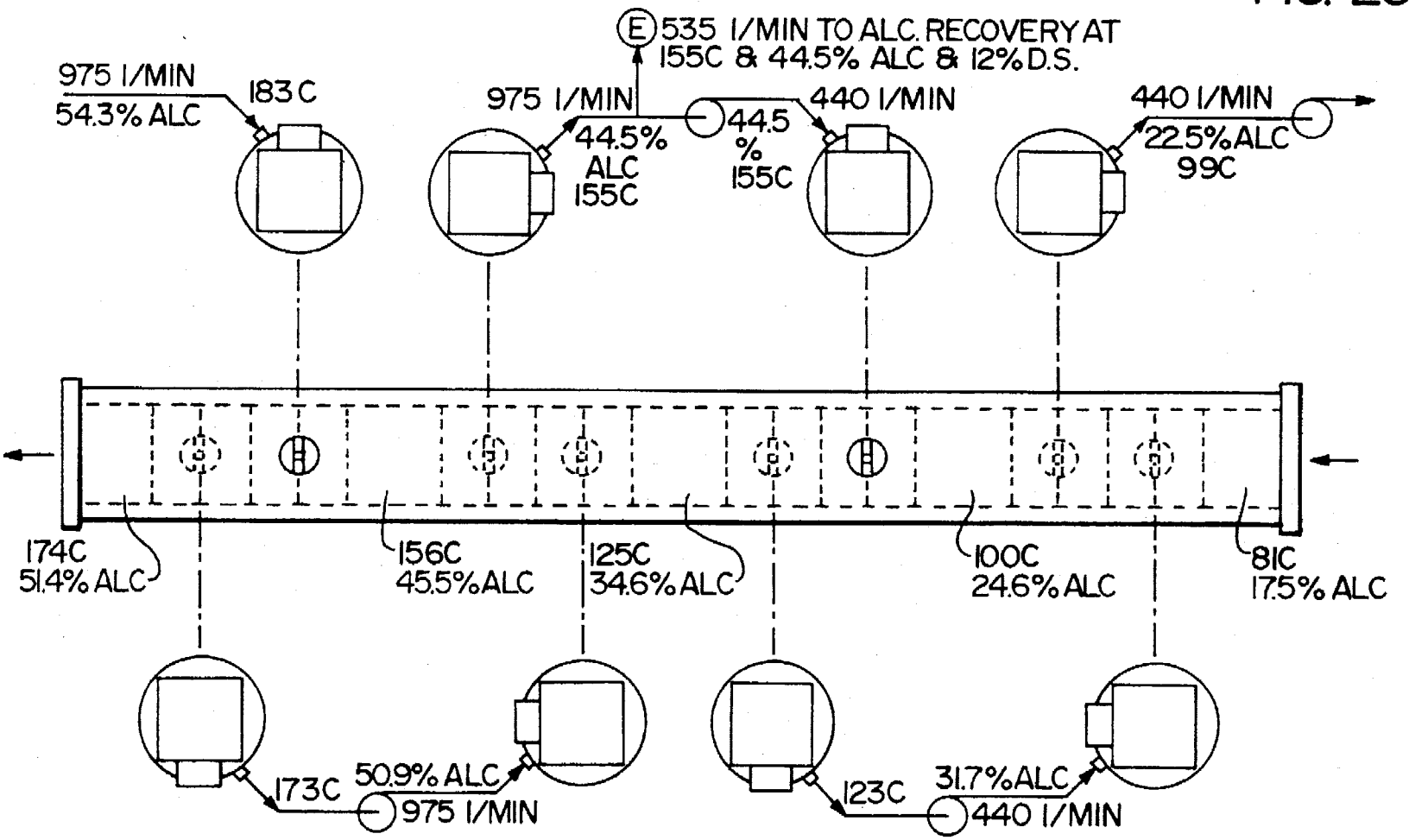
Figure 29:
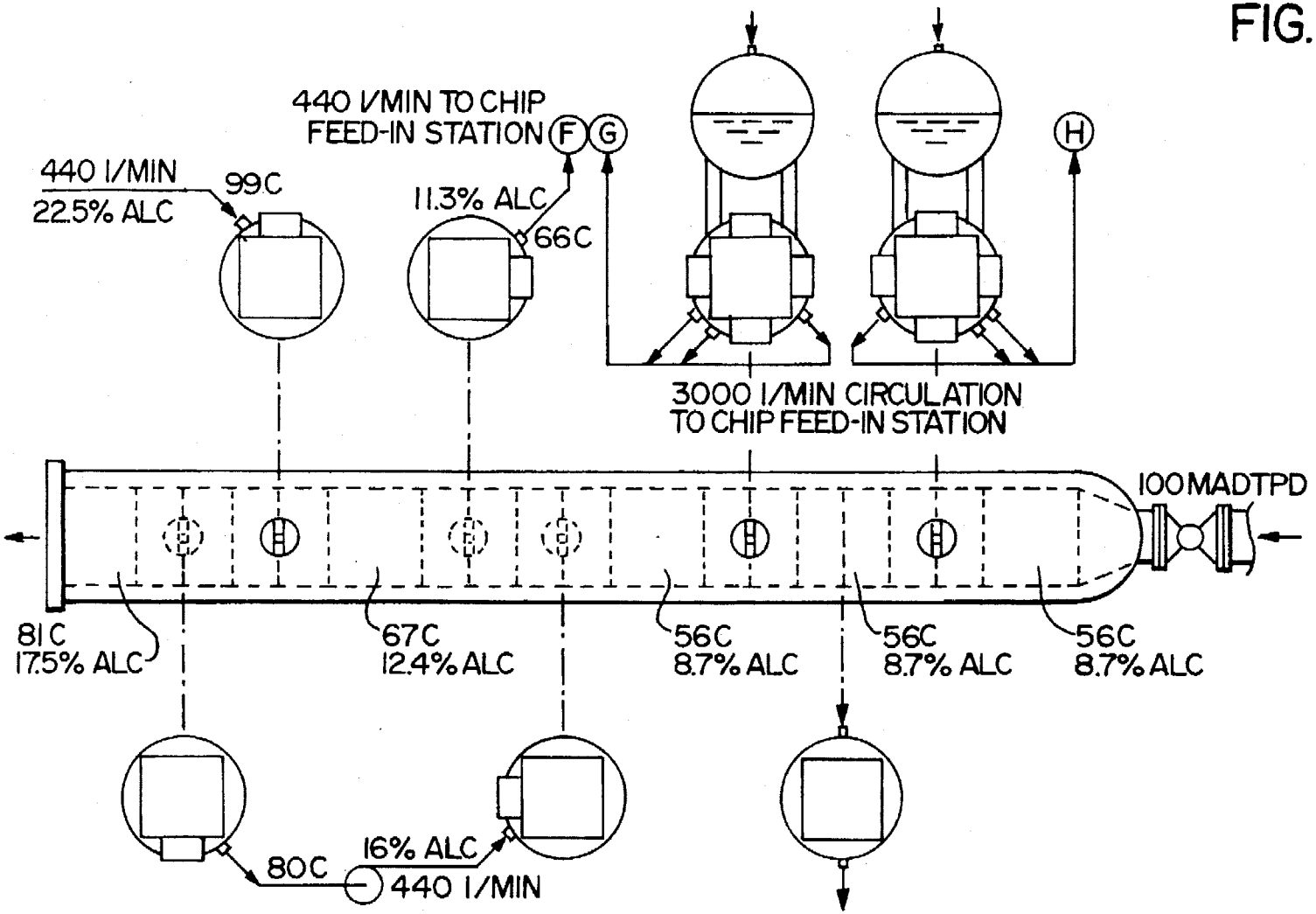

In FIGS. 27 and 28, and also in the left part of FIG. 29, there is shown the impregnation zone. In this impregnation zone there are ten pairs of a flow inlet module and a flow outlet module, with each pair of the flow inlet and flow outlet modules recirculating the filtrate in an upstream direction. As can be seen in the middle of FIG. 27, the outflow from locations "C" and "D" further downstream are added to the flow of filtrate. It can be seen from observing the operating values shown in FIGS. 27, 28 and 29 that as the filtrate recirculates in an upstream direction in the digester, the temperature decreases and the alcohol content decreases in the recirculating filtrate. In FIG. 28, just downstream of the first four rearmost pair of flow inlet and flow outlet modules, there is a discharge of the filtrate at location "E", and this is directed to the alcohol recovery location.

With reference to FIG. 29, it can be seen that the outflow from the furthest upstream flow outlet module is discharged at location "F" and directed to the chip feed-in station to be mixed with the wood chips that are directed into the inlet of the digester.

In the right part of FIG. 29, there is illustrated the dewatering section. It will be noted that there are two dewatering modules, and the outflow from these dewatering modules at locations "G" and "H" is directed to the chip feed-in station. The slurry of wood chips and filtrate are directed into the inlet end of the digester through the valve, such as indicated at 105 in the first embodiment.

In the description of the first embodiment, it was indicated that a pressure equalizing fluid (either gaseous or liquid) surrounding the square container 116 is utilized. It is believed to be desirable to utilize a pressurized liquid which has substantially the same composition as the filtrate which is inside the square container. This would better insure pressure equalization at different temperature levels.

C. THIRD EMBODIMENT OF THE INVENTION

17. Introduction To The Third Embodiment

The third embodiment is shown in FIGS. 30 through 41. In this section, there will first be an overall description of the system of the third embodiment with reference to FIG. 30. Following this, there will be three sections of text (Sections 18–20) devoted to three portions of the system of this third embodiment which merit more detailed discussion, these being:

a. the cross flow rings and their mode of operation;

b. the wood chip feed assembly, and filtrate recirculation zone;

c. the impregnation zone and its mode of operation.

After this, in Section 21 there will be a general description of the overall operation of the third embodiment, and in Section 22 there will be a description of the evaporating and recovery system, followed by a brief summary of Section 23.

Figure 30:
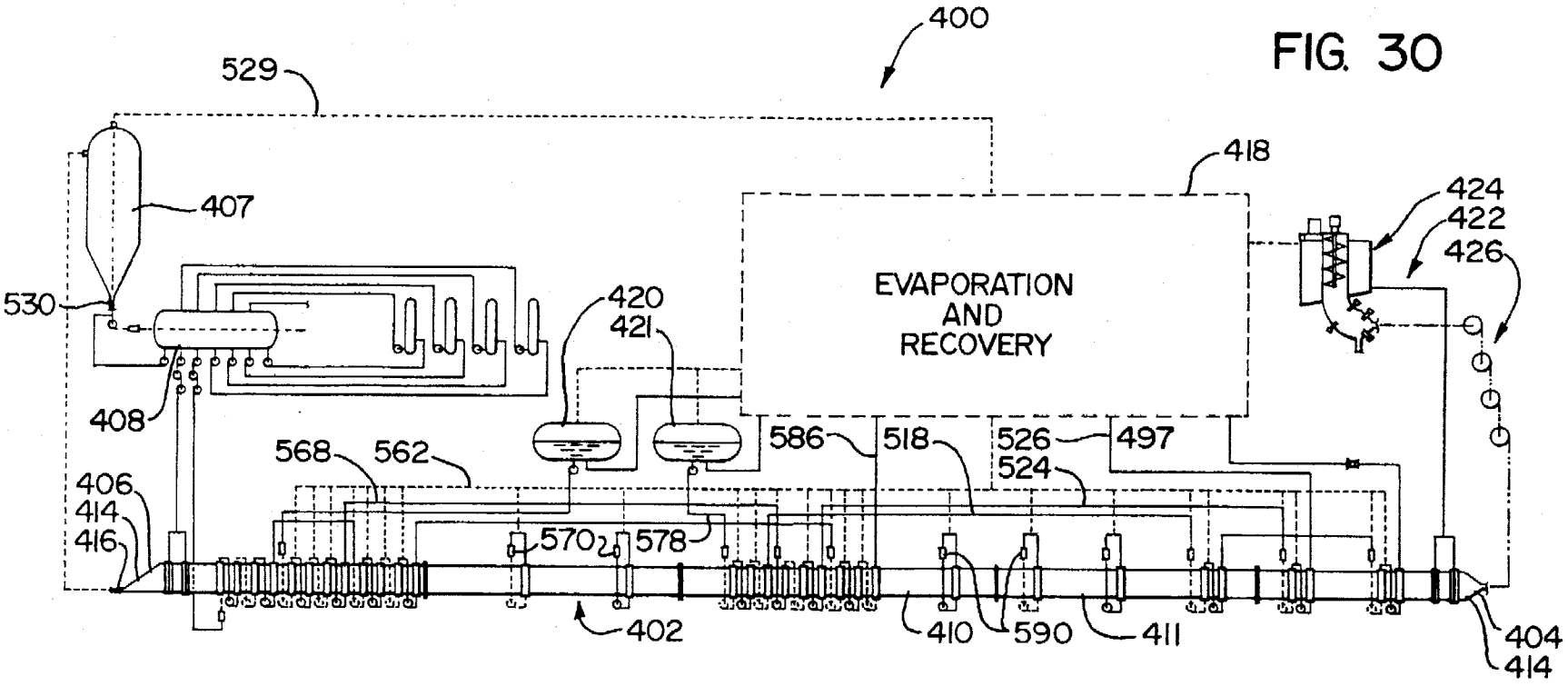
FIG. 30 is a schematic side elevational view of a third embodiment of the present invention.

To give an overview of this third embodiment, reference is made first to FIG. 30. The digester system 400 comprises a digester 402 having a rear chip inlet end 404, and a forward pulp outlet end 406. There is a blow tank 407 which receives the diluted pulp from the front outlet of the digester 402, and a washer 408 which receives the pulp from the blow tank 407.

The filtrate from the washer 408 is in turn directed into the digester 402 at its outlet end 406, and the manner in which this is accomplished will be described later herein. While various pulp washers that already exist in the prior art could be used in the present invention, particular advantages can be obtained by the washer 408 being the same as, or similar to, the washer described in U.S. Pat. No. 5,482,594 entitled "LIQUID REMOVAL APPARATUS AND METHOD FOR WOOD PULP", issued on Jan. 9, 1996, the inventor being the same as the inventor in the present patent application. One of the reasons for this is that this particular washer enables the pulp that is received from the digester 402 to be washed at several atmosphere pressure and at a high pulp consistency (7–10 bars and 20% to 30%), respectively). This is accomplished in a quite effective manner so that the amount of alcohol which is lost (ethyl alcohol being the preferred digesting agent) and carried out with the washed pulp is relatively small and the loss due to evaporation is practically nil, thus enhancing the economy of operation of the present invention.

The digester 402 comprises an elongate pressure vessel 410 having a cylindrical sidewall 411, a rear wall 412 into which the wood chips carrying filtrate is directed, and a front wall 414 through which the diluted pulp is discharged through an appropriate blow valve 416. One significant difference in this third embodiment is that it does not have the square cross section inner container that is present in the first two embodiments. Nor does this third embodiment have the inflow and outflow modules as described in the first two embodiments. Instead, their is provided a cross flow ring system (mentioned very briefly above) which will be described in more detail later herein in Section 18.

In FIG. 30 there is shown only schematically an evaporating and recovery plant 418 to which the filtrate from the digester is directed. This evaporation and recovery plant 418 recovers the alcohol from the filtrate and directs this to a pair of alcohol supply tanks 420 and 421, from which the alcohol is directed back into the digester 402. Also, the evaporation and recovery plant 418 accomplishes the recovery of the dry solids (i.e. organic material derived from the wood chips during the digesting process) in a quite advantageous manner which also will be described in more detail later herein with regard to the description of the impregnation zone of the present invention. This will be described later with reference to FIG. 43.

At the inlet end of the digester 402, there is the wood chip feed assembly 422 which comprises a wood chip and filtrate supply section 424 and a pump section 426 to receive the diluted wood chips from the supply section 424 and direct these into the inlet end 404 of the digester 402.

The digester 402 comprises, in terms of function, seven sections, which will be identified below in the order in which they are placed, beginning at the forward end 406 of the digester 402, and proceeding on to the rear end 404, these being:

a. dilution zone;

b. displacement wash zone A c. cooking zone 2 d. displacement wash zone B e. cooking zone 1 f. impregnation zone g. wood chip filtrate recirculation zone

It is believed that the operation of these seven zones would be in large part understood from a review of the description of the first embodiment. In the later sections, these will be described in more detail. In the following three sections, there will be, as indicated above, a description of three sections of the third embodiment.

18. Cross Flow Ring System

This cross flow ring system will be described with reference to FIG. 31 through 33. By way of introduction, it will be recalled that in the first two embodiments, the cross flow of the filtrate and alcohol is accomplished by having at various locations along the length of the digester an upstream inflow module 148, which is immediately followed in the downstream direction by an outflow module 190. Thus, at various locations, there is an inflow of filtrate (along with alcohol at some locations) which travels laterally across the digesting chamber and also downstream to the opposite side where a portion of this flow would be taken out by the outflow module, with another portion of that flow continuing downstream in the digester.

The cross flow function in the present invention is accomplished by sets or sections of cross flow rings 430 (FIG. 32) positioned around the outside of the cylindrical sidewall 411 of the digester pressure vessel 410. Reference is first made to FIGS. 31 and 32. It can be seen in FIG. 32 that the ring 430 has a "U" shaped cross sectional configuration, and thus comprises an outer circumferential plate portion 432 which is spaced outwardly from the digester sidewall 411, and a pair of radially inwardly extending flanges 434 which are welded at 436 to the outer surface 438 of the digester sidewall 411. The ring 430 defines a circumferential chamber 440 which has a depth dimension (indicated at "a") to provide an adequate cross section for filtrate flow.

Each ring 430 extends entirely around the circumference of the digester sidewall 411. The chamber 440 is actually divided into two arcuate sections. As can be Been in both FIGS. 31A and 31B, there is an inflow chamber section **440*a* which has an arcuate length of about 90°, and an outflow chamber section 440*b* which has an arcuate length of about 180°. At the inflow chamber 440*a*, the sidewall 411 is formed with several (four as shown herein) slots 442 which slant relative to the longitudinal center axis 444 (see FIG. 33) of the digester 402 at an angle of about 45°, and which extend circumferentially in a 90° arc. Thus, the plane occupied by each slot 442*a* has the configuration of a segment of a conical surface. In like manner, there are four similar slots 442*b* leading into the chamber or plenum 440*b*, these also slanting inwardly toward the center axis 444 in a downstream direction at an angle of about 45° relative to the longitudinal axis 444 (see FIG. 33). However, the arc length of the slots 442*b*** is 180°. This 45° slant angle could be varied, for example, between 20° to 80°.

There is an inlet fitting **446*a* leading through the outer wall 432 at the location of the inflow chamber 440*a*, this defining an inlet passageway into the chamber 440*a*. In like manner, there is an outflow fitting 446*b* leading from the outflow chamber 440*b***.

Figure 31A:
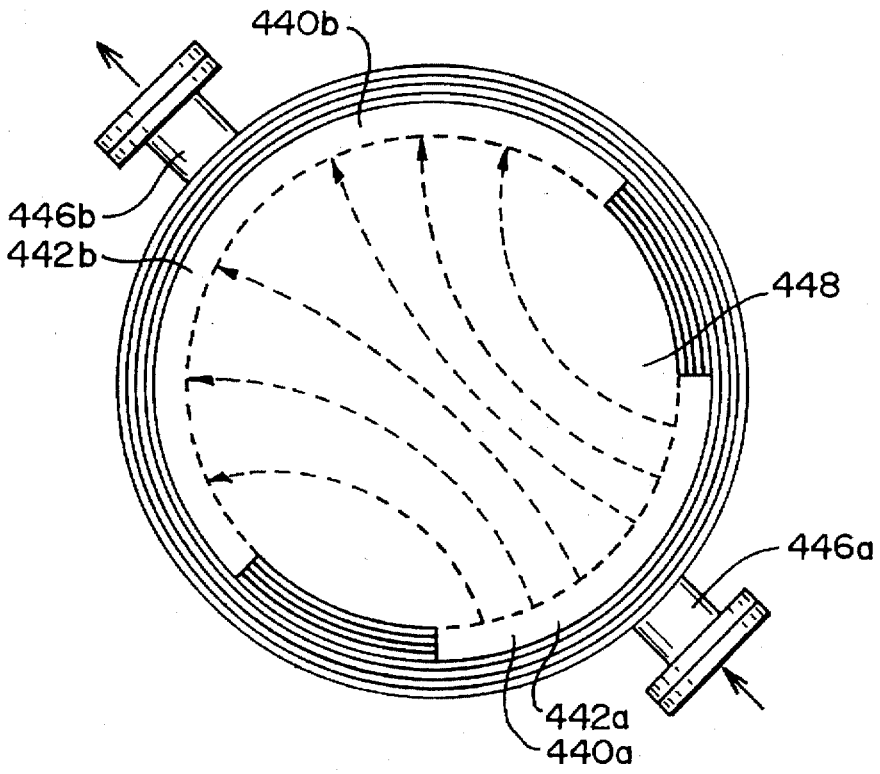
FIGS. 31A and 31B are cross-sectional views of two of the cross flow rings of the present invention, these Figures illustrating the different angular orientation of adjacent cross flow rings.
Figure 31B:
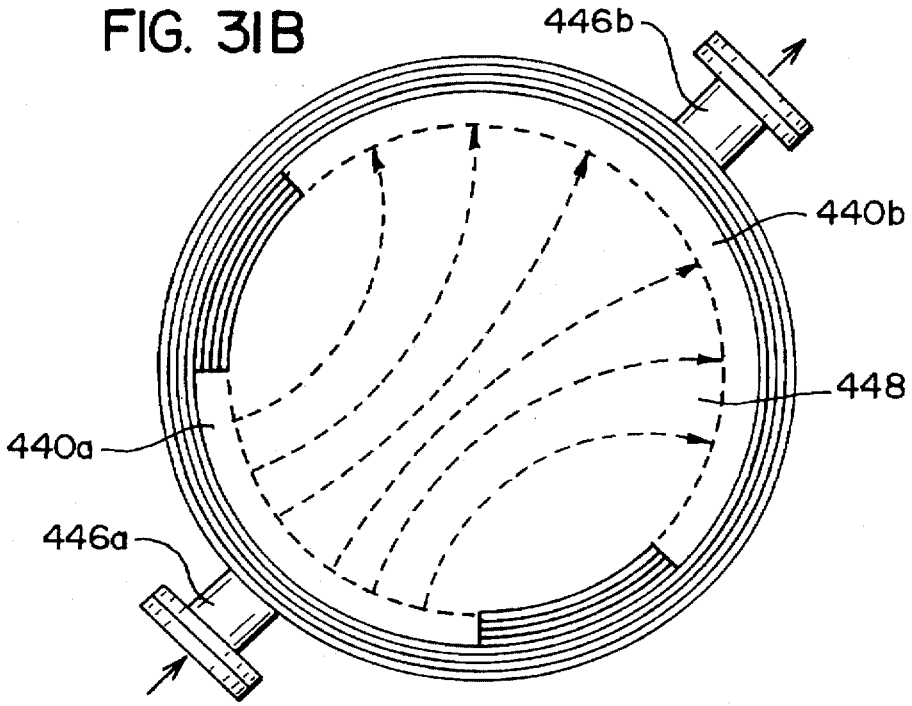

As can be seen in FIGS. 31 and 31B, part of the flow from the chamber **440*a* is directed across the main interior chamber 448 of the digester 402 to displace liquid in the chamber 448 through the outflow passageways 440*b*. However, angular positions of the passageways 440*a* and 440*b* of each set are offset 90° in an alternating pattern. Thus, longitudinally adjacent cross flow rings 430 are angularly offset relative to one another by ninety degrees. It can be seen that in the upper FIG. 31A, the inflow passageway 440*a* and the outflow passage 440*b* are directly opposite one another and their alignment slants upwardly to the left. In the lower showing at FIG. 31B, the inflow passageway 440*a* has been rotated to the left 90°, with the opposite outflow passageway 440*b* again being positioned diametrically opposite to the passageway 440*a*, so the alignment slants upwardly to the right. Obviously the rings 430** could be angularly positioned in the same alignment, and also the alternating pattern could be modified, as well as the angular displacement. These changes in flow direction enhance the effectiveness of the displacement wash, since the cross displacement wash is performed in alternating direction.

At this point, a clarification should be made with reference to the flow lines shown in FIGS. 31A and 31B. There is a constant flow of the liquid and pulp in the digester pressure vessel 410 in a forward direction. As the liquid is discharged from the inflow chamber **440*a* to pass into the chamber 448, in addition to having a flow component across the chamber 448, the flow also has a travel component in a forward direction toward the front end of the digester 402**.

Figure 33:
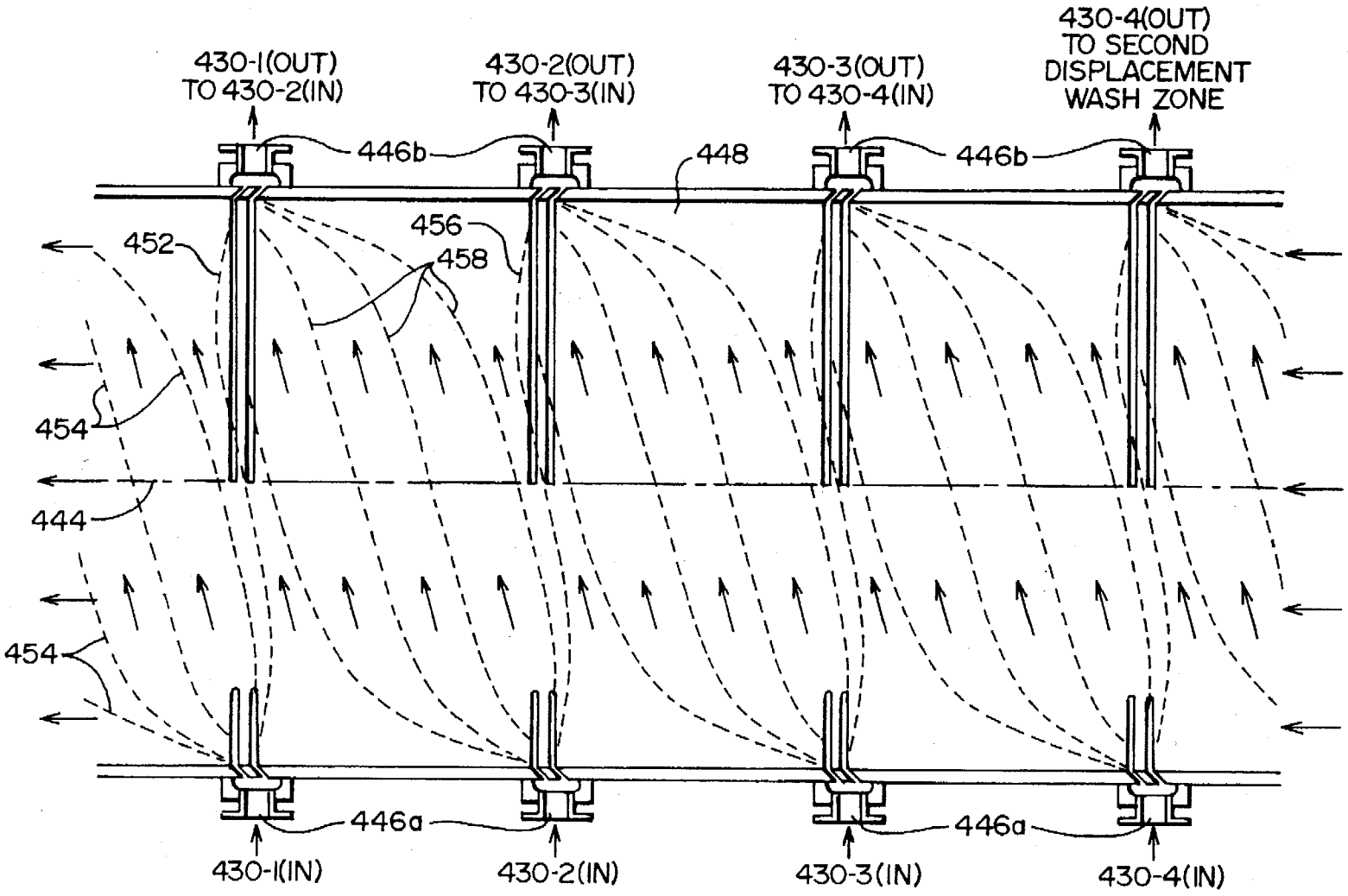
FIG. 33 is a longitudinal sectional view showing flow patterns in Displacement Wash Zone A
Figure 34:
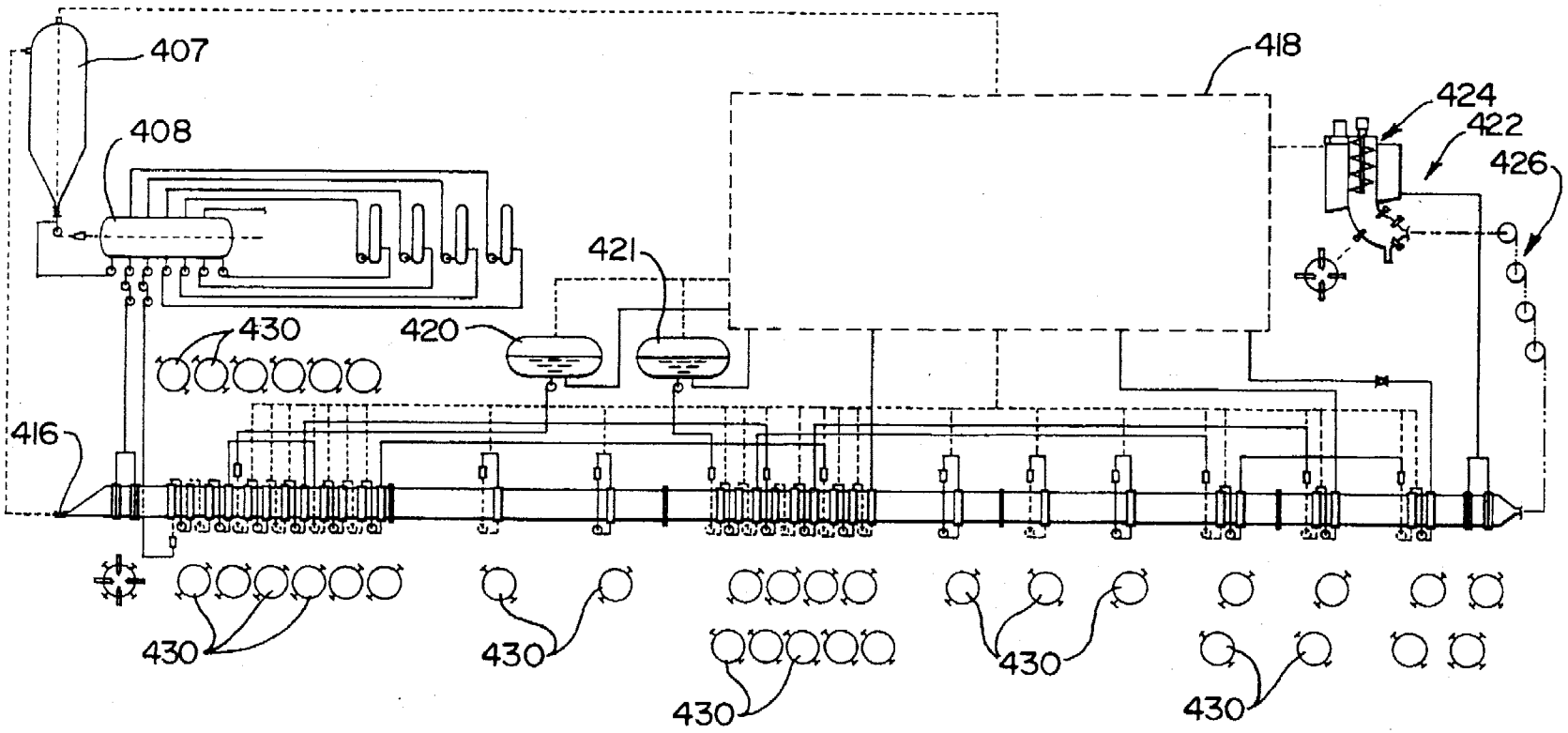
FIG. 34 is a view similar to FIG. 30, but showing additionally the various cross flow rings and their angular orientation.

To follow this line of thought further, reference is now made to FIG. 33, where there are shown the four cross flow rings 430 which comprise the most forward section of the displacement wash zone "A". For convenience of explanation, the four rings 430 have been designated 430-1 through 430-4, in an upstream direction. The excess part of the filtrate from the washer 408 is directed into the inlet port of the ring 430-1. The flow of this filtrate is illustrated by the arrows and the dotted lines. It can be seen that one of these dotted lines 452 moves across to exit out of the outlet port indicated at 430-1 (out). The remaining flow lines 454 proceed in a downstream direction toward the dilution zone.

The outflow from the ring 430-1 is pumped through a recirculating conduit positioned outside the digester vessel 410 to the inlet port at 430-2 (in). It can be seen that there is again cross flow where one of the flow lines 456 travels from the port 430-2 (in) across to the outlet port 430-2 (out), while other flow lines 458 travel across the chamber 448 and somewhat downstream toward the outlet port at 430-1 (out). This pattern repeats itself relative to the next rings 430-3 and 430-4. The flow from 430-4 (out) is directed upstream to re-enter into the digester at the inlet port of the most forward ring 430 in the second filtrate displacement wash zone (which is referred to in a later portion of this text as wash station 552) in displacement wash zone "A". (This can be seen by examining FIG. 37).

To explain the effect of this flow pattern, let us examine the flow which goes out the port 430-1 (out) and is directed into the port 430-2 (in). It can be seen that part of the flow (indicated by the broken lines 458) passes through the chamber 448 to go to the outlet port at 430-1 (out). However, a portion of this flow (indicated by the broken line 456) travels straight across to pass outwardly through the outlet port 430-2 (out). Further, the flow from the port 430-2 (out) moves through a recirculating conduit upstream to re-enter at the inlet port 430-3 (in). Thus, it can be seen that there is an overall circulating pattern where a greater portion of the flow from one inlet port migrates downstream to the next adjacent outlet port, and another portion of the flow coming through the inlet port passing straight across the chamber 448 to exit from the outlet port straight across and then to travel upstream through a recirculating conduit to next upstream inlet port. The overall effect of this pattern is that there is a net movement of the filtrate in an upstream direction in that there is an increment of downstream travel inside the vessel 410, and then a slightly greater increment of upstream travel through the recirculating pattern of the filtrate. Thus, in the digester vessel 410 there is a constant flow of filtrate downstream toward the outlet end 406. Outside the digester vessel 410 there is a counter flow upstream in the recirculating conduits, then across and through the chamber 448, then further upstream through the outside recirculating conduits, etc. The overall effect of this will be described more fully later herein.

It should be pointed out that FIG. 33 is not drawn with total accuracy, since the inlet ports 430-1 through 4 are shown in FIG. 33 as having the same angular orientation. Actually, (as illustrated in FIGS. 31A and 31B), the angular position of the rings 430 is in an alternating pattern so that if one inlet port **446*a* is at a lower right hand position (as shown in FIG. 31A) the next adjacent inlet port 446*a* is (as shown in FIG. 31B) at the lower left hand position. Therefore, with reference to FIG. 31A, the upper part of the cross flow would go diametrically across to the inlet slots at 440b, while part of the flow would travel across, but with a downstream component of travel, and off to one side, since the downstream inlet slot 440b** is displaced 90° from the diametrically opposed position.

19. Wood Chip Feed Assembly and Filtrate Recirculating Zone

Figure 39:
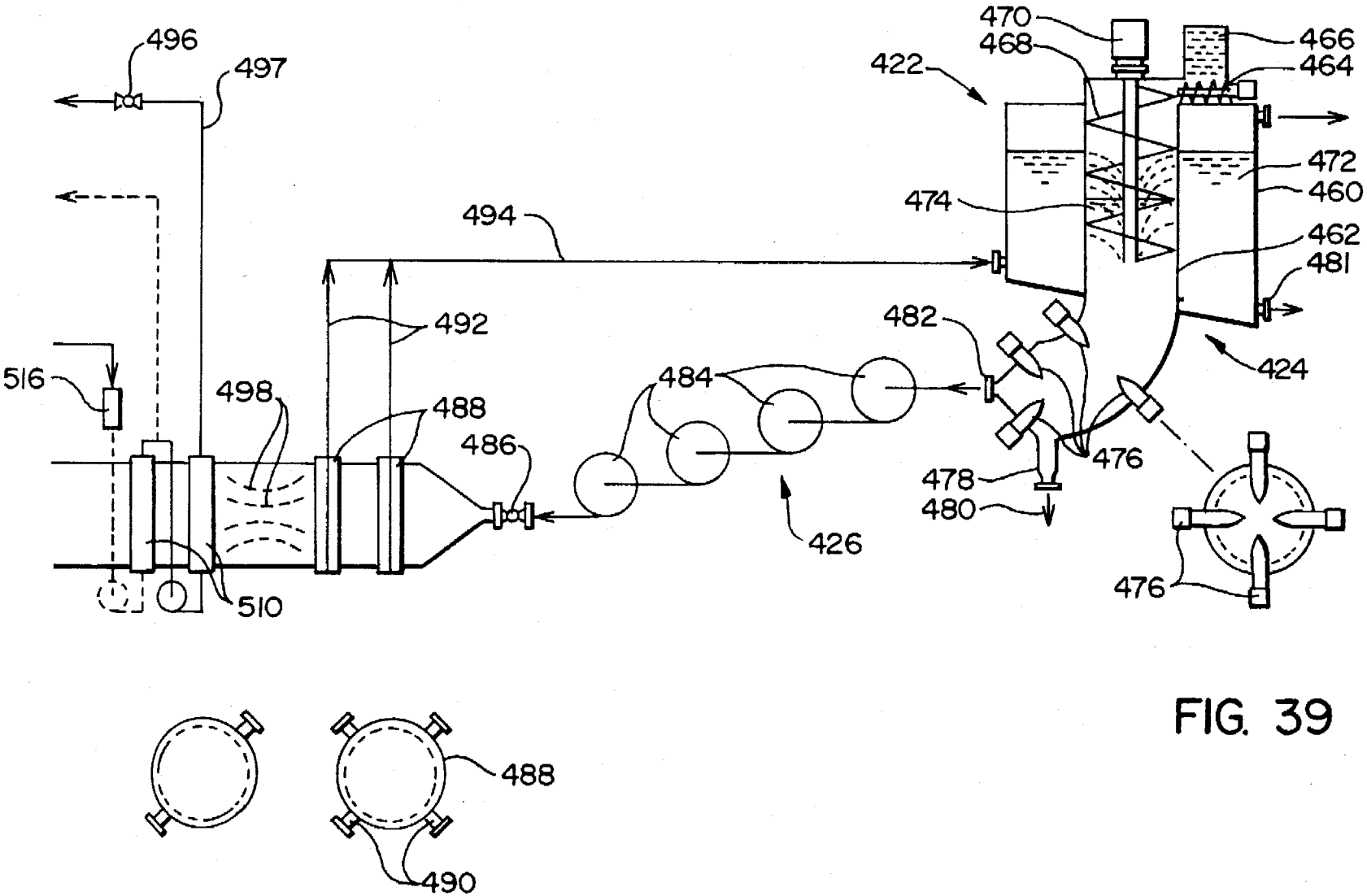

The wood chip feed assembly 422 can best be explained with reference to FIG. 39. There is a filtrate tank 460 in which is positioned a feed tube 462, and a measuring auger 464 which takes wood chips from a wood chip bin 466 and feeds these into the upper end of the feed tube 462. To move the wood chips downwardly in the feed tube 462, there is provided a vertical auger 468 that is rotated by a motor 470. The filtrate 472 in the tank 460 flows through a plurality of openings extending downwardly along in the sidewall of the feed tube 462. Thus, the flow of the filtrate 472 is through the sidewall of the feed tube 462 and into the passageway 474 in the feed tube 462. At the lower end of the feed tube 462, there are eight rotating agitators 476 which mix the wood chips into suspension with the filtrate. At the lowermost part of the feed tube 462 there is a rock and iron sump 478 having a blow valve 480 by which the rocks and metal particles can be extracted periodically. At the lower end of the tank 460, there is a clean out valve 481. Also, there is a vapor line 493 from the filtrate tank to the evaporation and recovery system 418. (See FIG. 36).

The out flow from the feed tube 462 is directed through an outlet 482 to the aforementioned pump section 426 of the wood chip feed assembly 422. There are four centrifugal pumps 484 which operate in series in order to raise the wood chip and filtrate slurry to a sufficiently high pressure to enter the digester at the inlet valve 486.

In operation, when the pumps 484 start operating, the wood chip and filtrate slurry is drawn from the flow passageway 474, so that the liquid level in the passageway 474 drops. The arrangement of the feed tube 462 with its vertically spaced openings automatically adjusts the level of the filtrate within the feed tube passageway 474, since when the filtrate level in the passageway 474 drops to a lower level, the higher level of the filtrate 472 in the tank 460 causes an increased flow through the sidewall openings of the feed tube 462 into the passageway 474.

To enable the centrifugal pumps 484 to pump the wood chip/filtrate slurry, it is necessary that there be approximately twenty four parts filtrate to one part wood chips by weight. This ratio is maintained by operating the measuring auger 464 so as to obtain a desired rate of feeding for the wood chips, and also sizing and operating the pumps 484 so that the volumetric flow through the pumps 484 properly matches the feed rate of the wood chips to obtain this ratio.

Since a wood chip to liquid ratio of twenty four to one is substantially greater than the desired wood chip to liquid ratio which is directed into the impregnation zone of the digester, it becomes necessary to withdraw most of the filtrate from the wood chip filtrate slurry entering the digester 402 and return this filtrate to the tank 460. This is accomplished at the wood chip filtrate recirculating zone which is immediately downstream of the inlet valve 486. This is accomplished by two recirculating rings 488. Each of the two recirculating rings 488 has substantially the same configuration as the cross flow rings 430, except that the plenum chamber extends entirely around the circumference of the digester sidewall 411. Also, each ring 488 has four extraction fittings 490 which withdraw the filtrate from the interior of the digester vessel 410. This filtrate flows through the lines 492 into the line 494 and back to the tank 460 through an inlet at 496.

It is necessary to supply makeup filtrate to the tank 460. The reason for this is as follows. It takes approximately two tons of oven dry wood chips to produce (at fifty percent yield) one ton of pulp. The moisture content of two tons of oven dry wood chips is usually between about one ton to two tons of water, depending upon how dry or wet the wood chips are. If the wood chips are rather dry, they absorb liquid as they pass downwardly through the feed tube 462 and through the pumps 484. Thus, the extra liquid which is absorbed into the wood chips needs to be made up. This makeup liquid is supplied from the upstream end of the impregnation zone. Thus, there is shown in FIG. 39 several arrows 498 illustrating the flow of this makeup filtrate. There is a suitable level sensor at the tank 460 to detect when the makeup liquid is required, and the flow control valve 496 in line 497 to the recovery plant is operated in a manner that the flow through the line 494 to the tank 460 is sufficient to maintain the level in the tank 460.

20. The Impregnation Zone

In the impregnation zone (see FIG. 36), there is a downstream impregnation section 502 and an upstream impregnation section 504. Further, there are three displacement wash sections, one displacement wash section 506 being immediately downstream of the impregnation section 502, a second displacement wash station 508 between the impregnation sections 502 and 504, and the third at 510, immediately upstream of the impregnation section 504. There are three heat exchangers, 512, 514, and 516, being positioned immediately downstream of the three displacement wash sections 506, 508 and 510.

The filtrate from the alcohol displacement wash station of displacement wash zone "B" (See FIG. 30) is directed through the line 518 into the heat exchanger 512, and thence through the displacement washing section 506 to exit through the line 520. The flow of filtrate through the line 520 is then directed through the heat exchanger 516 into the most upstream displacement wash section in the impregnation zone. Then the outlet flow from the upstream cross flow ring of the displacement wash section 510 travels through the line 497 to the evaporation and recovery plant 418.

The outflow of the filtrate from the third displacement wash section in the displacement wash zone "B" flows through a line 524 to pass through the heat exchanger 514 and thence pass through the two cross flow rings of the middle displacement wash section 508. The filtrate discharge from displacement wash section 508 travels through line 526 to the evaporation and recovery plant 418.

The heat exchanger 512 brings the temperature of the filtrate up to 205° C. so that the temperature of the filtrate flowing downstream through the cooking zone 1 is at a sufficiently high temperature, for example 195° C. The remaining two heat exchangers 514 and 516 are used to adjust the filtrate temperature for the two impregnation sections 502 and 504.

The withdrawal of the filtrate through the lines 497 and 526, which has a dry solids content of about seven percent, has certain advantages. In the impregnation zone there is being extracted from the wood chips a relatively large percentage of extraneous materials present in the wood chips. Examples of extraneous materials are volatile acids, volatile oils, resin and fatty acid fractions, etc. Volatile oils have considerable economic value because of these being a source of turpentine, pine oil, and other organic matter. Softwood species, such as pines and cedars, are particularly rich in this fraction. These are often termed "essential oils". The major components of resin and fatty acid fractions include resin acids, fatty acids, turpene, and other esters and unsaponifables (waxes, sterols, etc.). Sterols include B-sitrosterol which has been researched for medical purposes and has proven to be extremely valuable. These are discussed in more detail in the book, "Second Edition, Volume 1, The Pulping of Wood" by Ronald G. MacDonald and John N. Franklin, published by McGraw-Hill Book Company.

Removal of extraneous materials opens up the pores and cavities in the wood chips to allow the alcohol digesting liquid to enter into the wood chips and accomplish the delignification. It is very valuable to extract these extraneous materials early so that they are not subjected to possible deterioration in subsequent cooking zones in the digester and that they are not diluted by other organic matter dissolved later in the cooking zones 1 and 2. Also, some of the extraneous materials can also have negative effects in the delignification process if these remain and are present in the cooking zones.

Thus present analysis indicates that by extracting the filtrate flow from the impregnation zone and treating this separately certain advantages would be produced in that this portion of the organic material has a quite different composition and value than other portions of organic matter which are later extracted from the wood chips. In the present invention, by diverting this organic material that is extracted in the impregnation zone at an early stage and recovering it separately, with the alcohol being evaporated, the further processing of this organic material into certain desirable by-products is substantially enhanced.

Figure 45:
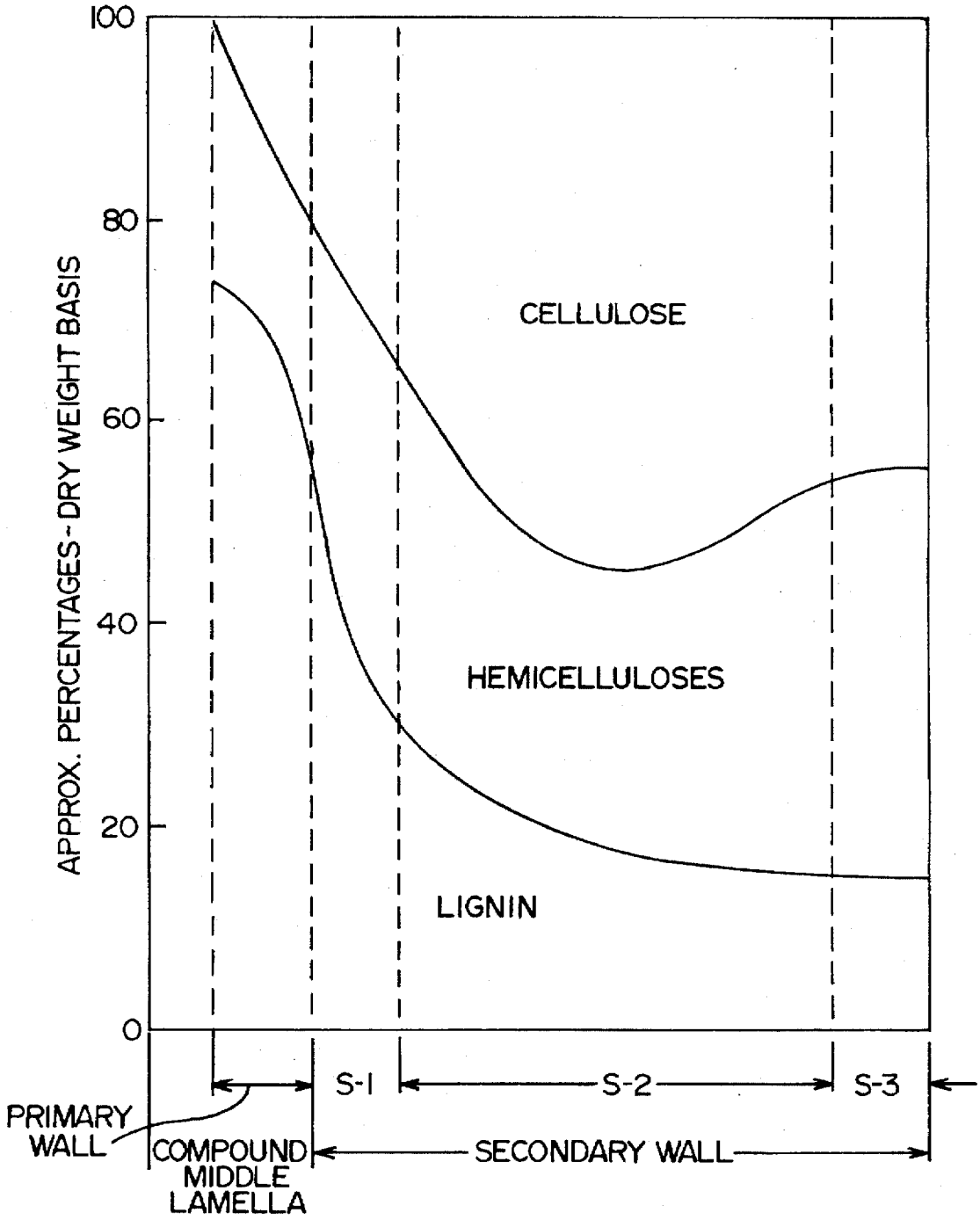
FIG. 45 is a graph illustrating the content of a typical wood cell, showing at the left hand side the outer surface of the wood cell, and at the right hand side the center of the wood cell.

Another benefit derived in this impregnation zone is that the filtrate that flows through the impregnation section 502 is recycled back to the upstream end of the impregnation section 504. By maintaining some of this extracted organic material present in the impregnation zone, in accordance with present analysis, an enhanced extraction process in the impregnation zone is accomplished. Thus, the term "impregnation zone" is somewhat incomplete, since this zone serves a dual function of both impregnation and extraction. To comment on this further, reference is made to FIG. 45 which represents the layers of a single cell of wood, Where the right side of the figure represents the longitudinal center line of the cell, and the left side represents the outer surface. It can be seen that the distribution in the cell is such that more of the lignin is nearer the outer layer, while the center part is rich in hemicellulose.

The liquor at the end of the first cooking zone is high in lignin content and low in extraneous materials, and is therefore heavier in composition. This is the liquor that is directed through the line 586 to be evaporated through an evaporating system separate from the impregnation zone.

Most of the liquor that is removed immediately after cooking zone 2 remains in the pulp/liquor flow in the middle of the displacement wash zone B and is pumped to the end of the impregnation zone. This liquor is rich in hemicellulose, and some of this migrates into the impregnation zone discharge liquor, thus adding hemicellulose to the extraneous materials stream going to the evaporation and recovery system 418.

Delignification is accomplished mainly in the cooking zones 1 and 2. Thus, the liquor that is directed from the end of cooking zone 1 and is directed through the line 480 to the evaporation and recovery system 418 provides a high percentage of the lignin that is extracted from the wood chips.

21. Overall Operation of the Third Embodiment

This section is not only to describe the overall operation of the present invention, but also to provide more specific information about the other sections (i.e., zone) of the digester system which have not been described in detail in the prior sections related to this third embodiment. In sections 19 and 20, there was presented a more detailed description of the wood chip feed assembly, and also the seventh and sixth zones of the digester 402, namely the wood chip feed assembly and filtrate recirculation zone, and the impregnation zone. In the following description, each of the five other zones will be described in sequence, beginning at the front end of the digester where there is the dilution zone and then proceeding through the following zones in sequence to and including cooking zone 1. As this is done, reference will be made to the other components related to the operation in those zones.

Reference is first made to FIG. 30. As previously described in Section 17, a pulp slurry is discharged through the blow valve 416 and directed to the blow tank 407. The pulp slurry from the glow tank 407 is further diluted and directed into the washer 408. Part of the filtrate from the washer 408 is directed into the digester 402 at two locations. First, some of the filtrate is directed into the dilution zone to mix with the pulp and filtrate that is received from the upstream displacement Wash Zone A, with this mixture then being discharged through the blow valve 416. Second, the excess filtrate from the washer 408 is pumped into the inlet port of ring 430-1 to start the displacement wash in the most downstream section of the displacement wash zone A. Also, another part of the filtrate from the washer 408 is directed to the outlet of the blow tank to dilute the pulp slurry flowing into the washer 408.

As indicated previously, the washer 408 is desirably the same as (or quite similar to) the washer described in U.S. Pat. No. 5,482,594, the subject matter of which is hereby being incorporated by reference into the present patent application. In the normal mode of the operation of the washer 408, the pulp slurry enters the washer at about a 2% consistency, which means that there is one part pulp to forty-nine parts liquid. In this instance, for purpose of description, it will be assumed that the washer 408 is being operated so that the pulp entering the washer 408 is at 2% consistency. Assuming a dilution factor of 1, and the pulp discharge from the washer 408 at 20% consistency (which means 4 parts water to one part pulp), there is a total wash water quantity of five parts wash water to one part pulp. When this is combined with the forty nine parts water for one part pulp (49 plus 5), the total liquid entering the washer 408 equals 54 parts liquid to 1 part pulp.

The pressure in the digester is at about thirty bars, and there is a pressure reduction of about fifteen to twenty bars, when the pulp passes through the blow valve 416. The blow tank 407 stores the pulp and the liquid so that liquid can be properly fed into the washer 408. (The washer 408 may not be operating at the very same time that there is a discharge from the blow valve 416 of the digester 402, so the blow tank 407 also acts as a buffer.) There is a line 529 that directs the flushed alcohol/water vapors from the blow tank 407 to evaporation and recovery system 418.

Figure 35:
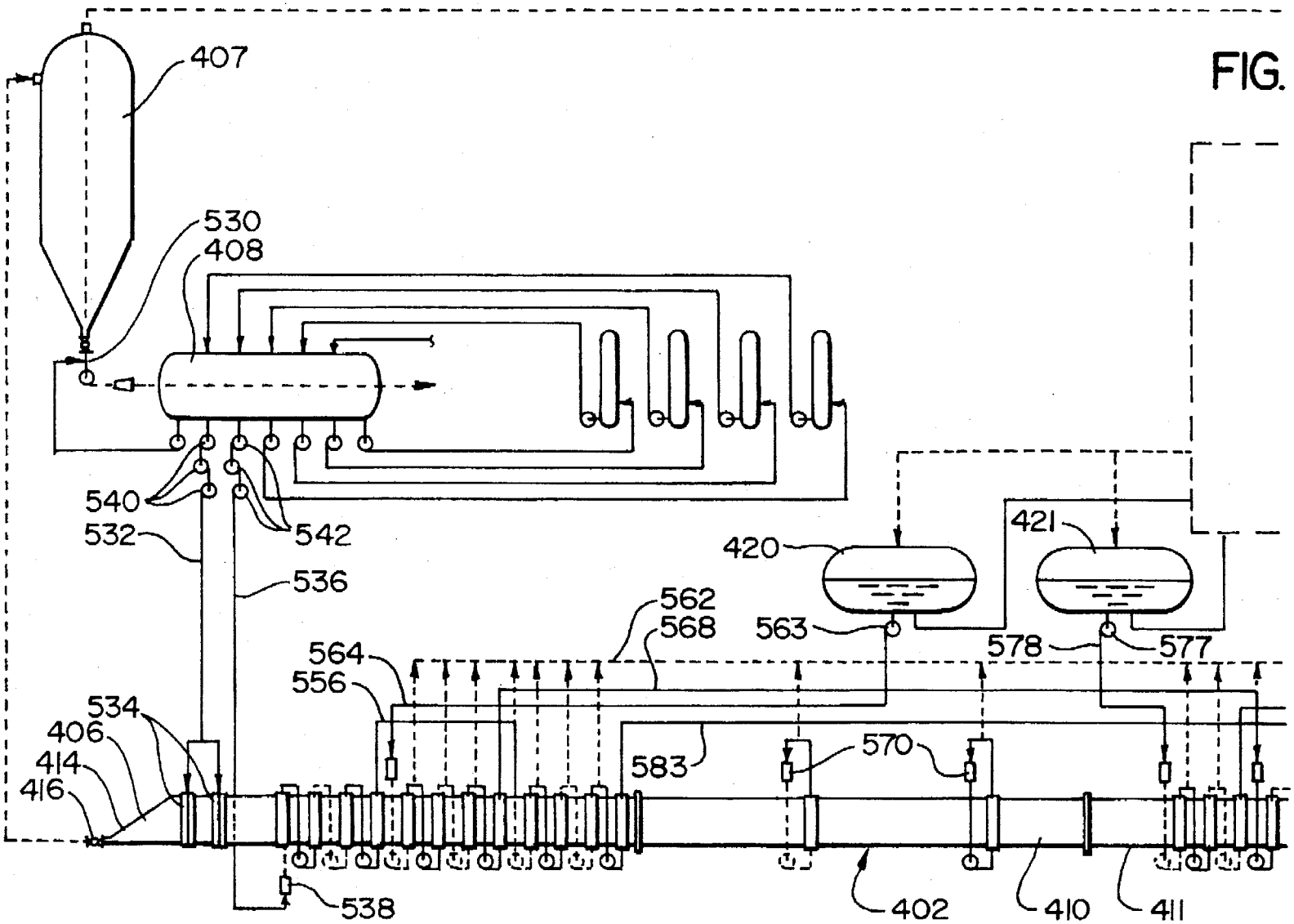
FIG. 35 is a view similar to FIG. 30, but drawn to an enlarged scale, and only showing the left half of the digesting system.

With reference to FIG. 35, of the 54 parts of liquid that enter the washer 408, 33 parts liquid go into the discharge line of the blow tank at 530 to dilute the pulp flowing from the blow tank 407 from about 6% consistency down to about 2% consistency. Ten parts of the liquid from the washer 408 travels through a line 432 to pass into dilution inlet ring 534 in the dilution zone to dilute the pulp in the digester from about 14% to about 6%. Seven parts of liquid from the washer 408 flow through a line 536 to pass through a heat exchanger 538 into the downstream end of the displacement wash zone A. Three pumps 540 in series are provided to pump the liquid from the washer 408 through the line 532 to the dilution inlet rings 534, and another three pumps 542 in series are provided to pump the filtrate from the washer 408 through the heat exchanger 538 and into the displacement wash zone A.

The components in the five zones beginning from the dilution zone through to cooking zone 1 will now be described under appropriate headings.

a. The Dilution Zone

Figure 37:
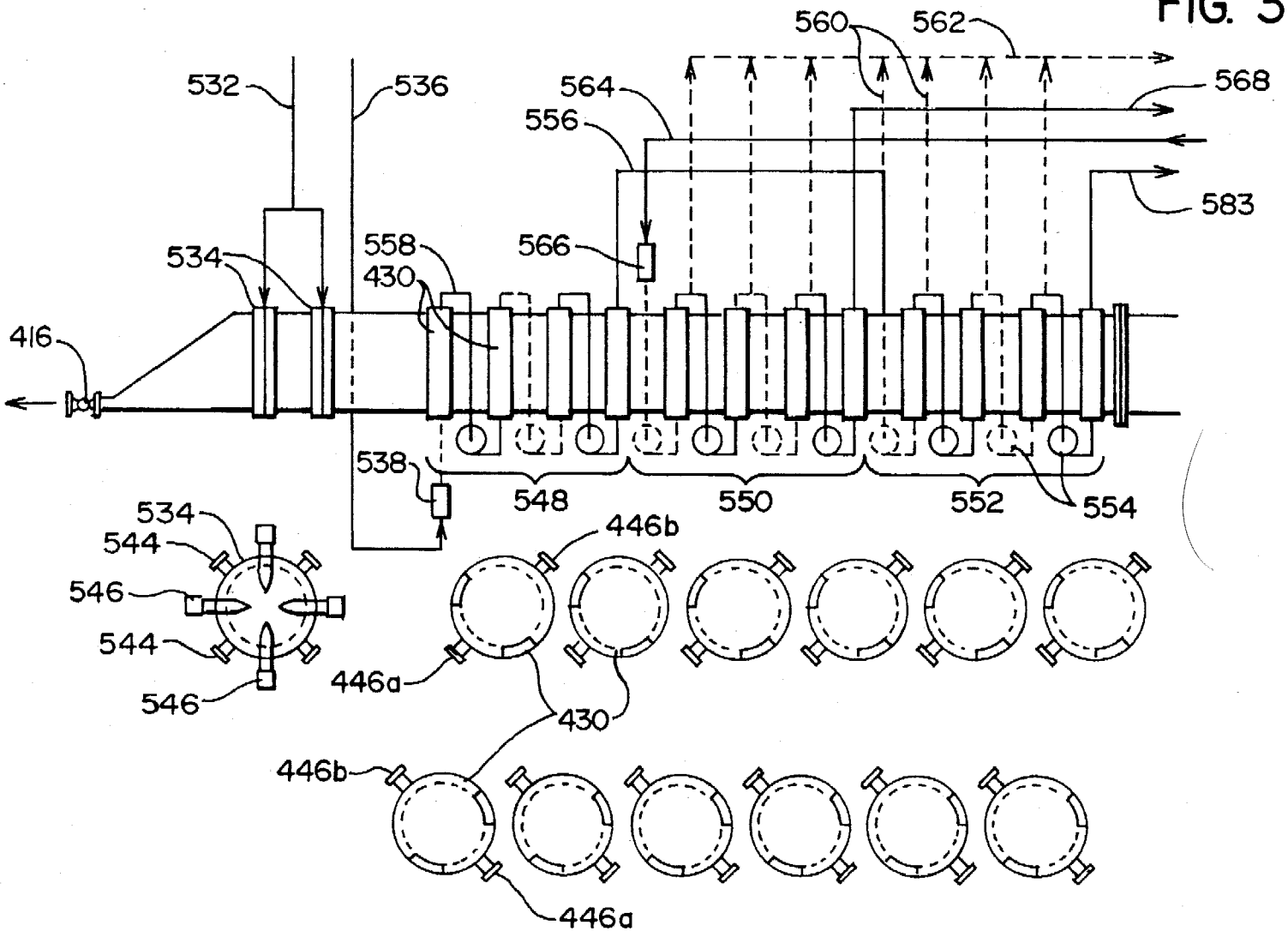
FIGS. 37 through 39 are three views drawn to a further enlarged scale, showing three different portions of the digester, with the downstream portion being shown in FIG. 37, the middle portion being shown in 38, and the upstream portion being shown in FIG. 39.

With reference to FIG. 37, it can be seen that the dilution zone comprises two longitudinally spaced identical filtrate inlet stations, with an inlet ring 534 being at each station. One of the inlet rings 534 is shown in transverse section in FIG. 37, and it can be seen that there are four inlet fittings 544 positioned at 90% intervals around the circumference of the inlet ring 534. Also, there are four rotating agitators 546 which (as the name implies) serve the function of mixing the effluent flowing inwardly through the fittings 544 with the pulp and liquid flowing downstream in the digester 402. These rotating agitators 546 can be the same as, or similar to, the agitator as shown in FIG. 39 in the wood chip feed assembly.

Figure 32:
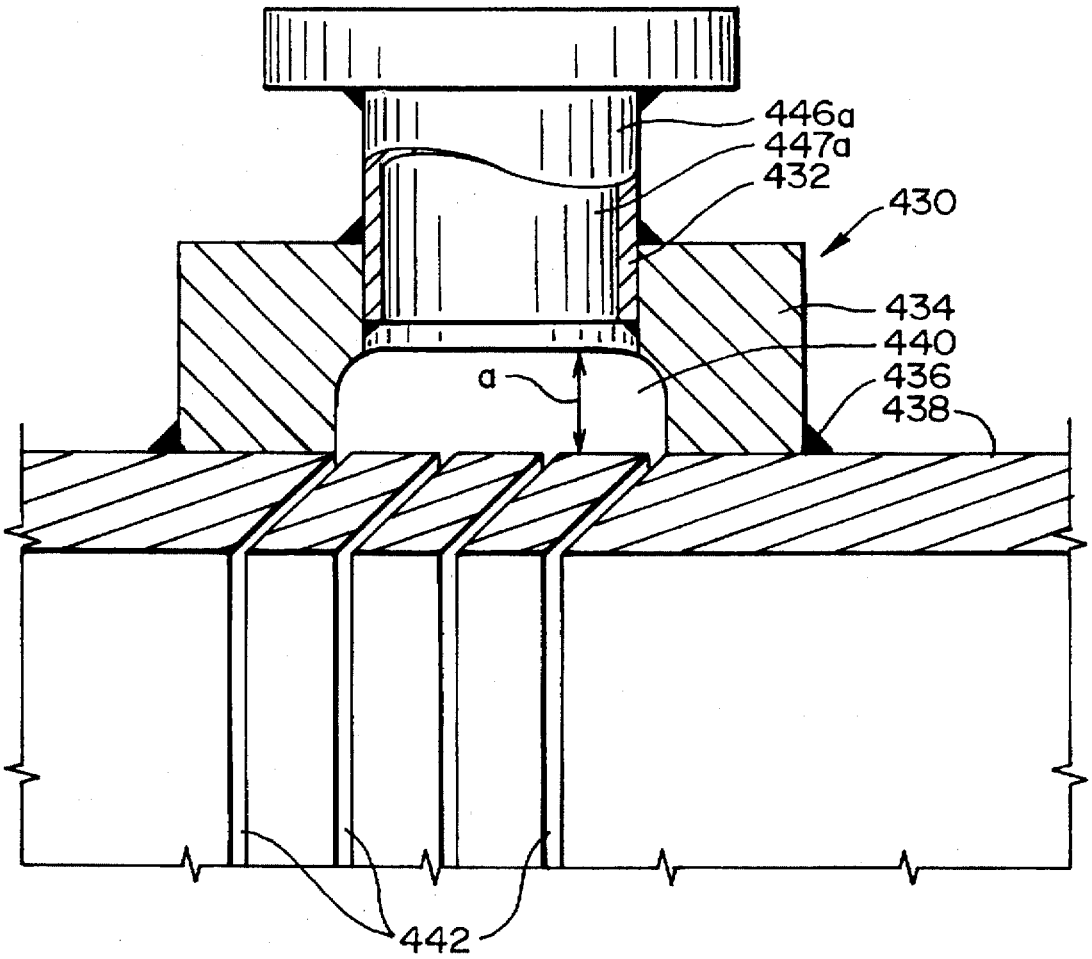
FIG. 32 is a sectional view of an inlet port section of one of the cross flow rings of the present invention.

The two inlet rings 534 each have an outer ring structure which is the same as (or similar to) the ring structure of the cross flow ring as shown in FIG. 32, where the liquid flows inwardly through the circumferential member 432 and into the chamber 440 and further inwardly through the slanted slots 442. Accordingly, it is believed that a detailed description of these two inlet ring stations 534 is not required. The function of this dilution zone is to bring the consistency of the pulp from about 1 part pulp to 6 parts liquid to approximately 1 part pulp to 16 parts liquid, which is the desired consistency at which the pulp and liquid is discharged from the blow valve 416.

b. Displacement Wash Zone A

Reference is made to FIG. 37 where there are shown three displacement wash stations indicated at 548, 550 and 552. Each of these stations comprises four cross flow rings 430. In FIG. 37, only the first two cross flow rings have been given the designation of 430 (to keep FIG. 37 from becoming too cluttered), it being understood that the other cross flow rings are also cross flow rings 430. Also, there are pumps directing the flow from one cross flow ring 430 to another, and two of these pumps have been designated at 554 in FIG. 37 (again to keep FIG. 37 from becoming too cluttered), and the other pumps have not been given numerical designations. The cross flow rings 430 in the first displacement wash section were described in detail previously in this text in Section 18. Accordingly, that description will not be repeated in this portion of the text.

With reference to FIG. 37, there is shown in cross section each of the twelve cross flow rings 430, in displacement wash zone A, and the cross sectional view of each such ring 430 is positioned in alignment below its related cross flow ring 430 which is shown in a side elevational view in the upper part of FIG. 37. It will be noted that the inlet and outlet fittings **446*a* and 446*b*, respectively, are angularly positioned in an alternating pattern so that one ring 430 will have the inlet and outlet fittings 446*a* and 446*b* aligned in an upward slant to the left, and the next adjacent ring 430 will have its inlet and outlet fittings 446*a* and 446*b* oriented in a direction slanting upwardly to the right. Since this was described previously herein relative to FIGS. 31*a* and 31*b***, this will not be described further in this portion of the text.

Flow from the washer 408 flows through the line 536 into the heat exchanger 538. The heat exchanger 538 operates in a manner that the flow from the heat exchanger 538 going into the digester is at about 68° C. This is to maintain the blowout temperature of the pulp/filtrate mixture that passes out the blow valve at about 74° C.

Also, as indicated previously, the outflow from the fourth cross flow ring (designated 430-4 in FIG. 33) flows through a line 556 into the most forward cross flow ring 430 in the further upstream filtrate displacement wash station 552. It can be seen that the flow from the initial filtrate displacement wash station 548 "leapfrogs" the middle alcohol wash station 550 to pass into the further upstream filtrate displacement wash station 552 of displacement wash zone A.

Also, it can be seen in FIG. 37 that to provide recirculating flow between adjacent cross flow rings 430, there are related recirculating conduits 558, each of which connects to the outlet fitting of its related ring 430 and leads through a pump 554 to the inlet fitting of the adjacent upstream cross flow ring 430. Further, it will be noted that there are broken lines 560 leading from many of these recirculating conduits 558, and these represent conduits leading from these recirculating conduits 558 to collect any accumulation of gaseous substances and redirect these through a line 562 back to the evaporation and recovery plant.

The middle alcohol displacement wash zone 550 receives a flow of alcohol from the accumulator tank 420 through a pump 563 and a line 564, which directs the alcohol through a heat exchanger 566 and thence through a pump 554 to flow into the most forward ring 430 of the alcohol displacement wash station 550. The heat exchanger 566 raises the temperature of the alcohol to about 135° C. The tank 420 derives its alcohol from the evaporation and recovery plant, as does the aforementioned tank 421.

The alcohol passing into the most forward ring 430 of the alcohol wash station 550 recirculates in a cross flow pattern through the digester in substantially the same manner as the flow pattern that was described previously herein relative to the cross flow pattern in the most forward filtrate displacement wash section 538, as illustrate in FIG. 33. The flow from the furthest upstream cross flow ring 430 of the middle alcohol wash station 550 flows through a line 568 to pass into the middle filtrate displacement wash station of the displacement wash zone B (which will be described later herein).

It is believed that in order to present a better understanding of the present invention, it would be helpful to review at this time the first part of the table presented in FIG. 42. In line 1, the flow of the filtrate flowing into the washer 408 (designated the "RKS-Washer"), which in this case is pure water, is at 30° C., with zero alcohol content and zero dry solids. The flow of pulp and the filtrate from the blow tank 407 is at a temperature 74° C., with an alcohol content of 17.5% alcohol and 0.07 dry solids. The filtrate which is discharged from the washer 408 (and is directed back to the digester 402) is at 74° C., with an alcohol content of 15% and dry solids of 0.06. The discharge of pulp from the washer 408 is at 50° C., with an alcohol content of 0.2%, and a dissolved solid content of 0.01%. With the assumed values given previously in this text, this pulp would be at 20% consistency.

However, it is within the capability of the washer 408, as described in the U.S. Pat. No. 5,482,594, to obtain even higher consistencies of the pulp being discharged. Also, it should be noted that the only net outflow of liquid from the washer 408 is the liquid which remains in the pulp which is being discharged from the washer 408. The rest of the filtrate from the washer 408 is directed back into the digester 402. As indicated previously, in the overall digester apparatus, there is a net upstream flow of filtrate. This occurs as follows. there is a substantially constant volumetric flow downstream from the rear end 404 to the front end 406 in the chamber 448 of the digester 402. However, at the same time there is a grater flow through the recirculating conduits 558 and in the other lines (i.e., 556, 568 and others) that carry the filtrate to further upstream locations).

Reference is now made back to the table in FIG. 42, and specifically to the values given for the filtrate/liquor flow, at the reference lines 3 through 8. It can be seen that the filtrate which flows outwardly from the most upstream ring 430 of the second filtrate wash zone 552 is at a temperature of 188° C., has an alcohol content of 57%, and a dry solids content of 4.5%. On the other hand, the filtrate/liquor flow raveling into the most downstream ring 430 of the first filtrate wash section 548 has a much lower temperature (68° C.), a much lower alcohol content (15%), and a much smaller dissolved solid content (0.06%). Thus, it can be seen that the net filtrate/liquor flow that is recirculated in an upstream direction increases in dry solids content substantially (0.06% to 4.5%) and also increases in alcohol content (15% to 57%). Further, there is a substantial rise in temperature in an upstream counterflow direction (68° C. to 188° C.). The plurality of wash sections provides fast cooling of the liquor to cause the digesting process to substantially cease.

With further reference to lines 3 through 8 of FIG. 42, on the right hand side values are given for the pulp chip flow. This is the flow which is traveling in the main chamber 448 of the digester vessel 410 in a forward direction toward the discharge end 406. It can be seen that the filtrate flowing from the cooking zone 2 into the portion of the chamber 448 at the start of the displacement wash zone A is at a relatively high temperature (195° C.). It has a dry solids content of 5.9%. By the time this filtrate in the digester chamber 448 reaches the downstream end of the displacement wash zone A, the dry solids have dropped from 5.9% to 0.07%, and the alcohol content has dropped from 59% to 17.5%. Thus, it can be seen that as the pulp/filtrate flow proceeds downstream in the chamber 448 in the displacement wash zone A, it is becoming cooler, clearer, and with less alcohol content. On the other hand, the recirculating counter current flow in an upstream direction is extracting the dry solids from the filtrate in the digester chamber 448 in displacement wash zone a, and carrying this further upstream for eventual discharge into the evaporation and recovery plant 418. Further, there is a net upstream flow of the digesting alcohol.

c. Cooking Zone 2

The pulp and filtrate mixture which leaves the displacement wash zone B travels downstream in the chamber 448 through the cooking zone 2 is maintained at a temperature of approximately 195° C. (As can be seen in FIG. 30, there are a couple of heat exchangers 570 which maintain this cooking temperatures).

The filtrate in the chamber 448 leaving the displacement wash zone B has just traveled through the second alcohol displacement wash section (to be identified and discussed in the next section of this text) and thus has a relatively high alcohol content (59%), and also a rather low level of dry solids (0.3%).

As the pulp/liquor flow proceeds in a continuous manner downstream in the cooking zone 2, the dry solids content in the liquor increases, so that the pulp/liquor passing from cooking zone 2 and into displacement wash zone A has the dry solids content increase from 0.3% (at the start of cooking zone 2) to 5.9% (at the end of cooking zone 2). The time which it would take for a portion of the pulp/liquor mixture to pass through the cooking zone 2 would generally be between about 30 to 60 minutes.

d. Displacement Wash Zone B

Figure 38:
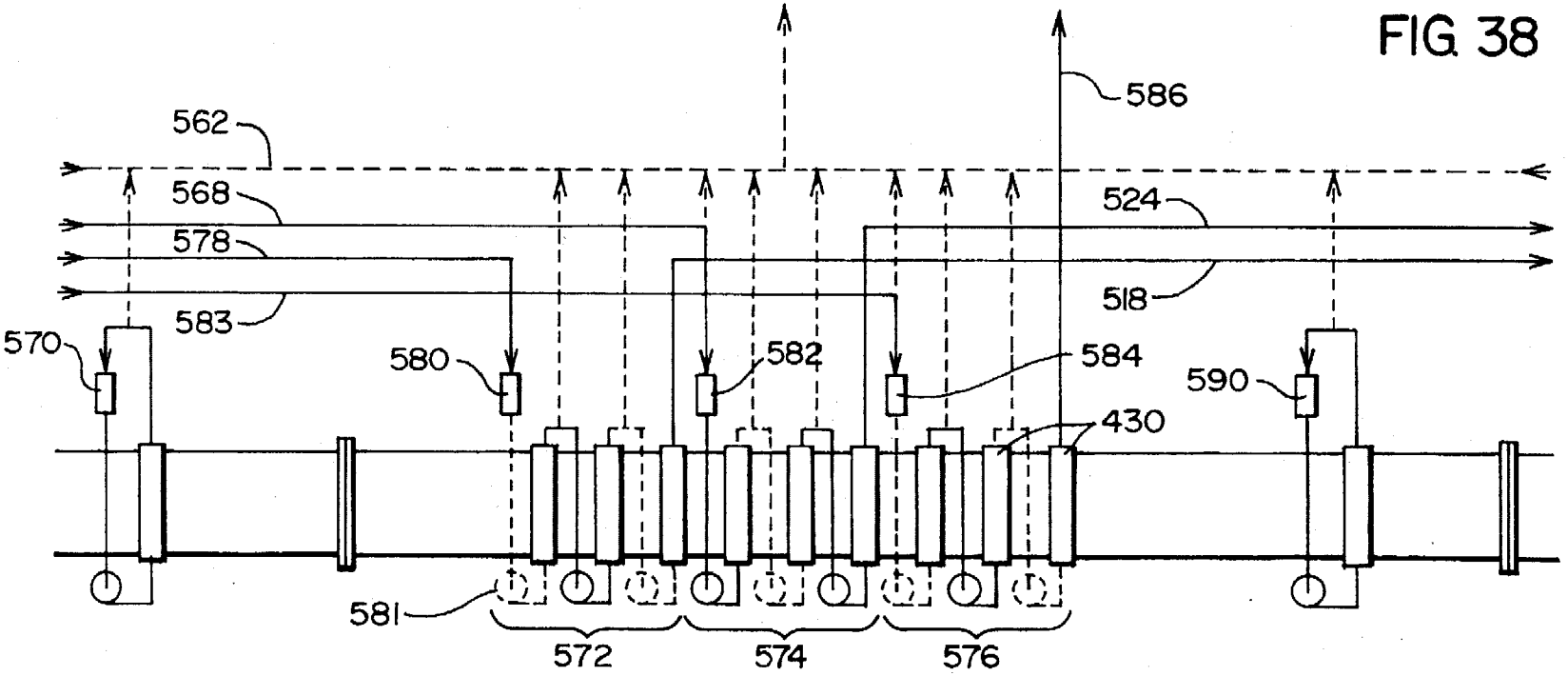

Reference is made to FIG. 38, where it can be seen that in displacement wash zone B there are three wash sections, namely, a first alcohol displacement wash section 572, and two additional filtrate displacement wash sections 574 and 576. Each of these wash sections 572, 574 and 576 comprises three cross flow rings 430. The inflow to the alcohol wash section 572 is from the alcohol accumulator tank 421 through a pump line 577 and 578 which in turn directs the alcohol through the heat exchanger 580 which raises the temperature of this alcohol to about 195° C., with the alcohol then passing into the furthest downstream ring 430 via pump 581. There is generally the same upstream recirculating flow pattern through the three rings 430 at the alcohol wash section 572, and this flow exits from the third ring 430 to pass through the line 518 to then flow through the heat exchanger 512 into the furthest downstream displacement wash section 506 of the impregnation zone (see FIG. 36).

The inflow into the most downstream cross flow ring of the third filtrate displacement wash zone 574 (which is in the middle of displacement wash zone B) is from the line 568 which receives the outflow from the furthest upstream ring 430 of the first alcohol displacement wash section 550. The flow through the line 568 passes through a heat exchanger 582 which raises the temperature of this filtrate to about 195° C. The outflow from the third filtrate displacement wash section 574 is from its furthest upstream ring of that section 574 through the aforementioned line 524 to pass through the heat exchanger 514 into the downstream cross flow ring of the middle displacement wash zone 508 of the impregnation zone (see FIG. 36).

The outflow from the most upstream cross flow ring of the second filtrate displacement wash zone 552 (see FIG. 37) is through the line 583 to pass through a heat exchanger 584 and enter into the furthest downstream ring of the fourth filtrate displacement wash section 576 (which is the furthest upstream section of the displacement wash zone B). The flow from the most upstream ring 430 in the section 576 is through the line 586 to the evaporation and recovery plant 418. It will be noted that the flow into the line 586 is mostly from the cooking zone 1, and that at the downstream end of the cooking zone 1, there is a dry solids content in the liquor in the digester chamber 448 of 10.4%. The dry solids passing outwardly from the most upstream ring 430 of the fourth filtrate displacement wash section 576 is about 9.1%.

e. Cooking Zone 1

Figure 36:
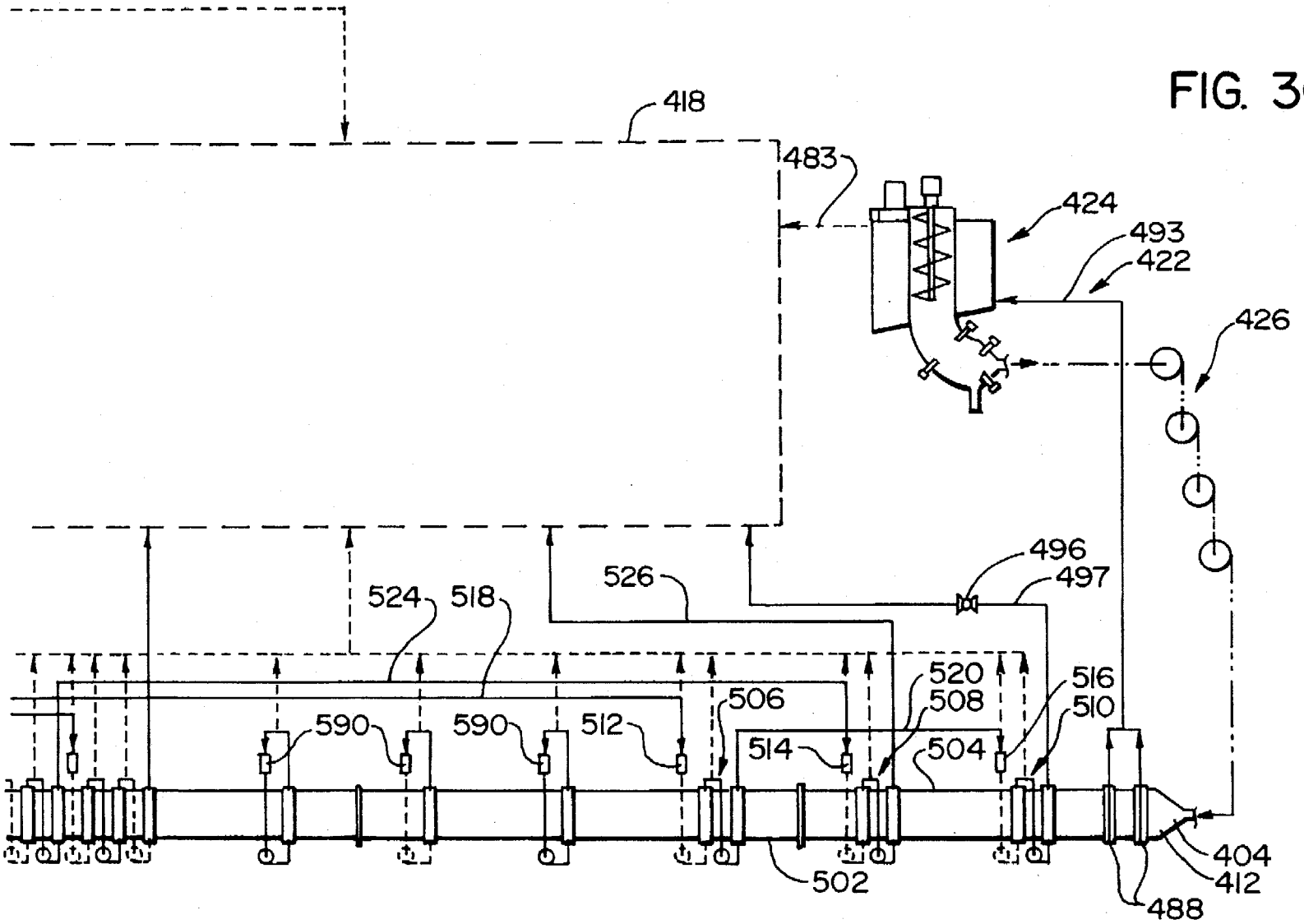
FIG. 36 is a view similar to FIG. 30, but drawn to an enlarged scale, and showing the right half of the digesting system of FIG. 30.

Reference is made to FIGS. 31 and 36. The flow of the pulp/filtrate leaving the impregnation zone has a dry solids content of about 3.3%, and this dry solids content increases to about 10.4% as the flow is exiting from the cooking zone 1. The temperature in cooking zone 1 is maintained at about 195° C., and three heat exchangers 590 are provided along the length of cooking zone 1 for this purpose, and the time for the pulp/liquor to flow through cooking zone 1 would be between 30 to 60 minutes.

To appreciate some of the benefits derived from the present invention, it would be helpful to pause at this point and review some of the values presented in the chart of FIG. 42. An analysis of the values presented in that chart will indicate that due to the recirculating upstream flow provided in the present invention, the dry solids content of the filtrate exiting from the digester 402 through the line 586 into the evaporating and recovery plant 418 is about 9% and is derived not only from the dry solids extracted from the pulp in cooking zone 1, but also partially from the dry solids extracted from the pulp in the cooking zone 2. Also, it becomes evident that by reviewing the overall chart FIG. 42, the dry solids that eventually leave the entire system in a path other than through the eh lines directed back to the evaporation and recovery plant 418, are only a very, very small fraction of the dry solids extracted from the pulp. This can be seen by examining reference line 2 of the chart of FIG. 42 where the percentage of dry solids is given for the discharge of the washer 408.

f. Other Modifications and Further Comments

Figure 40:
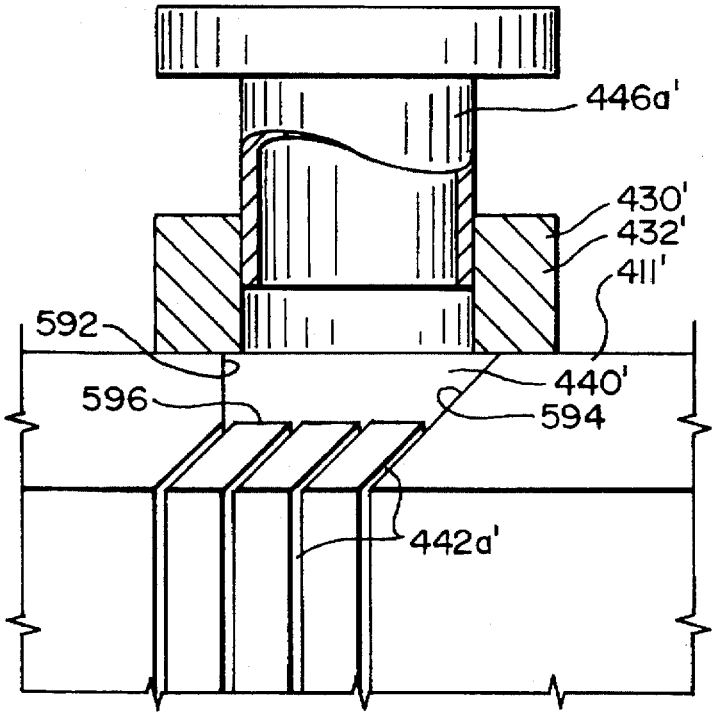
FIG. 40 is a view similar to FIG. 32, showing a modified form of a cross flow ring.

It is apparent that various modifications could be made in the present invention without departing from the basic teachings thereof. For example, FIG. 40, there is shown a modified form of the cross flow ring 430. Components of this cross flow ring which are similar to a ring that is shown in FIG. 32 will be given like numerical designations, with a prime (') designation distinguishing those of the arrangement in FIG. 40. As shown in FIG. 40, the ring 430' has simply a circumferential curved plate 432' without the flanges 434 as shown in FIG. 32. To form the chamber of 440', the outer wall 411' is recessed, and thus the chamber 440' is defined by the surfaces 592, 594 and 596 that are formed out of the digester side wall 411' at the time the chamber 440' is formed (e.g., by simply machining a circumferential recess into the wall') These portions of the recess 440' which are not to serve as flow passageways can simply be filled in with metal solder or other filler material. The intake fitting 446*a'* is formed as shown in FIG. 32, and an opening is drilled in the surrounding wall 432' to receive the fitting 446*a'*.

Figure 41:
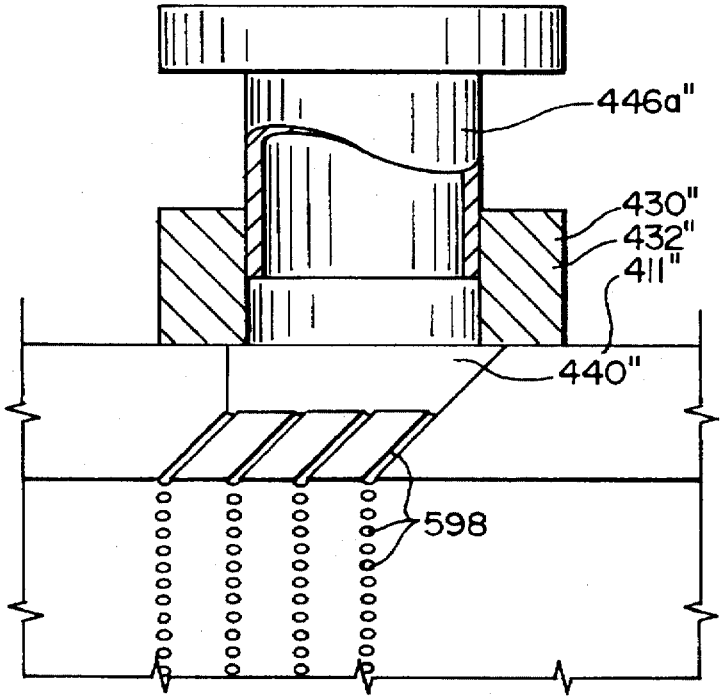
FIG. 41 is a view similar to 40, but showing a yet further modified version of the cross flow ring.

FIG. 41 shows substantially the same arrangement as shown in FIG. 40, but shows a further modification of the ring 430. The components of this further modification to FIG. 41 will be given numerical designations corresponding to those in 440, except that there will be a double prime ("" to distinguish those in the arrangement in FIG. 41.

The ring 430" has the chamber 440"? ? ? cut out of the wall 411", as in FIG. 40. However, instead of having the slots 440*a*, there are a plurality of slanted bore holes 598 formed in the side wall 411". Thus, the flow is through these bore holes 498 on one side of the ring 430", and out through similar bore holes 498 in the opposite side of the ring 430".

Another possibility is that during the operation of the digester 402, it could be subjected to vibrations for various purposes (e.g., to enhance the diffusion of dry solids from the inside of pulp fibers and/or chips and to dislodge chips that may have been stuck in inlets and outlets). Also, the digester could be rotated about its lengthwise axis back and forth for this same purpose or other purposes.

22. The Evaporation and Recovery System

Figure 43:
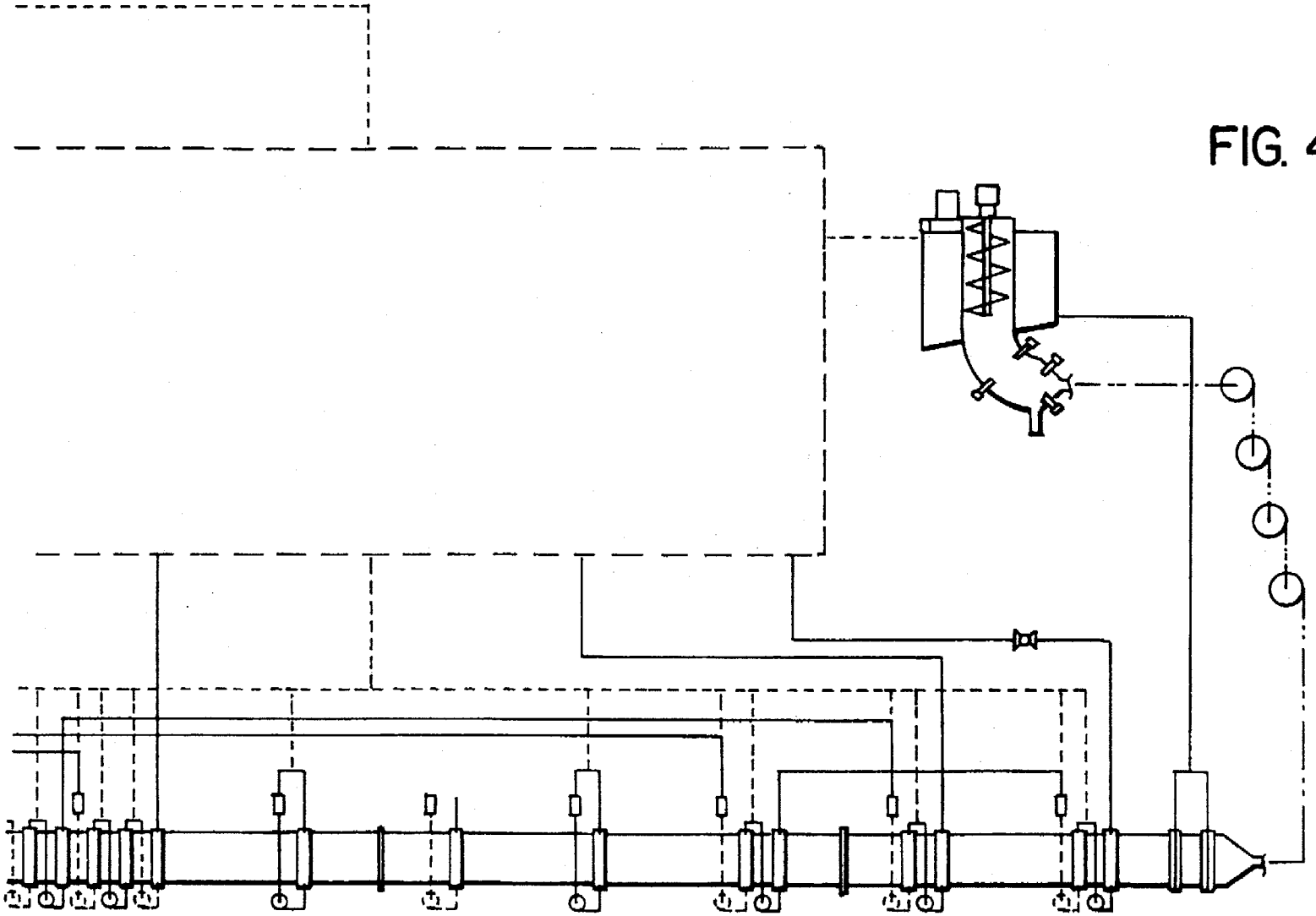
FIG. 43 is a semi-schematic view showing a modification of the cooking zone 1 shown in FIG. 30.

As a further modification, as shown in FIG. 43, the cooking zone 1 has been divided into cooking zone 1A and cooking zone 1B. The liquor is extracted at the end of each of cooking zones 1A and 1B, and these are directed through separate liquor streams into the evaporation and recovery system 418. Present analysis would indicate that the composition of the liquor from these two separate locations of the cooking zone 1A and 1B would differ so that the separation of by-products would be enhanced.

Figure 44:
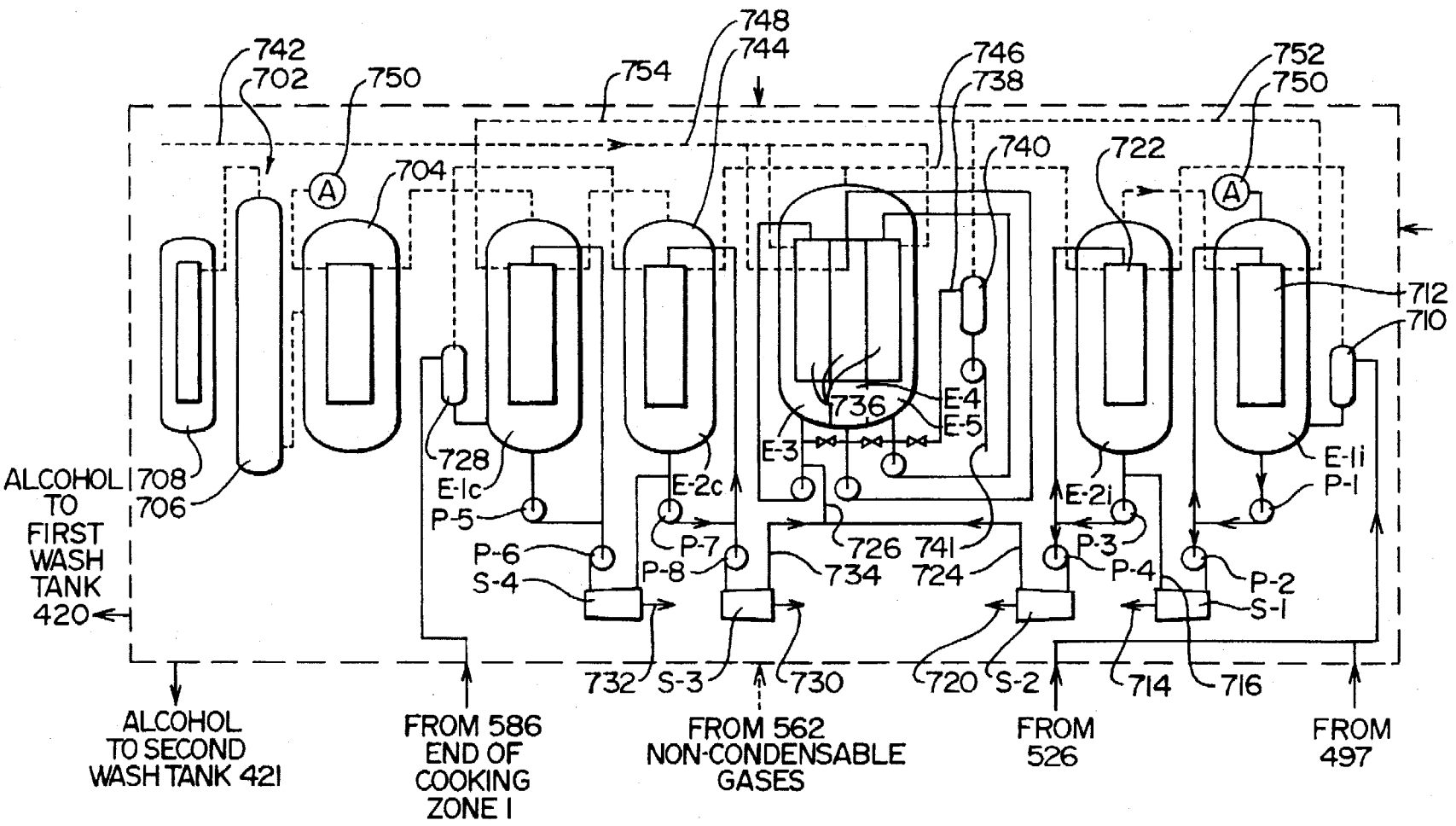
FIG. 44 is a schematic view illustrating the evaporation and recovery system of the present invention.

FIG. 44 shows the evaporating and recovery system of the present invention. There are three liquor inputs into the system 418. Two of these are through the lines 526 and 497 from impregnation zone. The third is through line 586 from the end of cooking zone 1. The alcohol that is recovered in the system 418 is discharged to two locations, one to the first alcohol wash tank 420 and the second to the second alcohol wash tank 421. The system 418 removes substantially all of the alcohol, and a substantial amount of the water from the pulping liquors directed into the system 418.

The system 418 comprises an alcohol recovery system 702, which may be conventional and in this instance comprises a condensate stripper 704, an alcohol distillation column 706, and an alcohol condenser 708. The system 418 also comprises an evaporating system which comprises three sets of evaporating units. These evaporating units (which in the industry are called "vapor bodies") can be conventional, and each comprise a containing tank, a heat exchanger, a liquor circulation means, a vapor supply line and a condensate removal system. There is a first set, comprising first and second stage evaporator units designated E-1i and E-2i. These two evaporators E-1i and E-2i receive liquor from the impregnation zone. There is a second set of evaporator units comprising two evaporator units E-1C and E-2C which receive liquor from the downstream end of cooking zone 1. Then there is a third evaporating section having three stages or units, these being designated, respectively, E-3, E-4 and E-5.

In FIG. 43, the flow of the liquid material in the recovery system is shown in solid lines, while the flow of vapor is shown in broken lines. First, there will be a description of the manner in which the liquid flow passes through the system, and then a description of the flow of the steam added to the system and the flow of alcohol and water vapor evaporated from the liquor.

The flow of liquid from the impregnation zone flows through the inlet lines from 526 and 497 into a blow tank 710, and thence into the tank of the first evaporator stage E-1i. The liquid is recirculated by the pump P-1 upwardly through a flow line and back into the tank of E-1i, and into the upper end of a heat exchanger 712. Also, a portion from the flow from the pump P-1 is conveyed by the pump P-2 into a first separator S-1. This separator S-1 can be one of a number of different types of separators. The portion of the liquor which is extracted in the separator S-1 is indicated by the arrow 714. The remaining portion of the liquid from the separator S-1 is directed through the line 716 into the second stage evaporator E-2i.

The second stage evaporator unit E-2i has pumps P-3 and P-4 which operate in substantially the same manner as the pumps P-1 and P-2, with a portion of the liquor being directed to the second stage separator S-2. The portion extracted from the separator is discharged through the discharge line 720. The other portion of the liquor is recirculated upwardly and into the heat exchanger 722 of the second stage E-2i. The unextracted liquor from the separator section S-2 is directed through the line 724 and thence into a line 726 leading into the middle evaporator section comprising the three evaporator stages or units, E-3, E-4 and E-5.

Attention is now directed to the evaporator units in the second section, namely units E-1c and E-2c. These have pumps P-5, P-6, P-7 and P-8. Also, there are two by-product separators S-3 and S-4. The flow from the line 586 at the downstream end of cooking zone 1 enters the blow tank 728, with the liquid passing through the evaporator units E-1c and E-2c in substantially the same manner as described previously with respect to the evaporators of the first section, namely E-1i and E-2i. The liquor stream that is extracted in the separation process from the two separators S-3 and S-4 are designated 730 and 732, respectively. The flow from the separator S-3 which is not extracted in the separation process goes through line 734 into the line 726 to flow into the center evaporator section.

Various separating techniques could be used in one or more of the separators S-1, S-4. For example, a conventional centrifuge could be utilized, where oils are being separated since the oils are less dense than the lignin. Conventional filters also could be used, or systems where an added substance reacts with the desired by-products, making these heavier or lighter so that they either sink to bottom or flow to the top. Or the added substance could make the desired by-product stickier, or possibly heavier so that it could be more easily separated by a centrifuge. Further, in the evaporation process, the alcohol will evaporate more rapidly than the water because of its lower boiling point and other characteristics. Thus, since alcohol is the dissolving agent, when it evaporates it frees the organic solids from suspension. This better enables the lignin to be spun off by centrifugal force to free most of the extraneous materials (oils, etc.).

The by-product(s) removed by separator S-1 have a rather different composition than those separated by the separator S-2, since the liquor which goes into the separator S-2 has practically all of the alcohol removed therefrom. This is also true with regard to the separation that takes place at the Separators S-3 and S-4, with most all of the alcohol being removed from the liquor that goes to S-4.

While the evaporating system shown in FIG. 44 has shown only two liquor streams going into the evaporating process, it is within the scope of the present invention to have yet more separate liquor streams. For example, the two streams from the lines 526 and 497 from the impregnation zone could be treated separately. Also, more than two cooking zones could be provided, and liquor streams could be taken from locations at each such cooking zone.

In the center evaporator section, there are three evaporating units/stages E-3, E-4 and E-5, and each stage comprises its own heat exchangers and recirculating components as previously described. The liquor flow in the stages are each handled separately, but the vapors are mixed to comprise one vapor stream. The three heat exchangers are each designated 736. The flow of liquor from the line 326 flows in a recirculating pattern through all three of the heat exchangers 736 in series, which recirculating pattern is or may be conventional in the prior art. Accordingly, this will not be described in detail herein. Specifically the liquor flow progresses from stage 3 to stage 4 and then to stage 5. The discharge of liquor from evaporation unit E-5 is through a line 738, into a blow tank 740, with the liquor being discharged through the line 741 to be delivered to the spray dryer.

Attention is now directed toward the flow of steam and vapor in the evaporation and recovery system 418. The steam is directed into the system 418 through a steam line 742 to the center section of evaporator units and is directed through three steam lines into the three heat exchangers 736 in the third, fourth and fifth stages E-3, E-4 and E-5. The vapors resulting from evaporators in E3, E4 and E5 is then directed through the lines 746, 748 to, respectively, heat exchangers in the two evaporating sections E-2i and E-2c. Then vapor from the evaporator units E-2i and E-2c of the second evaporating section. The vapor is then directed through the two heat exchangers of the evaporating sections E-1i and E-1c, The vapor collected in the evaporators E-1i and E-1c into the line 750, which leads directly into the heat exchanger of condensate stripper 704. For convenience of illustration, since the line 750 begins at the right hand part of FIG. 44 and extends all the way to the left hand side of FIG. 44 where it enters the condensate stripper 704, the line 750 is not shown extending all the way across the page. Rather, as shown, the line 750 ends at a circle with a designation "A" therein, and picks up again at the left hand side of the FIG. 750 where there is another circle with the designation "A" therein.

The vapor discharged from the blow tank 740 travels through two lines 752 and 754 to be delivered to, respectively, the heat exchanger 712 of the evaporator E-1i and to the heat exchanger in the evaporator E-1c.

To review the overall operation of the recovery system of FIG. 43, several items should be noted. First, the liquor from the impregnation zone is treated separately, and portions of this liquor are extracted at two separating stages S-1 and S-2. This is to recover some of the liquor components which are removed from the fibers at an earlier stage in the overall digesting system. Then the liquor from the downstream end of cooking zone 1 also has portions thereof separated at relatively early stages in the evaporation process, namely separation stage S-4 and S-3. The reason for this is that this earlier extracted liquor has a somewhat different character than the liquor going through the entire evaporation process. The liquor that travels from the first evaporator section, E-1i and E-2i, and from the second evaporator section (evaporators E-1c and E-2c) is delivered into the central evaporating section (evaporating stages E-3, E-4 and E-5) where it goes through a further evaporation process, and as indicated previously, is discharged at 741 to be delivered to the spray dryer.

The condensate from the heat exchangers in the seven evaporating units can be treated in a conventional manner. Any condensate which has such a low percentage of alcohol content so that further alcohol recovery would be uneconomical would be discharged from the recovery system. The condensate that has a sufficiently high percentage of alcohol therein for economical recovery is directed to the alcohol recovery section.

The non-condensable gases which enter the recovery system through the line 562 can be treated in a conventional manner in the recovery system. Accordingly, these will not be discussed further herein.

It is to be understood that within the scope of the present invention, there could be additional liquor streams from other portions of the digester entering into the recovery system, and these could be treated in separate evaporator sections, so that there would be additional sets of evaporators, such as indicated in the first section at E-1i and E-2i, and also in the second evaporator section (evaporators E-1c and E-2c). Likewise, there could be additional by-product separator sections such as those shown at S-1 through S-4.

23. Final Comments

To review briefly some of the desirable features of the present invention, it will be noted that except for the flow area at 498 (see FIG. 39), the wood chip/pulp/filtrate flow within the digester 402 is a substantially continuous downstream flow through the length of the digesting chamber 448. Thus, the wood chips initially introduced into the digester are in the process of becoming pulp as they flow through the digester along with the liquid in the digester chamber 448. The counter current flow (i.e., recirculating flow) is accomplished in a manner so that there is a cross flow transverse to the main forward flow through the digester chamber 448. Yet, there is overall a net upstream flow so that all of the filtrate from the washer 408 (except for the liquid that is discharged with the washed pulp) is directed into the downstream end of the digester 402 and is discharged at further upstream locations. Further, it can be seen that the overall migration of the dry solids is also in an upstream direction in the digester 402.

While alcohol is a preferred digesting agent in the present invention, other digesting agents could be used. For example, the present invention could be adapted for the Kraft process, sulfite process, or other digesting processes. Further within the scope of the present invention, while the present invention is particularly adapted for the digesting of wood products, it could be utilized for other materials such as hemp, linen and other plant material. Also, while in the preferred form, the digester has its longitudinal axis horizontally aligned, within the broader scope, the digester could be positioned vertically, or on a slant to both the horizontal and vertical.

As indicated above, there are various modifications which can be made to the present invention without departing from the basic teachings thereof.

What is claimed:

1. A continuous digester system comprising:

a. a pressure vessel having a lengthwise axis, a rear upstream inlet end having a wood chip intake means, and a front outlet end having a pulp outlet means, said vessel having an elongate processing chamber through which wood chips travel forwardly in the presence of a digesting agent while being transformed into pulp, with the pulp being discharged from the pulp outlet means at the front outlet end of the vessel;

b. liquid flow means to circulate processing liquid through said digester to carry dissolved solids with said processing liquid, said flow means comprising;

i. initial inlet means to initially introduce processing liquid into the pressure vessel at an initial inlet downstream location;

ii. a plurality of processing liquid inlet means at inlet locations along the lengthwise axis of the pressure vessel to introduce processing liquid into the processing chamber;

iii. a plurality of processing liquid outlet means at outlet locations along the lengthwise axis of the pressure vessel to extract processing liquid from said processing chamber, said outlet locations being spaced laterally from said inlet locations, so that flow of said processing liquid from each of said inlet means to related outlet means has a lateral flow component through said processing chamber;

iv. recirculating means comprising a plurality of interconnecting line means, at least some of said interconnecting line means connecting at least some of the outlet means with related inlet means at further upstream locations to direct processing liquid from said at least some of said liquid outlet means through related interconnecting line means to further upstream locations to flow through the related liquid inlet means into the processing chamber and laterally in the processing chamber to other outlet means to again be recirculated through related interconnecting line means to other inlet means;

v. liquor outlet means to discharge liquor, said liquor outlet means being upstream of the initial downstream location and upstream of at least some of said liquid inlet means and said liquid outlet means;

c. said digester system being characterized in that the processing liquid moving in a recirculating pattern through the processing chamber and through said recirculating means carries dry solid content extracted from the wood chips during processing in the processing chamber in a net upstream flow pattern to be discharged from the processing chamber at said liquor outlet means.

2. The system as recited in claim 1, wherein there is a washer to receive pulp from the digester and to dewater and wash the pulp, a substantial portion of filtrate from the washer being directed into the initial inlet means as said processing liquid to move through said recirculating means in said net upstream direction.

3. The system as recited in claim 2, wherein a digesting agent is introduced into said liquid flow means to flow through said recirculating means and through said processing in a net upstream direction to extract dry solids content from said wood chips being processed and carry said dry solids content in a net upstream direction.

4. The system as recited in claim 3, said system further comprising an evaporation and recovery means to receive liquor discharged from said pressure vessel at a plurality of discharge locations at different operating locations in said pressure vessel so as to extract liquor having different characteristics from different extraction locations.

5. The system as recited in claim 4, wherein said digesting agent is alcohol, with said evaporation and recovery means extracting said alcohol from said black liquor and recirculating said recovery alcohol back to said liquid flow means to be recirculated into said liquid flow means.

6. The system as recited in claim 1, wherein said system comprises an impregnation zone located in said pressure vessel at an upstream location, at least one cooking zone located downstream of said impregnation zone, and at least one wash displacement zone located downstream of said cooking zone, at least some of said liquid inlet means and said liquid outlet means being located at said displacement wash zone to receive said processing liquid and recirculate said processing liquid sequentially through related pairs of said liquid inlet means and said liquid outlet means, said flow means further comprising means to move the processing liquid from the wash displacement zone to an upstream location to be directed into said cooking zone, to flow in a downstream direction in the processing chamber toward said displacement wash zone.

7. The system as recited in claim 6, wherein at least some processing liquid from said displacement wash zone is recirculated ultimately to said impregnation zone to flow downstream in said vessel through said impregnation zone and into said cooking zone.

8. The system as recited in claim 7, wherein liquor is extracted from the impregnation zone and directed to said evaporation and recovery means for processing.

9. The system as recited in claim 8, wherein liquor is extracted from said cooking zone and directed to said evaporation and recovery means for processing.

10. The system as recited in claim 1, wherein said liquid flow means comprises at least one displacement wash zone, having a downstream end and an upstream end, with a plurality of said liquid inlet means being positioned at longitudinally spaced inlet locations along a length of said displacement wash zone and a plurality of said liquid outlet means positioned at spaced locations along a length of said displacement wash zone, said pluralities of liquid outlet and liquid inlet means being arranged so that there are a related first downstream and a second upstream liquid inlet means being arranged to a related first downstream and second upstream outlet means in a manner that at least a portion of processing liquid from said first downstream inlet means flows through said processing chamber to pass into said first downstream outlet means, with at least a portion of flow into said first downstream inlet means being recirculating through said recirculating means to said second upstream inlet means, with at least a portion of the flow from said second liquid inlet means flowing across said processing chamber to said second upstream inlet means, with at least a portion of the flow from said second upstream inlet means being recirculated by said recirculating means in an upstream direction, thus accomplishing said net upstream flow of processing liquid.

11. The system as recited in claim 1, wherein said pressure vessel has a generally cylindrical cross sectional configuration transverse to its lengthwise axis, and said digester system comprises an inner-containing means positioned within said pressure vessel, with said inner-containing means defining the elongate processing chamber, said inner-container means comprises at least in part planar wall surfaces.

12. The system as recited in claim 11, wherein there are inlet screen means and outlet screen means located at longitudinally spaced locations at said planar wall surfaces, at least some of said liquid inlet means passing liquid into said processing chambers through related screen means, and at least some of said liquid outlet means discharging processing liquid through related screen means, at least some of said screen means having propeller blade means which move across related screen means to prevent obstruction of flow through said screen means.

13. The system as recited in claim 1, wherein said pressure vessel comprises a generally cylindrical sidewall, which defines the processing chamber as a generally cylindrical processing chamber, at least one of said liquid inlet means and liquid outlet means comprises liquid passageway means formed in said cylindrical sidewall, said liquid passageway means having flow axes, said flow axes being slanted in a radially inward and forward direction.

14. The system as recited in claim 13, wherein said liquid flow means comprises a plurality of circumferential ring assemblies positioned at longitudinally spaced locations along said sidewall, each of said ring assemblies defining a flow chamber to communicate with related passageway means extending through said wall member.

15. The system as recited in claim 1, wherein said plurality of liquid inlet means and said plurality of liquid outlet means are arranged in alignment pairs, having an alignment flow path between the liquid inlet means and the liquid outlet means of a related pair, at least some of said pairs of liquid inlet and liquid outlet means being arranged in an alternating pattern, whereby cross flow of processing liquid between adjacent alternating pairs have different flow directions through said processing chamber.

16. The system as recited in claim 1, wherein said elongate processing chamber is defined by a longitudinally extending chamber wall means, said liquid inlet means and said liquid outlet means being positioned at said chamber wall means in a manner that said liquid inlet means causes processing liquid to flow through said chamber wall means into said processing chamber, and said liquid outlet means extracts processing liquid from said processing chamber through said chamber wall means, said liquid inlet means and said liquid outlet means being arranged in related alignment pairs where at least some of the liquid from the liquid inlet means flows in a flow path substantially across said processing chamber to its related liquid outlet means.

17. The system as recited in claim 1, wherein there is an evaporation and recovery means to receive liquor discharged from said pressure vessel, said evaporation and recovery means comprising at least first and second heat exchange means to cause evaporation of liquid from said liquor, and first and second separator means, said first evaporator means being arranged to initially receive liquor from said pressure vessel and to discharge liquor from said first heat exchange means, means to direct liquor from said first heat exchange means to said first separator means said first separator means to separate a portion of the liquor from to the first evaporator means, means to direct remaining liquor from said first separator means to said second heat exchange means where said remaining liquor is subjected to a further heat exchange process, means to direct liquor from said second evaporator means to said second separator means to extract a portion of the liquor from said second heat exchanger means.

18. The system as recited in claim 1, wherein there are:

a. at least one impregnation zone at an upstream location in said pressure vessel;

b. first and second cooking zones, with said first cooking zone being positioned downstream of said impregnation zone, and said second cooking zone being located downstream of said first cooking zone;

c. first and second displacement wash zones, with said first displacement wash zone being positioned downstream of said second cooking zone, and said second displacement wash zone being positioned between said first and second cooking zones;

d. each of said displacement wash zones having a downstream end and an upstream end, with a plurality of said liquid inlet means being positioned at longitudinally spaced inlet locations along a length of said displacement wash zone and a plurality of said liquid outlet means positioned at spaced locations along a length of said displacement wash zone, said pluralities of liquid outlet and liquid inlet means being arranged so that there are a related first downstream and a second upstream liquid inlet means being arranged to a related first downstream and second upstream outlet means in a manner that at least a portion of processing liquid from said first downstream inlet means flows through said processing chamber to pass into said first downstream outlet means, with at least a portion of flow into said first downstream inlet means being recirculated through said recirculating means to said second upstream inlet means, with at least a portion of the flow from said second liquid inlet means flowing across said processing chamber to said second upstream inlet means, with at least a portion of the flow from said second upstream inlet means being recirculated by said recirculating means in an upstream direction, thus accomplishing net upstream flow of processing liquid in said displacement wash zone;

e. said recirculating means interconnecting said first and second wash zones with said first and second cooking zones and said impregnation zone in a manner that within said processing chamber, there is a substantially continuous flow of pulp and processing liquid in a downstream direction from the inlet end to the outlet end, and a substantially continuous flow of processing liquid from said displacement wash zones through said recirculating means to upstream locations into said first and second cooking zones and into said impregnation zone, whereby dissolved solids are carried through said recirculating means in a net upstream direction, while wood chips being processed into pulp and the processing liquid in the digester travel in downstream direction.

19. The system as recited in claim 1, wherein said pressure vessel is aligned so that its major alignment component is horizontal.

20. A method of digesting wood chips, said method comprising:

a. providing a pressure vessel having a lengthwise axis, a rear upstream inlet end having a wood chip intake means, and a front outlet end having a pulp outlet means, said vessel having an elongate processing chamber;

b. feeding wood chips through said wood chip intake means into said processing chamber and causing said wood chips to travel forwardly in said processing chamber in the presence of a digesting agent while being transformed into pulp, and discharging the pulp from the pulp outlet means at the front outlet end of the vessel;

c. circulating processing liquid through said digester to carry dissolved solids with said processing liquid by:

i. initially introducing processing liquid into the pressure vessel at an initial inlet downstream location;

ii. directing processing liquid through a plurality of processing liquid inlet means at inlet locations along the lengthwise axis of the pressure vessel into the processing chamber;

iii. directing processing liquid from said processing chamber through a plurality of processing liquid outlet means at outlet locations along the lengthwise axis of the pressure vessel to extract processing liquid from said processing chamber, with said outlet locations being spaced laterally from said inlet locations, so that flow of said processing liquid from each of said inlet means to related outlet means has a lateral flow component through said processing chamber;

iv. recirculating said processing liquid through a plurality of interconnecting line means, with at least some of said interconnecting line means connecting at least some of the outlet means with related inlet means at further upstream locations, by directing processing liquid from said at least some of said liquid outlet means through related interconnecting line means to further upstream locations to flow through the related liquid inlet means into the processing chamber and laterally in the processing chamber to other outlet means to again be recirculated through related interconnecting line means to other inlet means;

v. discharging liquor through liquor outlet means at at least one location upstream of the initial downstream location and upstream of at least some of said liquid inlet means and said liquid outlet means;

d. said method being characterized in that the processing liquid moving in a recirculating pattern through the processing chamber and through said recirculating means carries dry solid content extracted from the wood chips during processing in the processing chamber in a net upstream flow pattern to be discharged from the processing chamber at said liquor outlet means.

* * * * *